US009310163B2

(12) United States Patent
Bay

(10) Patent No.: US 9,310,163 B2
(45) Date of Patent: Apr. 12, 2016

(54) SYSTEM AND METHOD FOR AUTOMATICALLY TARGETING A WEAPON

(76) Inventor: Laurence Andrew Bay, Atlanta, GA (US)

( * ) Notice: Subject to any disclaimer, the term of this patent is extended or adjusted under 35 U.S.C. 154(b) by 915 days.

(21) Appl. No.: 13/435,830

(22) Filed: Mar. 30, 2012

(65) Prior Publication Data

US 2014/0110482 A1 Apr. 24, 2014

Related U.S. Application Data

(60) Provisional application No. 61/470,888, filed on Apr. 1, 2011.

(51) Int. Cl.

| | |
|---|---|
| ***G06F 19/00*** | (2011.01) |
| ***F41G 3/06*** | (2006.01) |
| ***F41G 3/04*** | (2006.01) |
| ***F41G 3/08*** | (2006.01) |
| ***F41G 1/38*** | (2006.01) |
| ***F41G 1/44*** | (2006.01) |
| ***F41G 1/473*** | (2006.01) |
| ***F41G 3/16*** | (2006.01) |

(52) U.S. Cl.

CPC .. *F41G 3/06* (2013.01); *F41G 1/38* (2013.01); *F41G 1/44* (2013.01); *F41G 1/473* (2013.01); *F41G 3/04* (2013.01); *F41G 3/08* (2013.01); *F41G 3/165* (2013.01)

(58) Field of Classification Search

USPC ..... 235/404, 414; 359/428

See application file for complete search history.

(56) References Cited

U.S. PATENT DOCUMENTS

| | | | | |
|---|---|---|---|---|
| 2,999,415 | A | 9/1961 | Mandler et al. | 356/21 |
| 5,456,157 | A | 10/1995 | Lougheed et al. | |
| 6,357,158 | B1 | 3/2002 | Smith, III | |

(Continued)

FOREIGN PATENT DOCUMENTS

| | | | |
|---|---|---|---|
| EP | 1748273 | A1 | 1/2007 |
| FR | 2913266 | A1 | 9/2008 |

(Continued)

OTHER PUBLICATIONS

European Patent App. No. 12805383, Sep. 5, 2014, EPO Search Opinion, 5 Sheets.

(Continued)

*Primary Examiner* — Ahshik Kim

(74) *Attorney, Agent, or Firm* — Smith Tempel; Steven P. Wigmore

(57) ABSTRACT

A method and system for automatically calculating a trajectory of a projectile launched from a weapon includes receiving environmental conditions and determining a distance to a potential target. Determining the distance to the potential target may include calculating distance via optics of the weapon in conjunction with a self correcting reticle module or a video target tracking module. Alternatively, the distance to the potential target may be determined using a laser range finder. A point of impact for the projectile on the potential target may automatically be calculated based on the distance and environmental conditions. A graphical indicator may then be projected on a display device which corresponds to the potential target and indicates the point of impact for the projectile on the potential target. The video target tracking or self correcting reticle module moves the projectile impact point (crosshairs) as the weapon is translated in space by the marksmen.

17 Claims, 25 Drawing Sheets

(56) References Cited

U.S. PATENT DOCUMENTS

| | | | | |
|---|---|---|---|---|
| 6,499,382 | B1 | 12/2002 | Lougheed et al. | |
| 6,516,699 | B2 | 2/2003 | Sammut et al. | |
| 7,654,029 | B2 | 2/2010 | Peters et al. | |
| 7,877,886 | B1 | 2/2011 | Hamilton | 33/297 |
| 8,991,702 | B1 | 3/2015 | Sammut et al. | |
| 9,091,507 | B2 | 7/2015 | Paterson et al. | |
| 2005/0198885 | A1 | 9/2005 | Staley | |
| 2006/0005447 | A1 | 1/2006 | Lenner | |
| 2007/0103673 | A1 | 5/2007 | Ash | |
| 2008/0094473 | A1 | 4/2008 | Rom | |
| 2009/0183417 | A1 | 7/2009 | Smith, III | |
| 2009/0199451 | A1 | 8/2009 | Zaderey et al. | |
| 2009/0199702 | A1 | 8/2009 | Zaderey et al. | |
| 2009/0205239 | A1 | 8/2009 | Smith, III | |
| 2010/0182426 | A1 | 7/2010 | Perruchot et al. | |
| 2011/0132983 | A1* | 6/2011 | Sammut et al. | 235/404 |
| 2011/0168777 | A1 | 7/2011 | Bay | |
| 2012/0126002 | A1* | 5/2012 | Rudich | 235/404 |
| 2012/0273571 | A1* | 11/2012 | Kremer | 235/404 |

FOREIGN PATENT DOCUMENTS

| | | | |
|---|---|---|---|
| FR | 2921149 | A1 | 3/2009 |
| GB | 2255398 | | 11/1992 |
| JP | 6141915 | A | 2/1986 |
| KR | 100963681 | B1 | 6/2010 |
| WO | 9623270 | A1 | 8/1996 |

OTHER PUBLICATIONS

European Patent App. No. 10851146, Nov. 28, 2014 EPO Search Opinion, 5Sheets.

ISR From PCT/US2012/031529, transmitted Jan. 30, 2013; two U.S. Refs, and two Foreign Refs.

* cited by examiner

DIRECT OPTIC EMBODIMENT

CAMERA EMBODIMENT

CAMERA EMBODIMENT

DIRECT OPTIC EMBODIMENTS
(Height Measurements for Optical Ranging)
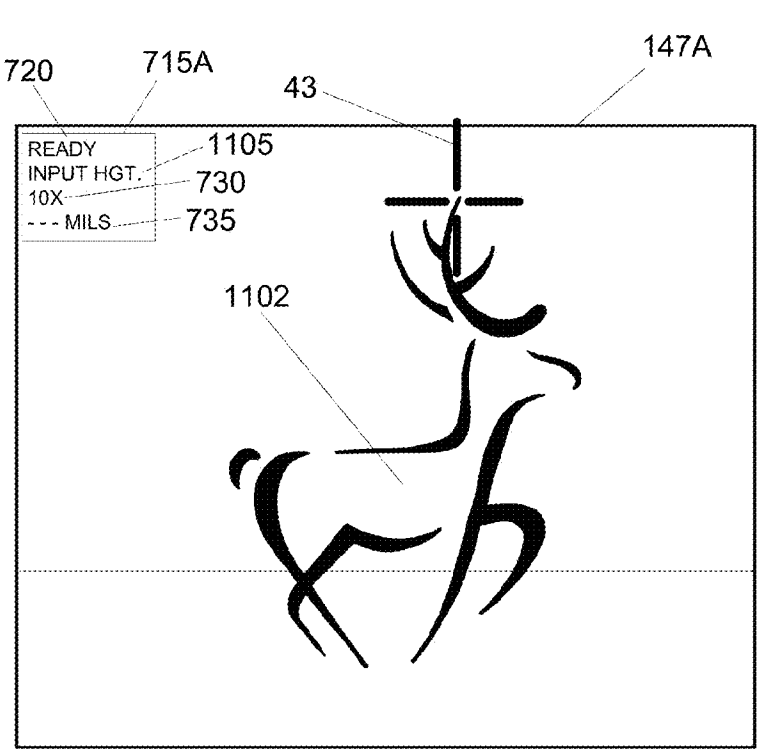
Fig. 11B1
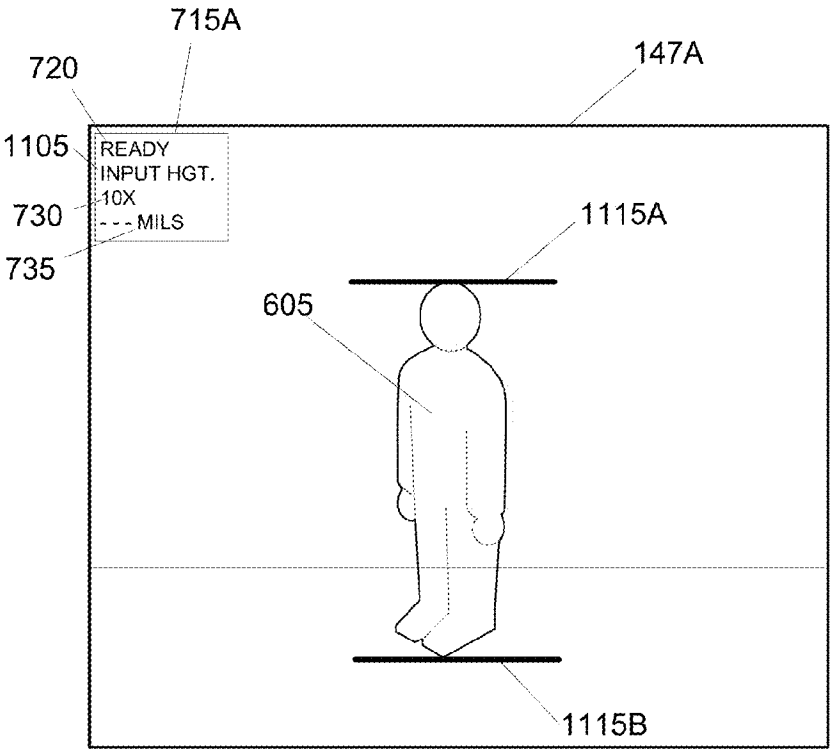
Fig. 11A1

DIRECT OPTIC EMBODIMENTS
(Height Measurements for Optical Ranging)
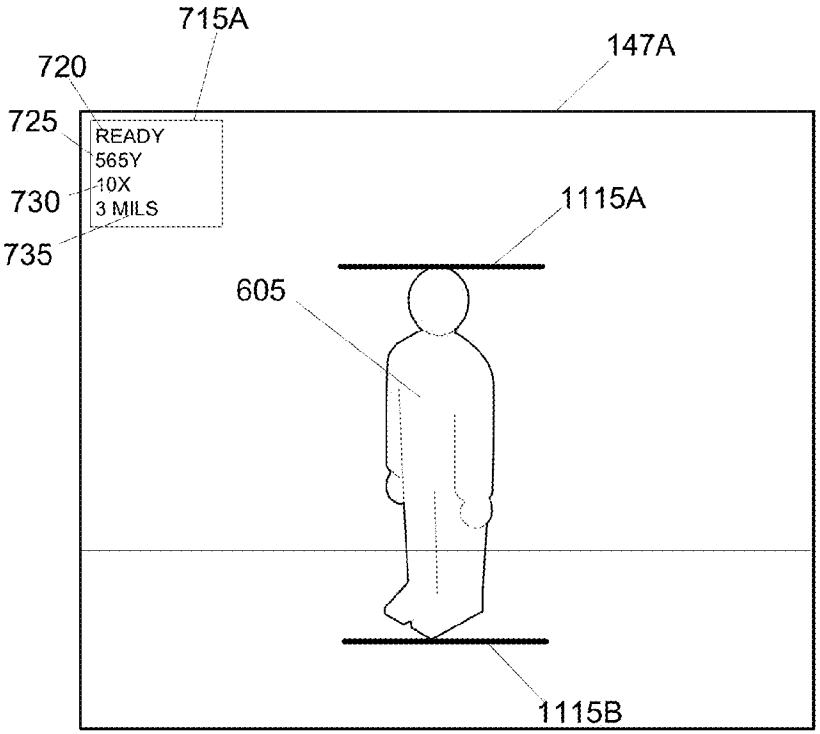
Fig. 11A2
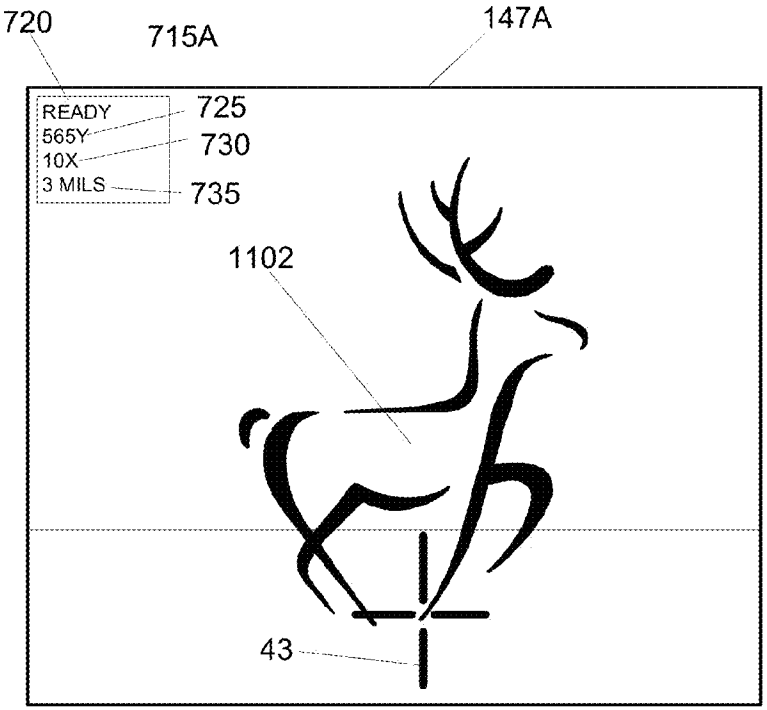
Fig. 11B2

CAMERA EMBODIMENT WITH MULT-TARGET CAPABILITY AND OPTICAL RANGING

CAMERA EMBODIMENT WITH MULT-TARGET CAPABILITY AND OPTICAL RANGING

SYSTEM AND METHOD FOR AUTOMATICALLY TARGETING A WEAPON

PRIORITY CLAIM AND RELATED APPLICATIONS STATEMENT

Priority under 35 U.S.C. §119(e) is claimed to U.S. provisional application entitled "Varying Magnification Range Determining and Ballistic Trajectory Calculating Apparatus," filed on Apr. 1, 2011 and assigned U.S. provisional application Ser. No. 61/470,888. The entire contents of this provisional patent application are hereby incorporated by reference.

This patent application is also related to U.S. non-provisional application entitled "System and Method for Ballistic Solutions," filed on Sep. 10, 2010 and assigned U.S. non-provisional patent application Ser. No. 12/879,277; and PCT patent application entitled, "System and Method for Ballistic Solutions," filed on Sep. 10, 2010 and assigned PCT patent application serial number PCT/US2010/48385. The entire contents of this U.S. non-provisional patent application and PCT patent application are hereby incorporated by reference.

BACKGROUND

Consistent short range shooting only requires a modest amount of skill and a weapon suitable for firing a reasonably flat and repeatable trajectory out to a couple hundred yards without regard for variations in ambient conditions. To consistently engage targets at long range, however, is a complex function of shooting skill, weapon system quality, reliable data query and, perhaps most importantly, applied math.

Even so, the first thing that a long-range marksman does with his weapon is the same thing that a novice marksman does—he calibrates or "zeroes" it. Typically, a rifle is fitted with a scope via a mounting system such that the scope is rigidly attached to the rifle and positioned in-line with the rifle's barrel. With the scope being rigidly fixed relative to the rifle, adjustments in the scope can be made by manipulating the position of the lenses that form the scope.

Though usually not adjustable itself, the mounting system may comprise an inclined base in order to angle the scope's default line of sight (DLOS) slightly downward (default elevation and windage settings of a scope are usually set at the median points within the relative ranges of available adjustment), relative to the baseline represented by the axis of the rifle's barrel bore, so that the DLOS intersects a line projected from the rifle's barrel at a point some distance in front of the rifle. Notably, while an inclined mounting system is not an absolute in all rifle/scope combinations, a marksman would know that it offers potential advantages to a long range marksman including the effective increase of the practical elevation adjustment range of the scope for long distance shots.

That is, because the inclined mounting system inherently biases the rifle barrel up relative to the scope's line of sight, the trajectory of the bullet will start off at an upward angle thus necessitating less adjustment for longer shots. Initially, the point of intersection between the DLOS and the barrel axis projection is unknown and of little value to the marksman until the scope is "zeroed" to the rifle such that the point of intersection correlates with a point of bullet impact at a given distance.

When a rifle is zeroed with its scope, the point of a bullet's impact on a target at a given distance will coincide with the DLOS when the bullet is shot at certain ambient conditions and not affected by significant wind or marksman error, i.e. the bullet will hit the target "right on the crosshairs." Although there is no set standard for selecting a zero distance, zeroing a rifle/scope combination is most often done at a short range, typically 100 yards or less.

The reason for short range zeroing is that the trajectory of the bullet is still relatively flat at a short range because the muzzle velocity (the velocity of the bullet at its maximum, i.e. shortly after it exits the barrel) has not degraded to such an extent that gravity has a significant effect on the bullet's flight path. As such, especially with a bullet caliber having a high ballistic coefficient and fast muzzle velocity, variations in ambient conditions, including moderate crosswinds, will not cause enough deviation in the predictable baseline trajectory of the bullet to warrant compensation by a marksman seeking to engage a target at or near the "zero" distance.

For the novice marksman, a properly zeroed rifle means locking down the scope settings and not worrying about the bullet's ballistics whether the shot to be taken is at 25 yards or 150 yards—he knows that the change in trajectory due to the deviation in range off his zero distance is well within the available margin of error for hitting a short range target.

For a long range marksman, however, a zero distance serves only as a good, predictable starting point—he's not looking to engage targets at 150 yards but, rather, at significantly longer distances, such as on the order of 1500 yards or more.

The suitability of a given rifle caliber for long range shooting directly correlates with the caliber's ballistic coefficient and muzzle velocity. The higher the ballistic coefficient, the better the particular caliber bullet slices through the atmosphere. The faster the muzzle velocity, the farther the bullet flies before aerodynamic forces reduce the bullet's stability. Therefore, a high ballistic coefficient coupled with a high muzzle velocity is a desirable combination for long range target engagement.

However, even calibers with desirable ballistic coefficients and fast muzzle velocities capable of keeping the bullet at supersonic speeds for long distances can drop upwards of 4 feet below DLOS at just 500 yards. At 600 yards, the same exemplary bullet can drop below DLOS an additional 2½ feet. Change the ambient conditions, such as humidity, barometric pressure, temperature and crosswind strength, and that 500 yard shot using the zeroed crosshairs may be 1½ feet to the left of a target and below the DLOS as if it were shot at 600 yards instead of 500.

Clearly, for a long range marksman, the zero distance is just a jumping off point for making adjustments. If long range targets are going to be hit precisely, then factors and conditions such as target distance, crosswind strength, humidity, barometric pressure, coriolis effect, and temperature, among others, must be considered and compensated for. As such, once the rifle has been zeroed at a given distance and ambient conditions, a long range marksman will begin to collect data at varying distances and conditions in order to develop what is known to one of ordinary skill in the art as a Data Observed from Prior Engagements or "DOPE" book.

A DOPE book can be used by the long range marksman to make adjustments in the field based on the actual field conditions for the shot versus the controlled "zero" conditions. More particularly, by referring to the empirical data documented in his DOPE book, a marksman can predict how far off point of impact his DLOS will be and, accordingly, make adjustments to correct the predicted error. However, practicality dictates that a DOPE book can only document so much data and, therefore, it is inevitable that the marksman will often use the DOPE data as a general guide to get him "most of the way home" before applying his judgment and experience to estimate the actual adjustments required to make the shot.

As an example, a given DOPE book may record data for target distances ranging from 500 to 1500 yards in 20 yard increments with a 10 mph crosswind, based on a specific rifle that has been zeroed at 100 yards using a specific round. While the exemplary DOPE book would be useful for the long range marksman seeking to make a shot in the 1000 yard range, it may not be "dead on" as the actual distance to target may have been estimated at 1015 yards with an 8 mph crosswind. To further complicate the calculation, consider that the gun was zeroed at 90% relative humidity and 90 degrees Fahrenheit at sea level, as opposed to the exemplary field conditions being measured at 40% humidity and 30 degrees Fahrenheit on top of a mountain, and one can easily see how drastically different the settings must be from the zero in order to score a hit. The point is that if the marksman doesn't have his "DOPE" book exactly on point, which he rarely does, he must either extrapolate or interpolate the required adjustments.

In addition to the inevitable estimation from DOPE records, the more estimation required on the part of the marksman concerning field conditions, the more likely that the adjustments calculated from those estimations will be inaccurate. Of all the estimations, perhaps the pivotal estimation for a long range marksman is the initial distance to target. Considering that at a 1000 yard distance even a caliber with desirable long range ballistics may be dropping up to one inch for every yard of forward travel, the result of a misjudged distance to target is a significant and costly miss. Underestimate the distance to target by a mere 10 yards and the shot could be almost a foot low.

There are basically two methods used in the art to estimate the all important distance to target. The first method is to "mil" the target and the second method is to use an infrared/laser (IR/Laser) range finding device. IR/Laser ranging devices are very accurate, using the known speed of light bouncing off the target to calculate the distance to target. However, in many applications, such as military sniping, use of an IR/Laser device can be seen by an enemy, thus compromising a sniper's position. For this reason, many long range marksmen rely on the "mil" method.

The process of "milling" a target to determine its distance comprises translating the target's linear height, as seen through an optical viewing device in units of mils, into corresponding units of angular measure which are useful for adjusting a line of sight (e.g., raising the point of aim by pivoting a weapon up). Consequently, if an object's height is known (or accurately estimated), then the number of mils required to demarcate the object's height as seen through an optical viewing device can be used to calculate the distance to the object. With the distance to object calculated and mapped to a known ballistic trajectory curve, adjustments for aim can be given in units of angular measure.

Notably, it will be understood by one of ordinary skill in the art that the use of the term "mil" as a verb, at least as it pertains to estimating target height, distance, crosswind, etc. is a comprehensive term for methods that employ linear and angular units of measure including, but not limited to, mils, minutes of angle, radians, inches per hundred yards and user-defined units. Thus, "milling" is a term in the art and its use is not intended to be limited to methods for calculating ballistic solutions that make use of mils as a unit of measure.

To actually "mil" an object and calculate its distance, an essential device for long range shooting is a scope or range finder that comprises a reticle, i.e. a network of fine lines or markings 15 that can be seen by the marksman when looking through the eyepiece of the scope. Range finder devices known in the art, or a scope with a reticle, provide a marksman with a means to determine the distance to target, assuming, of course, that the marksman can accurately estimate the target's height.

If the height of the target is known (or accurately estimated), and the distance between the scope or range finder reticle markings can be correlated with an angle of measure, then a right triangle is defined with the target height as the length of the leg opposite the angle of measure. From the defined triangle, the distance to the target can be calculated via the tangent of the determined angle.

Once a target is "milled" based on its estimated or possibly known height, and a distance to target is calculated, a long range marksman can refer to his DOPE card or other ballistic data to determine just how far above the target he needs to aim in order for the bullet to impact the target. Of course, as noted previously, other factors must also be considered. It is well understood to one of ordinary skill in the art that ambient conditions such as barometric pressure, crosswinds, coriolis forces, temperature and humidity directly affect the trajectory of a bullet. Based on the empirical data of the DOPE book or other ballistic data available, the marksman can further amend the elevation calculation to compensate for those factors and arrive at a comprehensive ballistic solution for engaging the target.

At such point, an application of the ballistic solution will dictate to the marksman that his particular weapon should be aimed at a certain "mil" height above the target and a certain "mil" distance off center of the target in order to score a hit (thus causing the marksman to adjust the angle at which the rifle is being aimed).

With a ballistic solution identified, the marksman has the option of either 1) leaving the scope at its zero and "holding off" the target as dictated by the ballistic solution or 2) accommodating the ballistic solution by adjusting the elevation and windage settings of his scope. For a marksman applying the first option, the reticle markings used to initially calculate distance can also be used to "hold off" the target according to the ballistic solution. For a marksman applying the second option, a reticle with a plurality of graduated markings within the rifle scope is not required as the mil or MOA angular adjustments will be made to the lenses within the scope, thus "moving" the crosshairs to correspond with the desired point of impact.

Infrared range finding technologies notwithstanding, the calculated distance to a target using trigonometry will only be useful if the marksman can 1) accurately estimate target height and 2) accurately estimate an angle of measure. Accuracy of target height estimation directly correlates with the marksman's ability to make the estimation. Likewise, even though the angle of measure can be determined based on scope or range finder reticle markings, the target may not fit exactly between reticle demarcations and, as such, the angle of measure estimation is also a function of marksman skill.

This issues described above with respect to target estimations for distance and height become more complicated when a plurality of targets require tracking by one or more marksman. Currently, there are no known ways to track multiple targets at different distances relative to a single marksman. Instead, if there are multiple targets to track, then each single target is assigned to a single marksman so that each marksman only tracks a single target. Such a team approach to tracking targets may become expensive and problematic given the amount of coordination required among the team of marksmen as understood by one of ordinary skill in the art.

Another problem in the art is the ability of a senior officer to issue a "fire" command to a team of marksmen. Currently, senior officers do not have the ability to see the images that may be captured or present within the view of a marksman's scope. Typically, senior officers may be in audio communication with his marksmen and the marksmen only relay via audio what he or she sees in the scope of the weapon. Based on that oral description of the target, the senior officer may issue the "fire" command and/or a hold command to the marksman.

Therefore, to address the problems associated with tracking multiple targets and to improve the accuracy of distance to target estimations for long range marksmen, there is a need in the art for devices and methods that can improve the estimation of inputs used to calculate target distance and/or target height and ones that can provide multi-target tracking features. Further, there is a need in the art to improve the accuracy of ballistic solutions via devices and methods used to collect and manipulate data that affects the flight of projectile, such as a bullet fired from a weapon.

SUMMARY

A method and system for automatically calculating a trajectory of a projectile launched from a weapon includes receiving one or more environmental conditions relative to the weapon and determining a distance to a potential target from the weapon. Determining the distance to the potential target may include calculating distance based on optics of the weapon in conjunction with a self correcting reticle module or a video target tracking module. Alternatively, the distance to the potential target may be determined with a laser range finder module. The method and system further includes automatically calculating a point of impact for the projectile on the potential target based on the distance and environmental conditions. A graphical indicator may then be projected on a display device which corresponds to the potential target and that denotes the point of impact for the projectile on the potential target.

Receiving environmental conditions relative to the weapon may include receiving data for at least one of: wind, temperature, humidity, barometric pressure, altitude, look angle, cant angle, spin drift, and coriolis effect relative to the weapon. The one or more environmental conditions received may be produced by at least one sensor and/or a sensor array. The method and system may further include displaying a zero point for the weapon on a display device. The method and system may also generate an alert when the bullet impact point is not visible on the display device. Such an alert may include at least one of an audible alert and a visual alert displayed on the display device.

According to further exemplary embodiments of the method and system, an image of the potential target may be generated and projected on the display device. The system and method may generate a unique marker for the potential target and display the unique marker on the display device such that it tracks the potential target The method and system may further include transmitting the image of the potential target to a remote location relative to the weapon. The image may be transmitted over a communications network to another display device.

One of the major advancements of the method and system is that the video target tracking module or the self correcting reticle module displays the projectile (i.e. bullet) impact point shown with crosshairs within the marksmen's field of view (on a display device). Further, the video target tracking module or self correcting reticle module moves that projectile impact point (crosshairs) as the weapon is moved/translated in space by the marksmen while a potential target is tracked by the marksmen.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "100A" or "100B", the letter character designations may differentiate two like parts or elements present in the same figure. Letter character designations for reference numerals may be omitted when it is intended that a reference numeral to encompass all parts having the same reference numeral in all figures

FIG. 11A1 illustrates a exemplary scene including height bars and one or more potential targets being ranged and seen using a direct optic ballistic solution system according to one exemplary embodiment;

FIG. 11B1 illustrates a exemplary scene including crosshairs used for a first point in a height dimension and one or more potential targets being ranged and seen using a direct optic ballistic solution system according to one exemplary embodiment;

FIG. 11A2 illustrates a exemplary scene including height bars and one or more potential targets after being ranged and seen using a direct optic ballistic solution system according to one exemplary embodiment;

FIG. 11B2 illustrates a exemplary scene including crosshairs used for a second point in a height dimension and one or more potential targets after being ranged and seen using a direct optic ballistic solution system according to one exemplary embodiment;

DETAILED DESCRIPTION

Figure 1A:
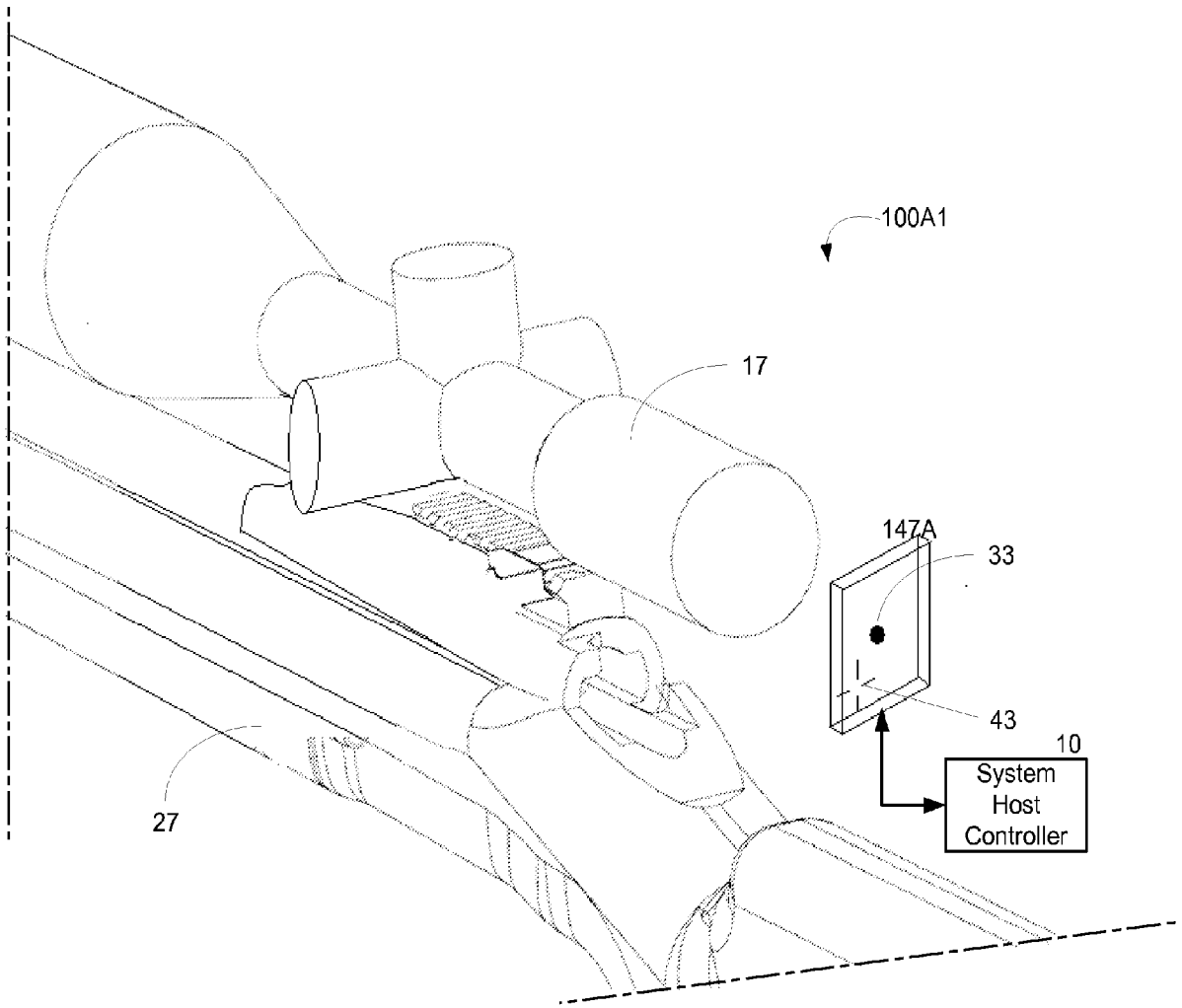
FIG. 1A illustrates an exemplary embodiment of a direct optic ballistic solutions system coupled to a weapon.

The presently disclosed embodiments, as well as features and aspects thereof, are directed towards providing a system and method for calculating comprehensive ballistic solutions, or portions thereof, via a ballistic solutions system. The word "exemplary" is used herein to mean "serving as an example, instance, or illustration." Any aspect described herein as "exemplary" is not necessarily to be construed as exclusive, preferred or advantageous over other aspects.

Exemplary embodiments of a ballistic solutions system are disclosed herein in the context of long range rifle shooting, however, one of ordinary skill in the art will understand that various embodiments may also comprise any combination of features and aspects useful for other applications related to, but not limited to, range finding, bird watching, golfing, surveying, archery, etc. Moreover, as the described embodiments are disclosed in the context of long range shooting, one of ordinary skill in the art will understand that the references to a "rifle" or to a "weapon" in this description are not intended to limit the use of a ballistic solutions systems to be in conjunction with a rifle or any particular weapon.

Rather, the terms rifle and weapon will be understood to anticipate any device, whether configured to launch a projectile or not, with which a ballistic solutions system may be used. That is, it will be understood that, in its simplest form, a ballistic solutions system is configured to operate in conjunction with any other device useful for making optical observations such as, but not limited to, any type of weapon that may include a missile launcher, a gun, a rifle, a cannon, a bazooka, a grenade launcher, a rifle scope, binoculars, monoculars, an optical rangefinder, a person's arm or even a stick. As such, the description herein of embodiments specifically configured for shooting applications will not be interpreted to limit the scope of the ballistic solutions system.

Devices and methods presently known in the art of range finding and ballistic trajectory prediction rely heavily on user inputs and estimations in order to render suggested ballistic solutions. One of ordinary skill in the art understands that solutions rendered by any ballistic trajectory calculating device, or any applied mathematical formula, are only as useful as the inputs from which the solutions were calculated. As such, because the devices and methods known in the art require extensive user estimation, the solutions rendered by such devices are only as good as the estimation skills of the user.

As has been described, current methods for long range shooting require a marksman to rely heavily on his estimated input evaluated in context of weapon-specific Data Observed from Prior Engagements (DOPE) records (or field data of projectile drop based on range). A marksman's DOPE record is empirically derived by shooting a specific weapon, with a specific zero setting (e.g., the default scope settings calibrated such that, at certain ambient conditions, a specific bullet configuration fired from the weapon will impact a target point at a specified distance), at varying distances and ambient conditions. The resulting data, or DOPE, is valuable information in the field when a marksman seeks to determine a long range ballistic solution.

Granted, if all ambient conditions are held constant to the conditions under which a weapon was zeroed, a marksman would only need DOPE relative to a single ballistic curve because a bullet's trajectory in controlled conditions is predictable and repeatable. Under such utopian conditions, a marksman would need only to "raise" or "lower" the trajectory curve of the bullet, relative to the weapon's line of sight, in order to manipulate the distance at which the bullet would intersect the line of sight and impact the target.

Of course, even under such utopian conditions, the marksman would have to know the distance to target. In long range field shooting applications, or tactical military engagements, however, there are more variables than those described under the utopian conditions. That is, in addition to random target distances, the field conditions are virtually guaranteed to differ from the DOPE conditions—thus making the calculation of a ballistic solution more complicated than simply manipulating the x-axis and y-axis of a single ballistic curve.

As has been described, before a long range marksman can reference his DOPE and determine a ballistic solution, the distance to target must be estimated. Methods known in the art require the marksman to "range" a target of a known or predictable size, whether such target is the actual target to be engaged or just a nearby object. To range a target, a marksman may employ a device with a reticle, such as the scope component of his weapon or a separate optical device specifically used for range finding.

Importantly, however, it will be understood that any device useful for demarcating the height of an object such as, for example, a stick pointed at a distant object, may be suitable for use in conjunction with an embodiment of a ballistic solutions system and, as such, the present disclosure will not be construed such that a ballistic solutions system can only be used in connection with a rifle scope or range finding device known in the art of long range shooting. Again, as is known to one of ordinary skill in the art, reticle markings can be used to demarcate the height of a distant object. Based on the reticle demarcation or relative sizes within a scope and the known magnification of the scope, the distance to the target can be mathematically calculated with a degree of certainty commensurate with the accuracy of the demarcation.

Referring now to the figures, FIG. 1A illustrates an exemplary embodiment of elements of a direct optic ballistic solutions system 100A1 coupled to a weapon 27. The weapon 27 illustrated in FIG. 1A is a rifle. However, as noted above, any type of weapon 27 that launches a projectile is included within the scope of this disclosure. A weapon 27, may include, but is not limited to, a missile launcher, a gun, a rifle, a cannon, a bazooka, a grenade launcher, etc.

The elements of the direct optic ballistic solution system 100A1 illustrated include a display 147A and a system host controller 10. The display 147A may be positioned in front of and coupled to a rifle scope 17. The display 147A may comprise a liquid crystal display (LCD). The display 147A may generate a zero point 33 that comprises a graphical indicator. The zero point 33 corresponds to the when a weapon is zeroed with its scope. The zero point 33 may also correspond to an end point generated by an optional laser range finder module 20 coupled to the weapon 27.

The zero point 33 usually denotes the point of a bullet's impact on a target at a given distance which usually coincides with the DLOS when a projectile launched from the weapon 27 is launched at certain ambient conditions and not affected by significant wind or marksman error, i.e. the bullet will hit the target "right on the zero point."

In addition to the zero point 33, the display 147A may also generate crosshairs 43 that also comprise graphical or screen elements. The reticle or crosshairs 43 will also be referred to as the ballistic solution impact point 43 as described in further detail below. As understood by one of ordinary skill in the art, there are many variations of reticles 43. One of ordinary skill in the art will recognize that one of the most simple reticles includes crosshairs 43. Crosshairs 43 are most commonly represented as intersecting lines in the shape of a cross, "+".

Many variations of crosshairs or reticles 43 exist, including dots, posts, circles, scales, chevrons, or a combination of these. Most commonly associated with telescopic sights for aiming weapons, crosshairs 43 are also common in optical instruments used for astronomy and surveying, and are also popular in graphical user interfaces as a precision pointer. The display 147A may be positioned in front of the scope 17 of the weapon 27 without impacting the magnification of the view presented by the scope 17.

The system host controller 10 may comprise an application specific integrated chip (ASIC). Alternatively, or in addition to an ASIC, the system host controller 10 may also comprise a central processing unit (CPU). The CPU may comprise a single core or a multicore CPU as understood by one of ordinary skill the art. The system host controller 10 may further comprise software. Further details of the system host controller 10 will be described below. When reference is made to a processing element and/or a processor, such element may embody anyone or a combination of the hardware elements described above.

Figure 1B:
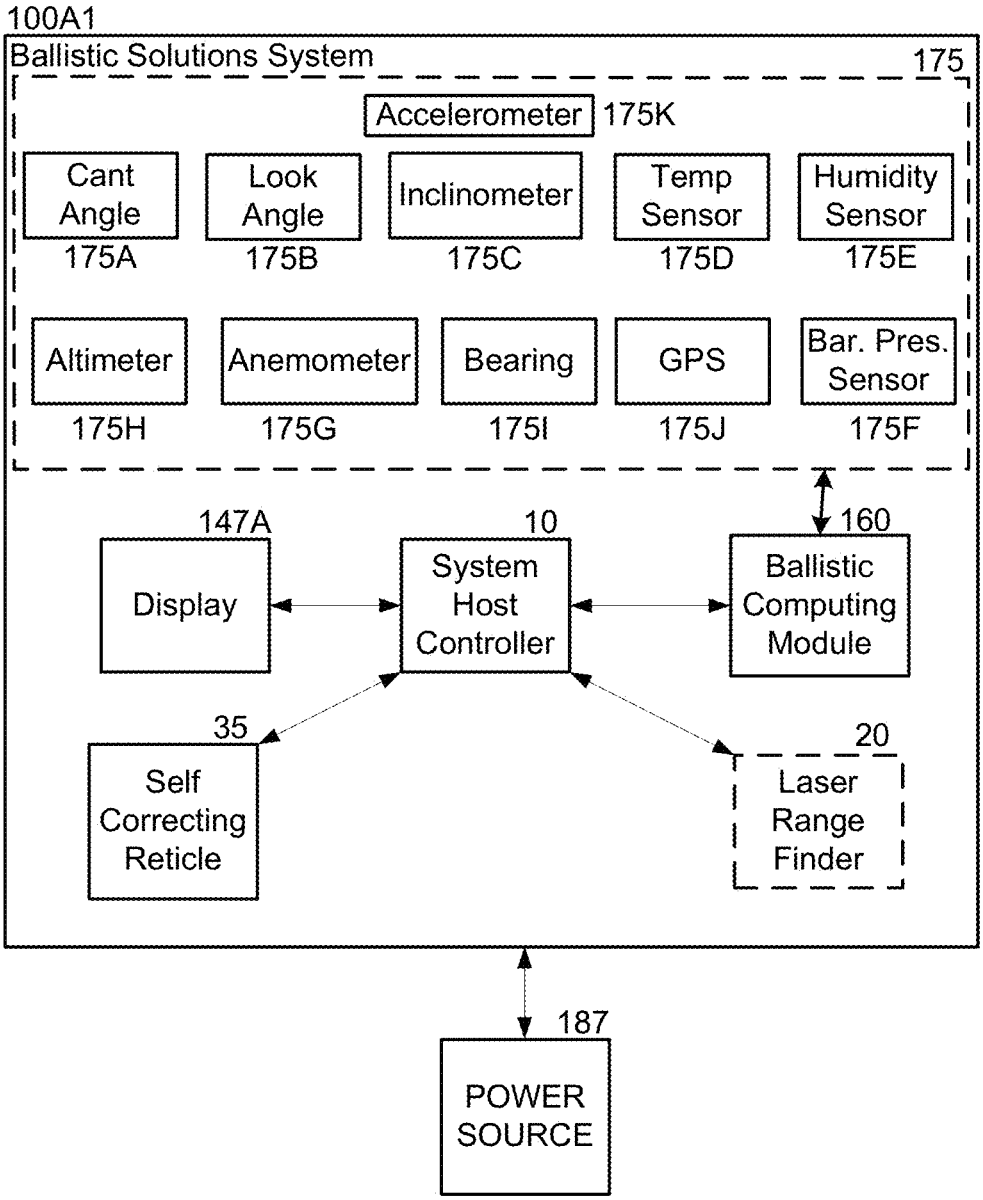
FIG. 1B is a functional block diagram for the direct optic ballistic solution system illustrated in FIG. 1A.

Referring now to FIG. 1B, this figure is a functional block diagram for the direct optic ballistic solution system 100A1 illustrated in FIG. 1A. The direct optic ballistic solution system 100A1 may comprise the display 147A, the system host controller 10, a self correcting reticle module 35, a ballistic computing module 160, an optional laser rangefinder 20, and a plurality of sensors 175. As noted above, the display 147A may comprise an LCD or a light emitting diode (LED) type of device. The system host controller 10 may comprise an ASIC and/or a CPU, as described above.

The system host controller 10 may be responsible for supporting the user interface in which the system receives input from the operator of the weapon 27 for selecting targets and/or input for manipulating height bars 1115A, 1115B (See FIG. 11A). The system host controller 10 may be coupled to the display 147A, the self correcting reticle module 35, an optional laser rangefinder 20, and the ballistic computing module 160.

The system host controller (SHC) 10 may be responsible for passing messages between each of these system elements. The self correcting reticle (SCR) module 35 coupled to the system host controller (SHC) 10 is responsible for manipulating and tracking the graphical coordinates for positioning the crosshairs 43 and placing the zero point 33 at its fixed position within the display 147A.

As noted previously, the crosshairs 43 may also be referred to as the ballistic solution impact point 43. The self correcting reticle module 35 receives data from the system host controller that is generated by the ballistic computing module 160. The self correcting reticle module 35 translates target distances and heights into screen mapping data, such as length and width in units of pixels as understood by one of ordinary skill the art.

The self correcting reticle module 35 transmits the screen mapping data to the display 147 which then produces the zero point indicator 33 and crosshairs 43 at the positions within the display 147A as determined by the self correcting reticle module 35. The self correcting reticle module 35 may comprise software and/or hardware.

One of the major advancements of the system 100A1 is that the self correcting reticle (SCR) module 35 displays the projectile (i.e. bullet) impact point shown with crosshairs 43 within the marksmen's field of view (in display 147A). Further, the self correcting reticle module 35 moves that projectile impact point (crosshairs 43) as the weapon 27 is moved by the marksmen. The projectile impact point or crosshairs 43 is moved by the SCR module 35 as the weapon 27 moves since the ballistic computing module 160 is continuously updating its projectile impact point solutions when movement of the weapon changes trajectory of the projectile. The SCR module 35 translates the ballistics solutions data from the ballistic computing module 160 into appropriate screen mapping data for positioning the crosshairs 43.

The ballistic solutions computing module 160 is designed to work with the sensors 175, manual inputs, the display 147, and any stored DOPE in order to produce a ballistic solution that is relayed to the SHC 10 and projected on the display 147. In addition, in some embodiments, computer generated animation may be leveraged to render a ballistic solution on the display 147.

Specifically, the ballistic solutions computing module 160 monitors signals from the sensors 175 in order to detect real-time ambient conditions and rifle-specific data (such as translation of the rifle through an arc of movement when "milling" a target). Once the real-time ambient conditions and rifle-specific data is detected by the ballistic solutions computing module 160, the ballistic solutions computing module 160 may run ballistic calculation algorithms to arrive at a ballistic solution for the projectile being launched by the weapon 27.

The ballistic solutions computing module 160 may calculate its ballistic solutions by using the zero point 33 of the weapon and a distance to a potential target, such as target 605 in FIG. 6, as a reference. From the zero point 33, distance to the target 605, the type of the projectile (i.e. its caliber, etc.), type of weapon 27 (i.e. type of gun, M-16, AK-47, etc.), and data received from the sensors 175, and/or input from the operator of the weapon 27 for calculating DOPE parameters as described above, the ballistic solutions module 160 may calculate a position for the projectile impact point which will be transmitted to the self correcting reticle module 35 (or video target tracking module 40, described below) for positioning the crosshairs 43 over that impact point.

The sensors 175 may include, but are not limited to, a cant angle sensor 175A, a look angle sensor 175B, an inclinometer 175C, a temperature sensor 175D, a humidity sensor 175E, a barometric pressure sensor 175F, an anemometer 175G, an altimeter 175H, a bearing sensor 175I, a global positioning system (GPS) 175J, and an accelerometer 175K. The barometric pressure sensor 175F may detect changes in the current barometric pressure relative to the weapon 27. The temperature sensor 175D may detect a current temperature relative to the weapon 27. The temperature sensor 175D may comprise a thermometer which may include a thermocouple or other types of temperature sensing devices. The humidity sensor 175E may detect the relative humidity relative to the weapon 27. The inclinometer 175C is mechanically coupled to an optical viewing device useful for demarcating the height of an object.

Notably, one of ordinary skill in the art will understand that an optical viewing device useful for demarcating the height of an object may be a device comprised of lenses and reticles, a rifle with a scope, a bow, a pair of binoculars, a user's arm, or even a stick. Also, it will be understood that the use of the term "inclinometer" 175C within the context of a ballistics solutions system 100 anticipates any rotational and/or translational measurement device including, but not limited to, an inclinometer 175C, an accelerometer, a gyroscope, etc. Moreover, it is envisioned that an inclinometer 175C or the like may be of a single axis or multiple axis type, may use an internal reference for measurement, or may be configured to provide an analog or digital output.

The particular inclinometer 175C used in some embodiments of a ballistic solutions device 100 is a VTI, Inc. model SCA100T-D02 capable of determining an analog output resolution as small as 0.0025 degrees, however, not all embodiments will comprise an equivalent inclinometer 175C. Advantageously, the resolution of angular measurement afforded a ballistic solutions system 100 which comprises an inclinometer 175C directly translates to more accurate distance to target calculations, as described above.

Moreover, in some embodiments, 24-bit analog to digital convertors may be employed to convert the inclinometer output (or an output from another included sensor 175C) and improve accuracy. In some embodiments, signal accuracy of the inclinometer 175C can be improved to 0.00012 degrees by including a convertor component.

However, it will be understood that not all embodiments of the inclinometer 175C include a convertor component, or other component operable to improve accuracy or performance, and, as such, the scope of a ballistic solutions system 100 will not be limited to an accuracy level for any particular component or component combination. Further, a 24-bit analog to digital converter is offered herein for exemplary purposes only and will not be interpreted to preclude other methods of improving component performance or accuracy that may occur to those of ordinary skill in the art of electronics.

The purpose of the inclinometer 175C, or other positional components, is to monitor the position and orientation of the ballistic solutions system 100, or the device (weapon 27) to which the ballistic solutions system 100 is mechanically coupled, and provide a signal representative of such position or orientation to the ballistic solutions computing module 160 (which may be executed by a central processing unit 121B in general computer embodiments) or to other component for use in calculating either a target height or a distance to target.

Notably, though the embodiment depicted in FIG. 1B comprises the inclinometer 175C within the housing of the exemplary ballistic solutions system 100A1, it is envisioned that other embodiments may comprise a rotational and/or translational measurement component outside of a device housing. For instance, some embodiments of a ballistic solutions system 100A1 may have an inclinometer 175C in mechanical communication with a weapon 27, like a rifle, or the scope 17, 19 or other optical equipment and wired or wireless communication with the other components of the ballistic solutions system 100.

Translational movement of the weapon 27, like a rifle, will also cause the inclinometer 175C to detect a range of angular motion. Similarly, one of ordinary skill in the art understands that any deviation of the weapon 27 from an upright position, i.e. upward slope, downward slope, slant, tilt or cant, may also be detected by a sensor 175 within the ballistic solutions system 100 as a degree of slope, slant, tilt or cant.

Advantageously, a ballistic solutions system 100A1 comprising a sensor 175 configured to measure a rifle's slope, slant, tilt or cant may consider such misalignment in the generation of a ballistic solution. For instance, one of ordinary skill in the art will understand that suggested elevation and windage adjustments taken from ballistic solution methods known in the art assume that the rifle/scope combination to which the solution will be applied is oriented in an upright position such that the scope DLOS shares a common vertical plane with a line projected from the bore of the rifle. Additionally, one of ordinary skill in the art will understand that a bullet fired along a downward slope will have a "flatter" trajectory due to the assist of gravity, as opposed to a bullet fired along an upward slope which will follow a more curved trajectory due to the force of gravity working in concert with atmospheric drag to slow the bullet's flight.

That is, with all factors held constant, an adjustment in an elevation setting, for instance, will uniquely affect the eventual point of impact on a target 605 along a vertical axis defined by the aforementioned common plane. However, when the weapon/scope combination is held at a cant, the DLOS no longer shares a common vertical plane with a line projected from the bore of the weapon 27 and, as such, adjustments to an elevation setting will not affect the eventual point of impact in a manner consistent with the applied ballistic solution. Similarly, a windage setting adjustment calculated under the assumption that a weapon/scope combination is oriented vertically will not be applicable to the same weapon/scope combination when held at a cant.

Likewise, a ballistic solution calculated based on the assumption the target and the rifle/scope share a common altitude will not be applicable for engaging a target that resides at an altitude above or below that of the weapon/scope. Advantageously, embodiments of a ballistic solutions system 100 may consider the slope, slant, tilt or cant of a weapon/scope combination such that a calculated ballistic solution will provide elevation and windage adjustments applicable to the actual three-dimensional orientation of the weapon/scope combination.

The exemplary embodiment 100A1 further comprises a barometric pressure sensor 175F and temperature measuring device 175D for the real-time monitoring of environmental conditions. As is known to one of ordinary skill in the art of ballistics, temperature and pressure variations have a direct impact on bullet trajectory. Generally, with lower pressure and higher temperature, a projectile will follow a "flatter" ballistic curve as it is exposed to less drag over a given horizontal distance.

Conversely, higher pressures and lower temperatures cause the atmosphere to be denser, thus creating friction that slows a bullet and causes it to drop prematurely. Thus, the ramifications of temperature and pressure variations off of the conditions at which a weapon 27 was zeroed can dramatically affect the envisioned trajectory of a projectile, like a bullet. As such, embodiments of a ballistic solutions systems 100 monitor the pressure and temperature with the pressure sensor 175F and temperature measuring devices 175D so that compensations for real-time variations in those conditions can be made to baseline DOPE data, thus providing for an accurate ballistic solution.

The look angle sensor 175B may detect the angle of the scope 17 relative to horizontal. Meanwhile the cant angle sensor 175A may measure the cant or tilt of the weapon 27 relative to vertical or some other reference. The altimeter 175H may sense altitude of the weapon 27 while the anemometer 175G may sense wind speed. The bearing sensor 175I may detect orientation of the weapon relative to true north while the GPS 175J may provide location of the weapon in latitude and longitude coordinates. The accelerometer 175K may detect accelerations and/or any other type of motion or movement as understood by one of ordinary skill in the art.

Other sensors 175 not specifically illustrated may be provided. The GPS 175J and bearing sensor 175I (and other sensors 175) may detect conditions required in computing the Coriolis effects. As understood by one of ordinary skill the art, anyone of the sensors 175 may be substituted with a means for input in which the operator of the weapon 27 may manually enter-in the values that may be detected with any one of the sensors 175.

The exemplary ballistic solutions system 100A1 may further comprise an optional laser rangefinder 20 that has been illustrated with dashed lines to indicate its optional status. The laser rangefinder 20 may produce a beam of laser light that is measured when the beam of laser light is reflected off the surface of a potential target. Further details of laser range finders 20 are understood by one of ordinary skill in the art.

A ballistic solution system 100A1 of FIG. 1B is designed to automatically manipulate the crosshairs or reticle 43 within the display 147A as illustrated in FIG. 1A. The ballistic solution system 100 A1 manipulates the crosshairs or reticle 43 based on the information that the system 100A1 receives from the sensors 175. Further details of how the crosshairs or reticle 43 is manipulated will be described below in connection with FIGS. 7A-8B.

Additionally, a power source 187 is shown to be coupled to the system host controller 10. It is envisioned that the power source 187 may be any device capable of providing the required energy to power the ballistic solutions device 100A1. The power source 187 is preferably a direct current energy or charge storage device that is configured to provide power.

It is envisioned that the power source 187 may be of any type known to one of ordinary skill in the art including, but not limited to, general purpose batteries, alkaline batteries, lead acid batteries, deep cycle batteries, rechargeable batteries, batteries in combination with solar cells, or the like. Moreover, it is envisioned that power source 187 may take the form of a fuel cell or capacitor. Notably, a power source 187 of a capacitor type could be employed in conjunction with a human powered crank component for supplying energy to the ballistic solutions system 100A1.

The ballistic solution system 100A1 may support the following functions and features: it may provide electronic zero alignment; it may function at any magnification; it may operate using very little power input such as on the order of 4.5 volts or less (which can be produced by 3 double AA batteries); it may be provided in an electronic package having dimensions on the order of 4 cm×5 cm in size; the display 147A may comprise at least one of VGA, SVGA, and XVGA resolution or others; and the system 100A1 may provide for passive ranging of targets 605, 710 in which vertical height and/or horizontal with of a potential target 605, 710 may be measured accurately; the system 100A may support supersonic, transonic, and subsonic firing solutions as understood by one of ordinary skill may art.

As noted above, the ballistic solution system 100A1 may be encapsulated in very compact electronic packaging environments. For example, exemplary electronic packaging environments for the system 100A1 may include those with length, width, and height dimensions on the order of 4 cm×5 cm×4 mm, as just an example. In other exemplary embodiments, during manufacturing of a direct optic 17, the system 100A1 may be integrated completely within the direct optic 17 so that the electronic packaging is contained within the housing of the direct optic 17.

Figure 3:
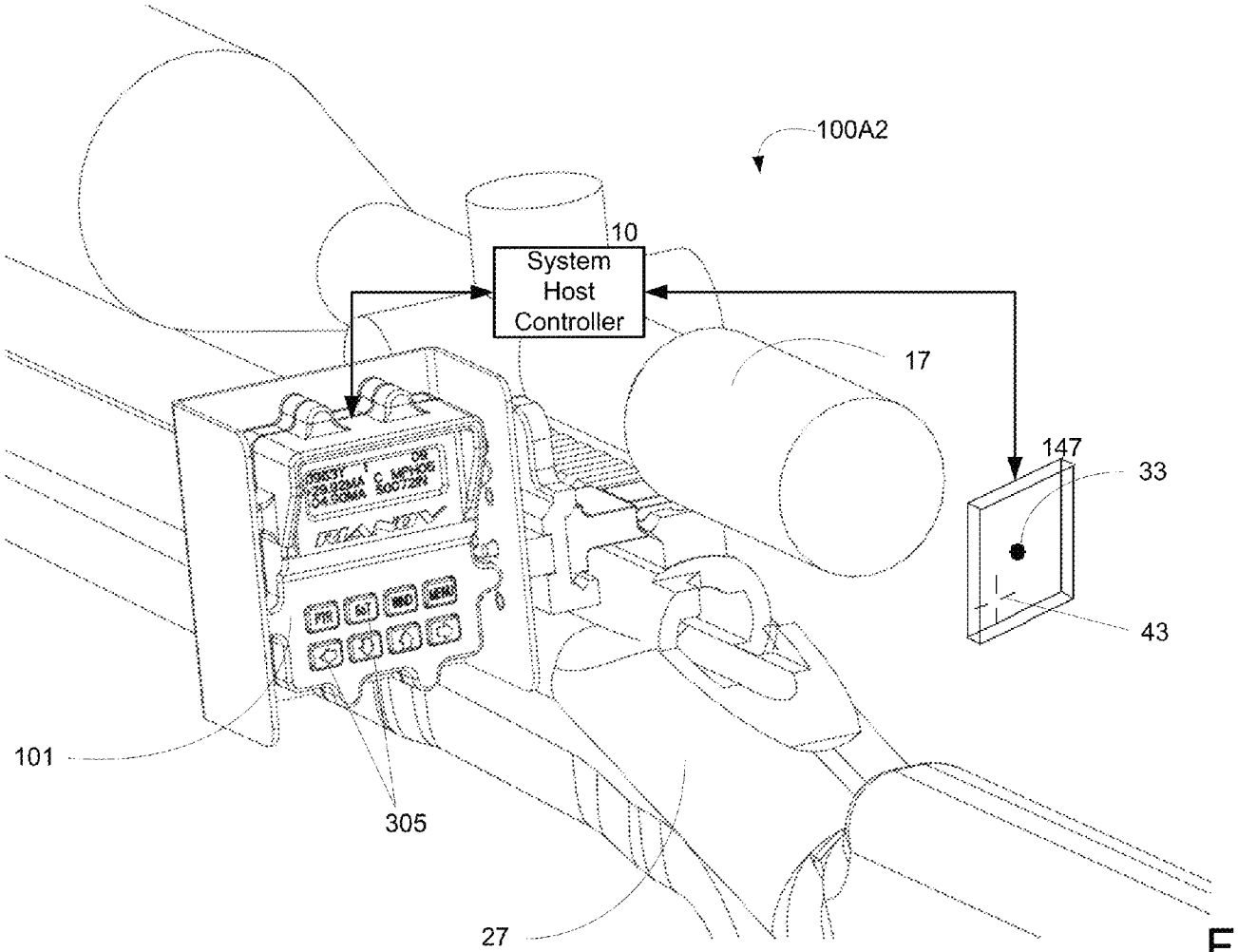
FIG. 3 illustrates a direct optic ballistic solution system that includes a ballistic solutions device having a separate keypad and display coupled to a weapon.

In aftermarket scenarios in which the weapon 27 is purchased prior to the purchase of the system 100A1, the system 100A1 may be coupled directly to the direct optic in which the display 147 is positioned in front of the direct optic 17 while the electronic package housing the system host controller 10 and ballistic computing module 160 are positioned on a side portion of the direct optic 17 and/or adjacent to the weapon 27, similar to the electronic package for the ballistic solutions device 101 as illustrated in FIG. 3, described in further detail below.

Figure 2A:
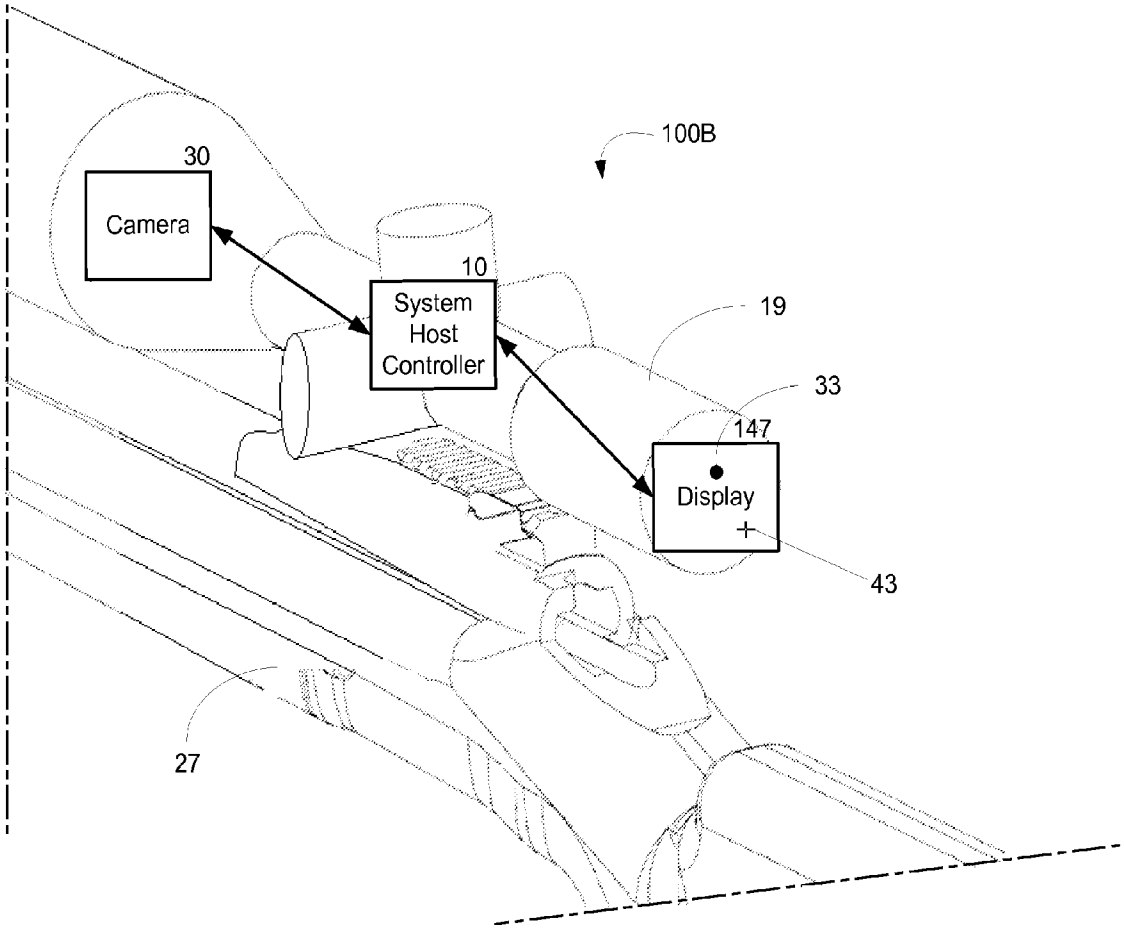
FIG. 2A illustrates an exemplary camera embodiment of a ballistic solution system coupled to a weapon.

Referring now to FIG. 2A, this figure illustrates an exemplary camera embodiment of a ballistic solution system 100B coupled to a weapon 27. In this exemplary embodiment illustrated in FIG. 2A, only a few elements of the ballistic solution system 100B1 are shown. Specifically, the ballistic solution system 100B is shown to include a display 147B, a system host controller 10, and a camera 30. The display 147B, according to this exemplary embodiment, is built in or part of the scope 19.

The display 147B may comprise any type of display device such as a liquid crystal display (LCD), a light emitting diode (LED) display, a plasma display, an organic light-emitting diode (OLED) display, and a cathode ray tube (CRT) display. With this built-in display 147B, anyone of these hardware options may be supported and housed within the scope 19.

The display 147B is coupled to the system host controller 10. The system host controller 10 is similar to the other exemplary embodiments described above. The system host controller 10 may comprise hardware and/or software. Coupled to the system host controller 10 is the camera 30. The camera 30 may comprise a video camera such as a webcam and can be a CCD (charge-coupled device) camera or a CMOS (complementary metal-oxide-semiconductor) camera. The camera 30 may be responsible for capturing images in front of the scope 19 that may include potential targets. Exemplary images captured by the camera 30 are illustrated and described below in connection with FIGS. 9A-10, 14-18.

The camera 30 may comprise a plurality of lenses and automatic zooming mechanisms as understood by one of ordinary skill the art. The ballistic solution system 100B may send instructions to the camera 30 to increase or decrease magnification levels in order to adjust the field of view for the camera 30. The camera 30 may further comprise digital zooming features in which images captured by the camera 30 are digitally enhanced/improved with dedicated graphical processors as understood by one of ordinary skill the art.

Figure 2B:
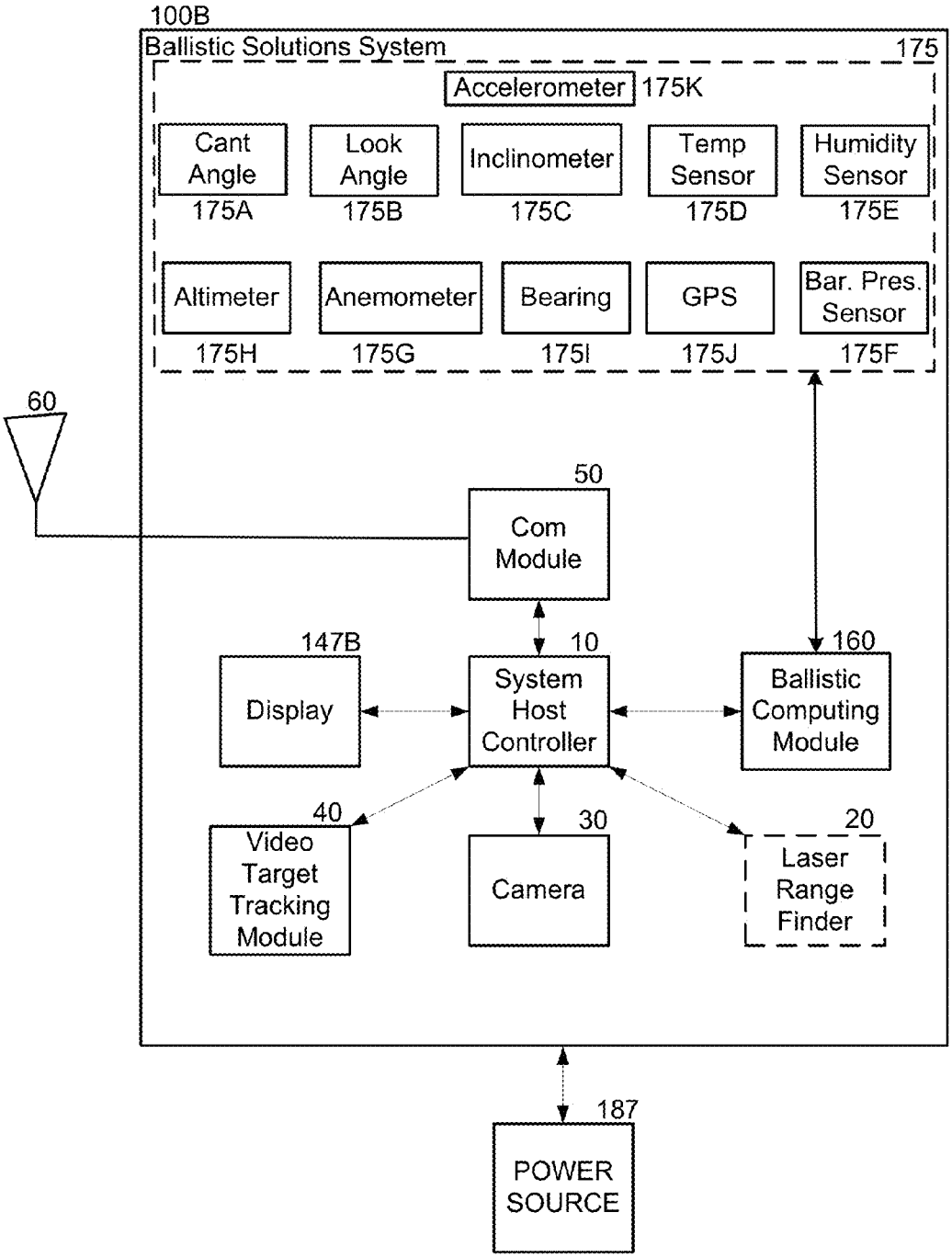
FIG. 2B is a functional block diagram for the ballistic solution system illustrated in FIG. 2A.

FIG. 2B is a functional block diagram for the ballistic solution system 100B illustrated in FIG. 2A. The functional block diagram of FIG. 2B is very similar to the functional block diagram illustrating FIG. 1B. Therefore, only the differences between FIG. 2B and FIG. 1B will be described below.

The system host controller 10 is coupled to a video target tracking module 40 and a communications module 50. The communications module 50 may comprise any type of communications transceiver or transmitter as understood by one of ordinary skill the art. According to one exemplary embodiment, the communications module 50 comprises a radio-frequency (RF) transceiver as understood by one of ordinary skill the art. However, other types of wired and/or wireless mediums and corresponding communications modules 50 may be employed without departing from the scope of this disclosure.

Other types of wireless mediums include, but are not limited to, acoustic, magnetic, optical, and infra-red mediums. The communications module 50 may be coupled to an antenna 60 for propagating a wireless medium. In the radio-frequency (RF) exemplary embodiment, the antenna 60 may propagate and receive radiofrequency signals as understood by one of ordinary skill the art.

The video target tracking module 40 is similar to the self correcting reticle module 35 of FIG. 1B. However, the video target tracking module 40 may be responsible for calculating coordinates for other graphical or screen related elements besides the crosshairs 43. For example, the video target tracking module 40 may monitor and produce unique screen indicators for tracking multiple potential targets as will be described below in connection with FIGS. 15-18. The video target tracking module 40 is responsible for calculating and sending screen coordinates to the system host controller 10 for generating various graphical screens or displays that are produced on the display device 147B.

One of the major advancements of the system 100B is that the video target tracking module 40, similar to the self correcting reticle module 35, displays the projectile (i.e. bullet) impact point shown with crosshairs 43 within the marksmen's field of view (in display 147A). Further, the video target tracking module 40 moves that projectile impact point (crosshairs 43) as the weapon 27 is moved by the marksmen.

The projectile impact point or crosshairs 43 is moved by the video target tracking module 40, which operates similar to the SCR module 35 for the direct optic embodiment of the ballistic solutions system 100A1. The video target tracking module 40 moves the crosshairs 43 as the weapon 27 moves since the ballistic computing module 160 is continuously updating its projectile impact point solutions when movement of the weapon 27 changes trajectory of the projectile. The video target tracking module 40, like the SCR module 35, translates the ballistics solutions data from the ballistic computing module 160 into appropriate screen mapping data for positioning the crosshairs 43 on projectile impact point.

As noted above in connection with FIG. 2A, the camera 30 may comprise a video camera such as a webcam and can be a CCD (charge-coupled device) camera or a CMOS (complementary metal-oxide-semiconductor) camera. The camera 30 may be responsible for capturing images in front of the scope 19 that may include potential targets. Exemplary images captured by the camera 30 are illustrated and described below in connection with FIGS. 9A-10, 14-18.

The ballistic solution system 100B of FIG. 2B may support the following functions and features: it may provide rapid ballistic solutions on the order of two seconds or less; a system 100B may provide for a very low electrical current draw, such as on the order of 385 nA during its sleep cycles and less than 35 mA during its peak performance; the system 100B may be powered with very little voltage such as on the order of 3V; the system 100B may be provided in electronic package that is very light weight on the order of 0.25 oz, 7 grams; the system 100B may be contained within a very tight electronic package volume such as on the order of 25.4 mm×40 mm×8.0 mm; and the system 100B may support two bit commands and may include on the order of least 64,000 commands.

FIG. 3 illustrates a direct optic ballistic solution system 100A2 that includes a ballistic solutions device 101 having a separate keypad 305 and display 147A coupled to a weapon. The direct optic ballistic solution system 100A2 illustrated in FIG. 3 is very similar to the direct optic ballistic solution system 100A1 of FIG. 1A. Therefore, only the differences between these two solutions will be described below.

The ballistic solutions device 101 may comprise a separate housing relative to the system host controller 10. The ballistic solutions device 101 may comprise the ballistic computing module 150 and any one of a combination of sensors 175. The ballistic solutions device 101 comprises a keypad 305 so that the operator of the weapon 27 may enter data such as, but not limited to, cant angle, look angle, temperature, humidity, and/or barometric pressure. The ballistic solutions device 101 is described in further detail in co-pending and commonly owned related U.S. non-provisional patent application Ser. No. 12/879,277, mentioned above in the related applications statement. The entire contents of this co-pending and commonly owned patent application are hereby incorporated by reference.

Therefore, the ballistic solutions device 101 may be purchased separately relative to the system host controller 10 and the self correcting reticle module 35. These two devices may then be coupled together with appropriate coupling cables or through wireless connections as understood by one of ordinary skill the art.

Figure 4:
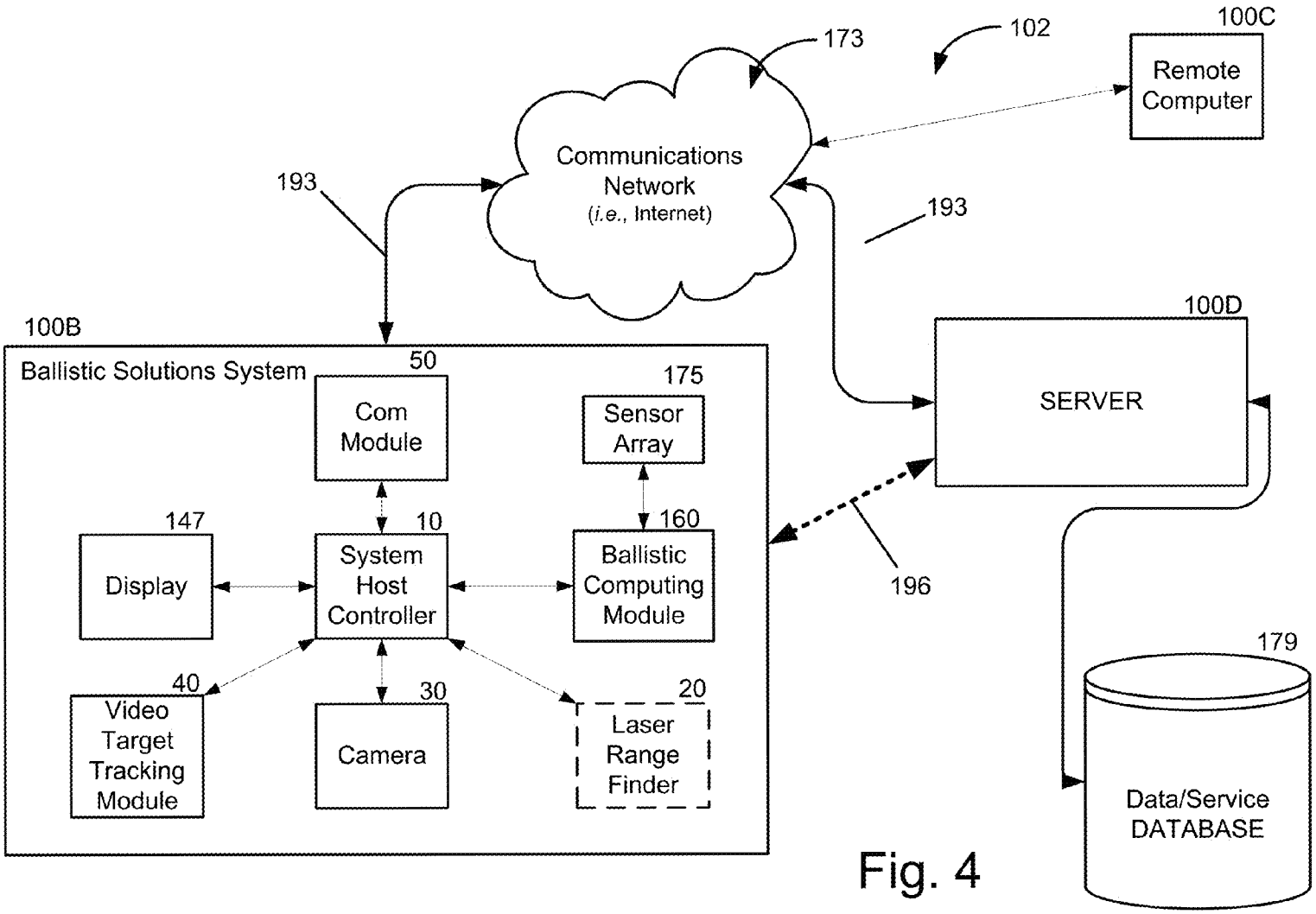
FIG. 4 illustrates a system that includes a camera embodiment for the ballistic solution system coupled to a computer network, a server, a database, and a remote computer.

FIG. 4 illustrates a system 102 that includes a camera embodiment for the ballistic solution system 100B coupled to a computer network 173, a server 100D, a database 179, and a remote computer 100C. Exemplary embodiments of a ballistic solutions system 100B that are configurable per the illustrated system 102 anticipate remote communication, real-time software updates, extended data storage, etc.

Advantageously, embodiments configured for communication via a computer system such as the exemplary system 102 depicted in FIG. 4 may leverage the Internet for, among other things, geographical information, real-time barometric readings, weather forecasts, real-time or historical temperate, etc. Other data that may be useful in connection with a ballistic solutions device 100B, and accessible via the Internet or other networked system, will occur to those with ordinary skill in the art.

The computer system 102 may comprise a server 100D which can be coupled to a network 173 that can comprise a wide area network ("WAN"), a local area network ("LAN"), the Internet, or a combination of networks. The server 100E may be coupled to a data/service database 179.

The data/service database 179 may store various records related to, but not limited to, device configurations, software updates, user's manuals, troubleshooting manuals, Software as a Service (SaS) functionality, customized device configurations for specific weapons or terrain, user-specific configurations, baseline DOPE, updated DOPE, previously uploaded DOPE, real-time DOPE, real-time weather data, target specific information, target coordinates, target altitude, target speed, etc. Advantageously, in some embodiments, operators of the ballistic solutions system 100B may download data from data/service database 179 at any time before engaging a target or, alternatively, in real-time via the communications module 50, which may provide for wired or wireless communication.

The server 100D may be coupled to the network 173. Through the network 173, the server 100D can communicate with various different ballistic solutions systems 100B that may include portable computing devices or other devices. Each ballistic solutions system 100B may be capable of running or executing web browsing software in order to access the server 100D and its various applications. The ballistic solutions systems 100B can take on many different forms such as desktop computers, laptop computers, handheld devices such as personal digital assistance ("PDAs"), in addition to other smart devices such as cellular telephones. Any device which can access the network 173, whether directly or via tether to a complimentary device, may be characterized as a ballistic solutions system 100B.

The ballistic solutions systems 100B may be coupled to the network 173 by various types of communication links 193. These communication links 193 may comprise wired as well as wireless links. The communication links 193 allow each of the ballistic solutions systems 100B to establish virtual links 196 with the server 100D.

The ballistic solutions system 100B preferably comprises a display 147 and one or more sensors 175 as described above. The sensors 175 as described above may capture any number of field conditions and/or conditions directly attributable to the weapon/scope to which it is coupled such as, but not limited to, the angle of the rifle relative to horizontal, the position of the rifle relative to the equator and the cant or tilt of the rifle relative to vertical or some other reference. The sensor inputs, as well as other manual inputs in some embodiments, may be used to calculate a ballistic solution for rendering on the display 147 as the crosshairs 43.

The ballistic solutions system 100B may communicate with the ballistic computing module 160, which may comprise software and/or hardware. The ballistic solutions computing module 160 may comprise a multimedia platform that can be part of a plug-in for an Internet web browser. The ballistic computing module 160 is designed to work with the sensors 175, optional manual inputs, the display 147, and any stored DOPE in order to produce a ballistic solution on the display 147 in the form of alphanumeric text data as well as positions of a zero point 33 and crosshairs 43.

In addition, in some embodiments, computer generated animation may be leveraged to render a ballistic solution on the display 147, such as illustrated in FIGS. 9-10 and 14-16. Specifically, the ballistic computing module 160 monitors signals from the sensors 175 in order to detect real-time ambient conditions and rifle-specific data (such as translation of the rifle through an arc of movement when "milling" a target).

Once the real-time ambient conditions and rifle-specific data is detected by the ballistic computing module 160, the ballistic computing module 160 may run ballistic calculation algorithms to arrive at a ballistic solution that involves manipulation of at least one of the crosshairs 43 and current weapon trajectory indicator 33. The ballistic solutions system 100B of FIG. 4 is similar to the ballistic solutions system 100B of FIG. 2B. Therefore, a further description of this ballistic solutions system 100B of FIG. 4 will not be provided below. Instead, the reader is referred back to FIG. 2B in which the details are described above.

Figure 5:
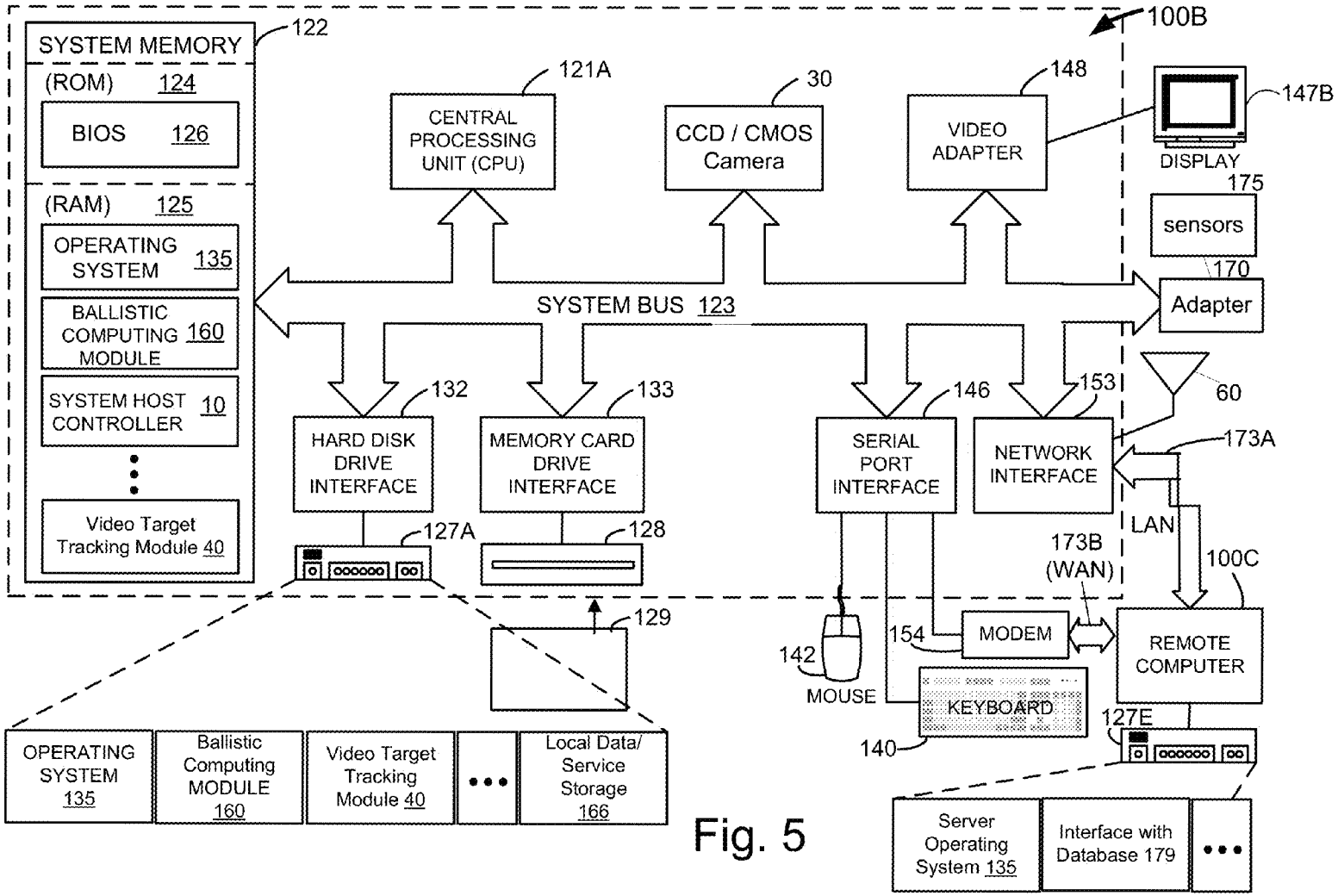
FIG. 5 is a detailed functional block diagram of one exemplary embodiment of the ballistic solution system which includes a display and an antenna for radio-frequency communications.

FIG. 5 is a detailed functional block diagram of one exemplary embodiment of the ballistic solution system 100B which includes a display 144 and an antenna 60 for wireless communications. The ballistic solution system 100B of FIG. 5 is very similar to the exemplary embodiment illustrated in FIG. 2B. However, in this exemplary embodiment of FIG. 5, the ballistic solution system 100B has been implemented more like a general purpose computer compared to the application specific integrated circuit (ASIC) implementation illustrated in FIG. 2B. One of ordinary skill in the art will appreciate that either embodiment or a combination of the two may be practiced/built without departing from the scope of this disclosure.

In other words, the system 100B in this exemplary embodiment of FIG. 5 has been described in terms as a general-purpose computing device in the form of a conventional computer. Notably, although a conventional computer is described relative to the FIG. 5 illustration, it is envisioned that single chip solutions may be used in some embodiments, such as illustrated in FIG. 2B.

Generally, the ballistic solutions system 100B may includes a processing unit 121, a system memory 122, and a system bus 123 that couples various system components including the system memory 122 to the processing unit 121. The system bus 123 may be any of several types of bus structures including a memory bus or memory controller, a peripheral bus, and a local bus using any of a variety of bus architectures. The system memory includes a read-only memory (ROM) 124 and a random access memory (RAM) 125. A basic input/output system (BIOS) 126, containing the basic routines that help to transfer information between elements within ballistic solutions device 100A, such as during start-up, is stored in ROM 124.

The ballistic solutions system 100B, which may embody a computer, may be designed to include a hard disk drive 127A for reading from and writing to a hard disk, not shown, and a memory card drive 128 for reading from or writing to a removable memory 129, such as, but not limited to, a memory card, a non-volatile memory card, a secure digital card (SD, SDHC, SDXC, miniSD, etc.), a memory stick, a compact flash memory (CF), a multi media card (MMC), a smart media card (SM), an xD-Picture card (xD), a Microdrive card, an EPROM non-volatile memory, an EEPROM non-volatile memory, or the like.

Hard disk drive 127A and memory card drive 128 are connected to system bus 123 by a hard disk drive interface 132, and a memory card drive interface 133, respectively. To enhance portability and ruggedness of the system 100B, the use of the hard disk drive 127A may be optional and could be dropped from the design and use in the system 100B as understood by one of ordinary skill in the art.

Although the exemplary environment described herein employs a hard disk 127A, and a removable memory card 129, it should be appreciated by those skilled in the art that other types of computer readable media which can store data that is accessible by a computer, such as magnetic cassettes, flash memory cards, digital video disks, Bernoulli cartridges, RAMs, ROMs, and the like, may also be used in the exemplary operating environment without departing from the scope of the invention.

Such uses of other forms of computer readable media besides the hardware illustrated will be used in smaller ballistic solutions systems 100B such as in cellular phones and/or personal digital assistants (PDAs). The drives and their associated computer readable media illustrated in FIG. 5 provide nonvolatile storage of computer-executable instructions, data structures, program modules, and other data for computer or ballistic solutions systems 100B.

A number of program modules may be stored on hard disk 127, memory card 129, ROM 124, or RAM 125, including an operating system 135, a ballistic computing module 160, the system host controller module 10, and a video target tracking module 40. Program modules include routines, sub-routines, programs, objects, components, data structures, etc., which perform particular tasks or implement particular abstract data types. Aspects of the present invention may be implemented in the form of a downloadable, client-side, browser based ballistic computing module 160 which is executed by the central processing unit 121A of the ballistic solutions system 100B in order to provide a ballistic solution.

A user may enter commands and information into a ballistic solutions system 100B through input devices, such as a keyboard 140 and a pointing device 142. Pointing devices may include a mouse, a trackball, and an electronic pen that can be used in conjunction with an electronic tablet. Other input devices (not shown) may include a microphone, joystick, game pad, satellite dish, scanner, or the like. These and other input devices are often connected directly to processing unit 121 in some embodiments or, alternatively, may be connected through a serial port interface 146 that is coupled to the system bus 123, but may be connected by other interfaces, such as a parallel port, game port, a universal serial bus (USB), wireless port or the like.

The display 147 may also be connected to system bus 123 via an interface, such as a video adapter 148. As noted above, the display 147 can comprise any type of display devices such as a liquid crystal display (LCD), a plasma display, an organic light-emitting diode (OLED) display, and a cathode ray tube (CRT) display. The sensors 175 may also be connected to system bus 123 via an interface, such as an adapter 170. It will be understood that sensors 175 may be comprised within the housing of an embodiment of a ballistic solutions system 100B, or, alternatively, communicably coupled to an embodiment of a ballistic solutions system 100B.

The ballistic solutions system 100B may further comprise a video camera 30 such as a webcam and can be a CCD (charge-coupled device) camera or a CMOS (complementary metal-oxide-semiconductor) camera. In addition to the camera 30 and display 147, the ballistic solutions system 100B, comprising a computer, may include other peripheral output devices (not shown), such as speakers and printers.

The ballistic solutions device 100A, comprising a computer, may operate in a networked environment using logical connections to one or more remote computers, such as the remote computer 100C. A remote computer 100C may be another personal computer, a server, a client, a router, a network PC, a peer device, or other common network node. While the remote computer 100C typically includes many or all of the elements described above relative to the ballistic solutions system 100B, only a memory storage device 127E has been illustrated in FIG. 5. The logical connections depicted in FIG. 5 include a local area network (LAN) 173A and a wide area network (WAN) 173B. Such networking environments are commonplace in offices, enterprise-wide computer networks, satellite networks, telecommunications networks, intranets, and the Internet.

When used in a LAN networking environment, the ballistic solutions system 100B, comprising a computer, may be coupled to the local area network 173A through a network interface or adapter 153. When used in a WAN networking environment, the ballistic solutions system 100A, comprising a computer, typically includes a modem 154 or other means for establishing communications over WAN 173B, such as the Internet. Modem 154, which may be internal or external, is connected to system bus 123 via serial port interface 146. In a networked environment, program modules depicted relative to a server, or portions thereof, may be stored in the remote memory storage device 127E. It will be appreciated that the network connections shown are exemplary and other means of establishing a communications link between the computers may be used.

Moreover, those skilled in the art will appreciate that the system may be implemented in other computer system configurations, including hand-held devices, multiprocessor systems, multicore processors, application specific integrated chips (ASICs), microprocessor based or programmable consumer electronics, network personal computers, minicomputers, mainframe computers, and the like. The invention may also be practiced in distributed computing environments, where tasks are performed by remote processing devices that are linked through a communications network. In a distributed computing environment, program modules may be located in both local and remote memory storage devices.

Figure 6A:
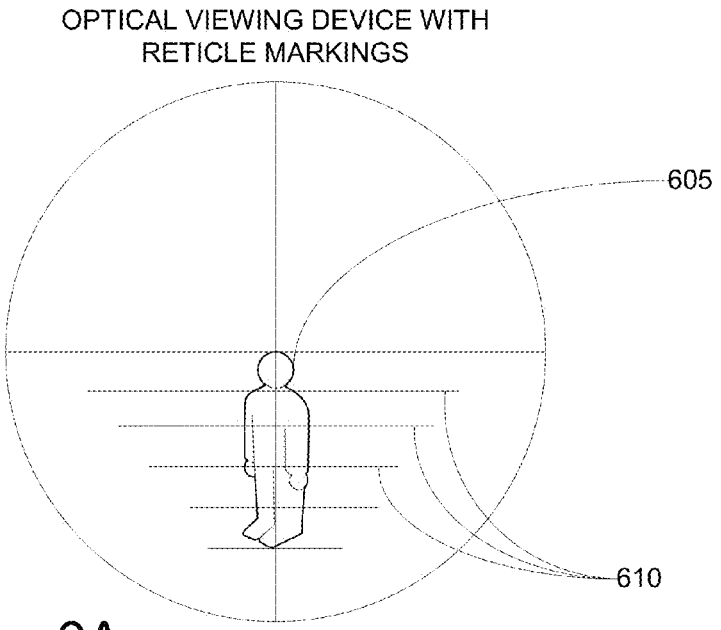
FIG. 6A depicts a scene of a target, such as a human target, that may be viewed through an exemplary rifle scope comprising a plurality of reticle markings.

Referring now to FIG. 6A, this figure depicts a scene of a target 605, such as a human target, that may be viewed through an exemplary rifle scope 17 comprising a plurality of reticle markings 610. At the particular magnification of the exemplary scope 17, the distance between two reticle marks may represent one (1) mil, wherein 1 mil demarcates a yard of linear height at one thousand (1000) yards. Notably, therefore, in the example it should be understood that the same mil would demarcate more than a yard of linear height at a distance beyond one thousand yards and less than a yard of linear height at a distance shorter than one thousand yards.

As such, suppose that it is known, or at least reasonably estimated, that the target 10 depicted in FIG. 6A is six feet tall, i.e. two yards in English units. Because the target 10 takes up five reticle markings 610, i.e. five mils, in the scope, it can be calculated that the target 10 is four hundred yards away.

Figure 6B:
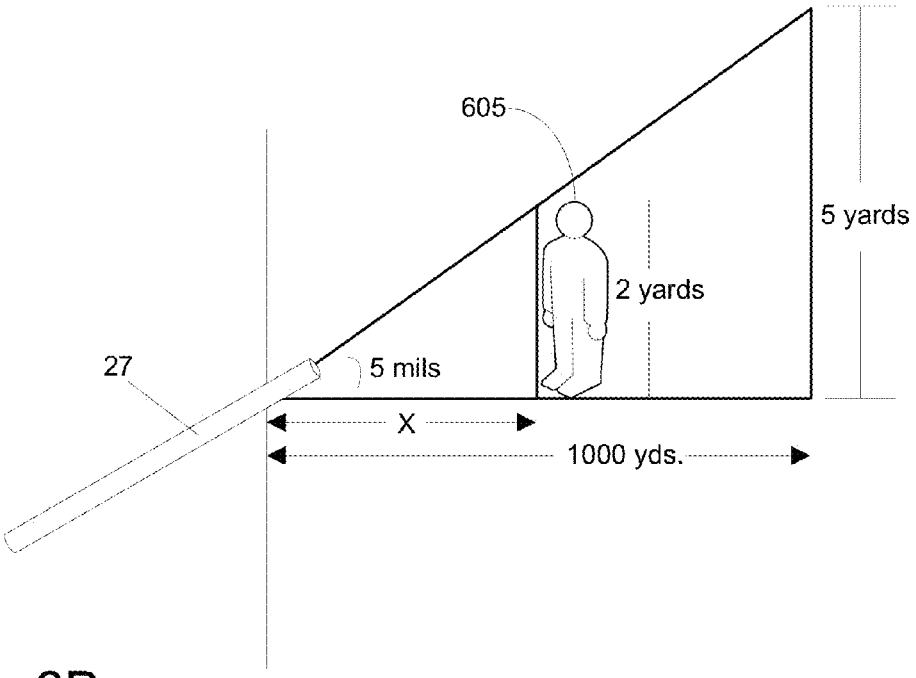
FIG. 6B is an exemplary unit circle illustrating the mathematical ratios used to calculate a distance to the target illustrated in FIG. 6A.

The math behind the calculation is based on simple ratios of triangles and can be understood by consideration of the exemplary unit circle depicted in FIG. 6B. As outlined above, the illustrative target's actual height is known to be two yards (six feet) and the target's height as viewed through the scope reticle 610 is measured at five mils. Therefore, because five mils is known to correlate to a five yard tall object at 1000 yards, a Y/X ratio for the triangles depicted in FIG. 6B is Established as 5/1000. Thus, because the 2 yard tall object (the human target) also takes up five mils when viewed through the exemplary scope reticle 615, the equation 5/1000=2/X can be solved using cross multiplication to arrive at the four hundred yard distance.

Again, the calculated distance is only as accurate as the estimate of the target's actual height and the estimate of how many mils the figure takes up in the reticle. Clearly, in FIG. 6A the target takes up exactly five mils. But, consider a more likely scenario wherein the mil height estimation is not so clear. Modifying the example articulated above, suppose that the marksman estimated that the target took up five mils in the reticle 610 when, in actuality, the target only had a mil height of 4.8 mils. Using the math above, the marksman would calculate a four hundred yard distance to the target when the actual distance is almost 417 yards (4.8/1000=2/X). That seventeen yard miscalculation, depending on the ballistic trajectory of the bullet, could result in a significant deviation from the intended target 605.

Returning to a marksman who has successfully ranged the illustrative target to four hundred yards, he can refer to his DOPE data to determine a ballistic solution. As described prior, a marksman will zero his weapon 27 at a given distance and the DOPE data that he collects subsequent to zeroing the weapon 27 will record the ballistic performance of the bullet beyond the zero range. Therefore, assuming all ambient conditions are consistent with the conditions at which the weapon 27 was zeroed, the marksman need only to adjust his elevation such that the trajectory of the projectile (i.e. the bullet) will hit the target 605 that he now knows is four hundred yards away.

To adjust his scope settings off of the zero settings for the exemplary four hundred yard shot, the marksman will have determined that the weapon 27 needs to be raised by a certain angle or, alternatively, the lenses internal to the scope 17 adjusted by a certain angle (thus serving to cause the marksman to raise the weapon 27 in order to place the crosshairs on the target). The angle of adjustment is commonly measured in the art as either minutes of angle (MOA) or MILS. Regardless of units, the angle of adjustment can be calculated using trigonometry based on tangents, as the legs of the triangle depicted in FIG. 6B are known to one of ordinary skill in the art.

One of ordinary skill in the art will understand that the ballistic solution is greatly impacted if the distance to target is inaccurate. The mathematical calculations usually work out nicely for the FIG. 6 example, but it should be understood that it was based on two estimations left up to the judgment of the marksman—the target's height and the number of mils the target took up in the reticle. More specifically, the target in the illustration took up exactly five mils in the illustrative scope reticle, but such an exact measurement is rare in reality. More often than not, the marksman is required to estimate where between the reticle markings 610 a target 605 falls.

Moreover, to mil the target accurately, the marksman also has to hold one reticle marking 610 exactly at one end of the target 605 while he estimates where the other end of the target 605 falls. A guess for a target 605 height taking up a guessed amount of mils in a scope reticle 615 will inevitably result in inconsistent ranging calculations. Consequently, if the range is miscalculated, then the ballistic solution derived from the DOPE table will not be very useful. This common field scenario often results in missed targets on the first shot, with subsequent adjustments required until the target 605 is eventually hit.

As described above, inaccurate ranging of a target 605 is only one thing that can throw off a long range shot. Even assuming that a target 605 is accurately ranged, it is inevitable that the actual field conditions of the shot will vary from the shot conditions recorded in the marksman's DOPE book. Crosswinds, humidity, altitude, temperature and barometric pressure all have an effect on a bullet's flight and significant changes in any of these field conditions will cause the ballistic trajectory of a projectile, like a bullet, to vary at a set distance. Therefore, accurate measurement or estimation of field conditions is also essential in order to arrive at a ballistic solution that will hit an accurately ranged target.

Advantageously, embodiments of the ballistic solutions system 100 may drastically reduce marksman error in milling targets 605, thus delivering consistently accurate distances to target 605. Additionally, embodiments of a ballistic solutions system 100 may also comprise features and aspects that enable a user to leverage available real-time field data such that error associated with those variables is minimized prior to calculating a comprehensive ballistic solution.

One exemplary embodiment of a ballistic solution system 100 comprises an inclinometer 175C and is mechanically coupled to an optical viewing device 17, 19 useful for demarcating the height of an object. Notably, one of ordinary skill in the art will understand that an optical viewing device 17, 19 useful for demarcating the height of an object may be a device comprised of lenses and reticles, a rifle 27 with a scope 17, 19, a bow, a pair of binoculars, a user's arm, or even a stick.

Also, it will be understood that the use of the term "inclinometer" 175C within the context of a ballistics solutions device anticipates any rotational and/or translational measurement device including, but not limited to, an inclinometer, an accelerometer, a gyroscope, etc. Moreover, it is envisioned that an inclinometer 175C or the like may be of a single axis or multiple axis type, may use an internal reference for measurement, or may be configured to provide an analog or digital output.

Because the exemplary ballistic solution system 100 is mechanically coupled to the secondary device (usually a weapon 27), articulation of the secondary device 27 through an angular rotation can be measured by the inclinometer 175C. One of ordinary in the art will understand that such an embodiment is useful for the accurate calculation of a distance to target because error in "milling" the target can be drastically reduced compared to existing methods.

Consider the scenario in which a marksman estimates the number of mils in a reticle that are taken up by a target. With a ballistic solution system 100 comprising an inclinometer 175C and mechanically coupled to the marksman's weapon 27, the graduated reticle markings 610 are not required for ranging the target. The marksman needs only to place the single reticle marking or other visual indicator, like crosshairs 43, at the bottom of the target 605 and then rotate (technically, elevate the weapon 27) to the top of the target—the inclinometer 175C may measure the angular rotation of the marksman's rifle 27 as the visual indicator, like a reticle 610 or crosshairs 43 is moved/translated.

The accuracy of the marksman's crosshairs 43 translation from the bottom to the top (or the top to the bottom) of the target 605 is drastically improved over the estimation of how many mils the target 605 would take up in the reticle markings 610. With the angle known via the inclinometer 175C, and the target height known or estimated, the distance can be calculated via the tangent function of the angle.

It is understood that a ballistic solutions system 100 provided with an inclinometer 175C may also be used to accurately calculate the height of an object 705 at a known distance. For example, if the distance to an object is known, the methodology described above could be used to "mil" the object 605, whereby the tangent function could be employed to solve for the object height.

As just described, an embodiment of a ballistic solutions system 100 comprising an inclinometer 175C may be used to accurately calculate a distance to target 605. Subsequently, the distance to target 605 may be used in connection with a marksman's DOPE data in order to calculate a ballistic solution. One of ordinary skill in the art will appreciate that a marksman's DOPE data is often not comprehensive and, as such, the marksman must make judgments as to how actual field condition variables may affect the bullet's trajectory.

Advantageously, some embodiments of a ballistic solutions system 100 further comprise integrated DOPE data, means for automatic as well as the manual input of field conditions or estimations and/or sensors 175 configured to collect real-time field condition data so that a comprehensive ballistic solution can be provided to the marksman.

For example, some embodiments of a ballistic solutions device, in addition to comprising an inclinometer 175C, may also be configured to receive user inputs of field conditions such as, for example, crosswind strength. Additionally, some embodiments configured to provide a comprehensive ballistic solution may be configured to receive and reference standard DOPE data for given calibers or custom DOPE provided by the marksman. Also, some embodiments may comprise sensors 175C configured to measure any number of field conditions including, but not limited to, altitude (altimeter 175G), barometric pressure (175F), humidity (175E), cant angle (175A), bearing (175I), latitude and longitude (175J), look angle (175B), and temperature (175D).

It will be understood that exemplary embodiments of a ballistics solutions system 100 may comprise all, or just some, of the features and aspects outlined above and below. A particular exemplary embodiment configured to receive Data Observed from Prior Engagements (DOPE) may leverage user inputs and/or sensor inputs, in conjunction with the calculated range from the inclinometer 175C, in order to arrive at a comprehensive ballistic solution. That is, by incorporating the known and accurately estimated data, the DOPE may be algorithmically manipulated such that an accurate ballistic solution is delivered. Notably, while much of the ballistic algorithms that may be applied to DOPE data in order to calculate a ballistic solution based on field condition variables are known, the accuracy of the measurement of the field conditions directly correlates with the accuracy of the resulting ballistic solution.

As such, one of ordinary skill in the art will recognize that exemplary embodiments of a ballistic solution system 100 that comprises real-time sensors 175 configured to measure field variables may deliver more accurate ballistic solutions than devices presently used in the art which require the user to estimate those field variables. Of course, it will also be understood that various embodiments of a ballistics solutions system 100 may be configured such that the user can override or eliminate the consideration of a sensor input in favor of a manual input or none at all.

Outputs or deliverables generated by various embodiments of a ballistic solutions device include, but are not limited to, a MIL card, a range card, an updated DOPE card, scope setting adjustments, aiming or "holdover" recommendations, etc. With regards to the various outputs, a marksman may employ a ballistic solutions device to generate shot-specific data or entire data cards based on pre-input manual and measured variables.

As an example, a marksman may input known or estimated field conditions, such as crosswind strength, and, in conjunction with sensor inputs from sensors 175 comprised within the exemplary ballistic solutions system 100, a comprehensive card may be generated for those specific conditions, wherein the card is generated from a stored baseline ballistic curve or baseline DOPE data that has been adjusted in light of the various inputs. The card may relay the adjusted data in terms of distance to target, MILS, MOA or the like.

Advantageously, embodiments that are configured to output a card can provide a marksman with accurate adjustments to existing DOPE such that the marksman is not required to calculate those adjustments on a shot by shot basis. Moreover, other exemplary embodiments may generate a shot-specific output from pre-loaded manual and sensor inputs such that the marksman needs only to use the inclinometer functionality of the ballistic solutions system 100 in order to trigger a real-time, shot-specific solution.

Regardless of the output of a given embodiment of a ballistic solutions system 100, one of ordinary skill in the art will appreciate and understand that various exemplary embodiments of a ballistic solutions system 100 may provide for different methods of solution implementation. For example, some exemplary embodiments may provide an output measured in MILS whereby the marksman is required to use a scope's reticle markings 610 to "holdover" the target 605 at a certain number of mils. Other exemplary embodiments may require the marksman to actually adjust the scope's DLOS such that the new settings cause the crosshairs 43 to correspond to the given target 605 sought to be engaged.

Still other embodiments may cause the ballistic solution to be employed by automatic adjustment of the scope's erector assembly or lenses from the zero settings. As an alternative to adjusting a scope's erector assembly or lenses from the zero settings, other embodiments of a ballistic solutions system 100 may cause a ballistic solution to be implemented via automatic adjustment of the base mechanism used to couple a scope 17, 19 to a weapon 27, such as a rifle. Such exemplary embodiments that may be configured to adjust the scope mounting mechanism may comprise motors or manual gearing for manipulation of the scope's position relative to the center line 615 of the rifle's bore, thereby alleviating the need to change a scope's initial elevation and windage settings.

Moreover, various exemplary embodiments of a ballistic solutions system 100 may be employed separately from the weapon 27 or other projectile launching device that will be used to implement calculated ballistic solutions. Still other exemplary embodiments may be integrated into a rifle 27, a scope 17, 19 coupled to a rifle 27 or the mounting mechanism between a rifle 27 and scope 17, 19. Additionally, some exemplary embodiments may be configured to be used separately from a rifle 27 or in direct communication with a rifle 27, as may be preferred by the user. It is also envisioned that some exemplary embodiments will comprise "quick disconnect" features or aspects that provide for the coupling and decoupling of the embodiment to a rifle 27 or other device.

Figure 7A:
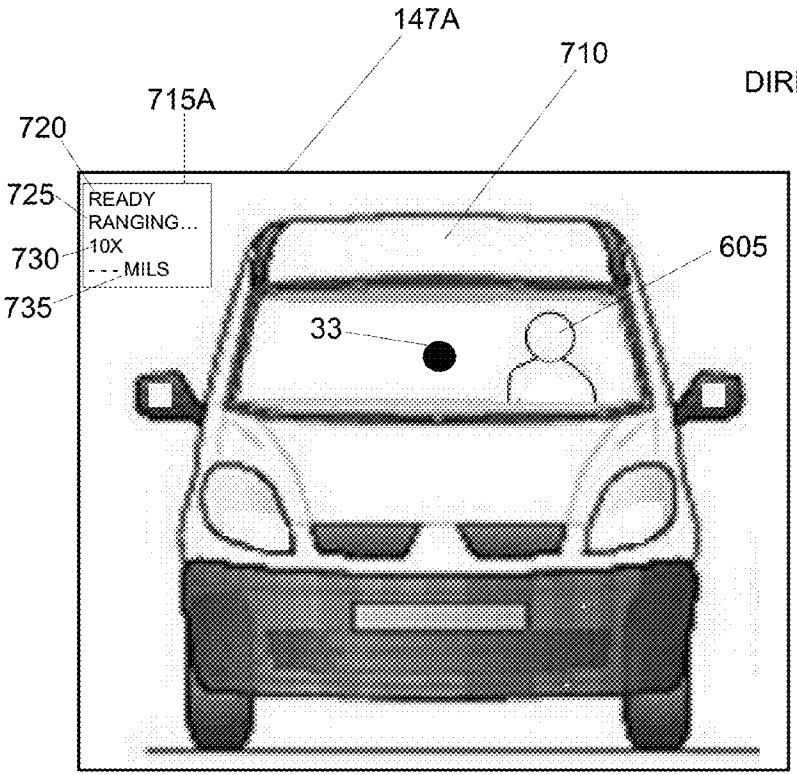
FIG. 7A illustrates a exemplary scene including a zero point and one or more potential targets being ranged and seen using a direct optic ballistic solution system according to one exemplary embodiment.

FIG. 7A illustrates an exemplary scene within a display 147A including a zero point 33 and one or more potential targets 605, 710 being ranged and seen using a direct optic ballistic solution system 100A1 (not shown, but see FIG. 1B) according to one exemplary embodiment. The scene of FIG. 7A is generated by a direct optic 17 in combination with the display 147A of the direct optic ballistic solution system

100A1. The first potential target 605 may comprise a person while the second potential target 710 may comprise a vehicle. In the exemplary scene illustrated, the vehicle comprises a minivan.

The display 147A is shaped in a rectangular fashion since the display 147A corresponds with the display 147A illustrated in FIG. 1A in which the display 147A is positioned in front of a direct optic, such as a rifle scope 17 (illustrated in FIG. 1A). One of ordinary skill the art will appreciate that the display 147A may have any type of shape corresponding to the direct optic, like a rifle scope 17, that it may be coupled to. This means that the display 147A may be made with a circular shape in order to match a direct optic which has a corresponding circular shape. And those exemplary embodiments in which a camera 30 is used, the display 147B (See FIG. 2A) does not need to match any direct optic since a direct optic is usually not required because all the images and magnification of potential target images may be captured with the camera 30.

Referring back to FIG. 7A, the display 147A may generate a message window or region 715A that may comprise alphanumeric text messages. While the message window or region 715A has been illustrated in the top left-hand corner of the display 147A, one of ordinary skill the art will appreciate that the message window 715A may change positions and may change size and shape depending on the amount and type of data displayed. The alphanumeric text messages may comprise a status field 720, a range field 725, a magnification field 730, and an elevation field 735. Additional or fewer fields may be employed without departing from the scope of this disclosure. Further, the box containing the text messages of the message window 715A is optional.

The status field 720 may indicate the current status of the direct optic ballistic solutions system 100A1. The status field 720 may display messages such as "ready" to indicate that the system 100B is in a ready state. The status field 720 may also display messages such as "busy" or "error" to indicate that the system 100A1 is either busy performing calculations or is in error state. Other similar status messages are well within the scope of this disclosure.

The range field 725 may indicate that a potential target 605, 710 is currently being ranged meaning that the distance between the weapon 27 and the potential target 605, 710 is being calculated. The range field 725, after the ranging operation has occurred, may then display the current distance between the weapon 27 and the potential target 605, 710. The distance may be displayed in any form of units such as English units or metric units of distance, like yards or meters.

The range field 725 may display the message "ranging" when the direct optic ballistic solution system 100B is calculating the distance to the target 605, 710 or if the direct optic ballistic solution system 100A1 is equipped with an optional laser rangefinder 20 and when the rangefinder 20 is performing the distance calculation.

The magnification field 730 displays the current magnification at which the direct optic is currently set. This allows the direct optic ballistic solution system 100A1 to assist in calculating the distances to potential targets 605, 710 if the direct optic ballistic solution system 100A1 does not use the optional laser rangefinder 20 as understood by one of ordinary skill the art. In those systems, such as the camera embodiment 100B as illustrated in FIG. 2B, the magnification field 730 will usually not be displayed since the camera embodiment 100B controls the magnification of images with the camera 30.

The elevation field 735 may display the current dialed in-elevation for the direct optic 17 that the system 100A1 is coupled to. The elevation field 735 may display data in units of Mils. However, other units may be used such as, but not limited to, MOA, IPHY, Feet, inches, clicks as understood by one of ordinary skill in the art.

The zero point 33 generated by the display 147A generally corresponds to the zero point of the barrel of the weapon 27, such as a rifle. The zero point 33 may also correspond to the endpoint of a laser beam generated by a laser rangefinder 20 as understood by one of ordinary skill in the art. In the exemplary embodiment illustrated in FIG. 7A, the zero point 33 is shown to be positioned on the windshield of the potential target 710 that comprises a minivan.

Figure 7B:
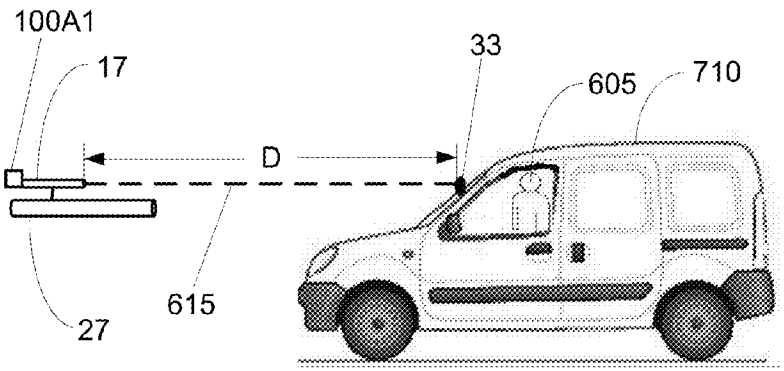
FIG. 7B illustrates a real-world side view of the weapon and the one or more potential targets which were visible in the display of the direct optic ballistic solution system of FIG. 7A.

FIG. 7B illustrates a real-world side view of the weapon 27 and the one or more potential target 605, 710 which were visible in the display 147A of the direct optic ballistic solution system 100A1 of FIG. 7A. The system 100A1 is represented by small square-shaped module coupled to the direct optic 17 of the weapon 27. The dashed line 615 represents a distance D between the weapon 27 and the potential target 605, 710. The dashed line 615 may generally correspond with the default line of sight (DLOS) that intersects an imaginary line emanating from the barrel for the weapon 27 as understood by one of ordinary skill in the art.

The dashed line 615 may also correspond to a laser beam generated by an optional laser rangefinder 20 of the direct optic ballistic solution system 100A1. The endpoint relative to the dashed line may comprise the zero point 33 that is illustrated in the display 147A of FIG. 7A. When ballistic solution system 100 has the optional laser rangefinder 20, the laser rangefinder 20 may calculate the distance D based on the reflected light from the zero point 33 reflecting from the surface of the potential target 605, 710.

If the ballistic solution system 100 and does not have the optional laser rangefinder 20, then the ballistic solution system 100 may calculate the distance D to the target 605, 710 by using the inclinometer 175C. The ballistic solution system 100 may use the inclinometer 175C in combination with input from the operator of the weapon 27 who will enter a top point in a bottom point in order to define the height of a target 605, 705 as will be discussed in further detail below in connection with FIG. 11.

Figures 7C, 7D:
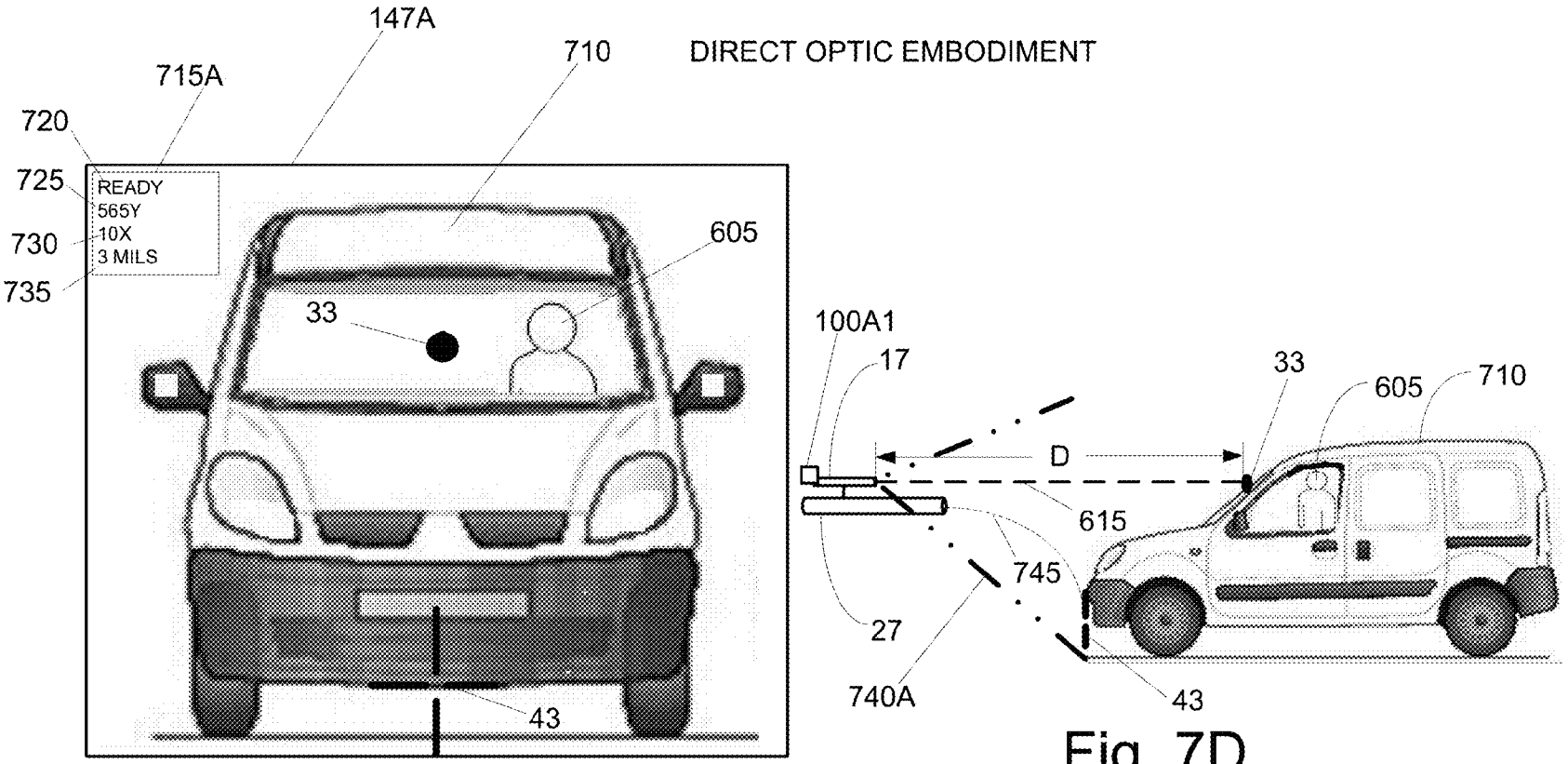
FIG. 7C illustrates a exemplary scene including the zero point and the one or more potential targets after being ranged as seen using a direct optic ballistic solution system according to one exemplary embodiment.
FIG. 7D illustrates a real-world side view of the weapon and the one or more potential targets which were visible in the display of the direct optic ballistic solution system of FIG. 7C.

FIG. 7C illustrates a exemplary scene including the zero point 33 and the one or more potential targets 605, 710 after being ranged as seen using a direct optic ballistic solution system 100A1 according to one exemplary embodiment. The scene of FIG. 7C is generated by a direct optic 17 in combination with the display 147A of the direct optic ballistic solution system 100A1. FIG. 7C is very similar to FIG. 7A. Therefore, only the differences between these two figures will be described.

According to this exemplary embodiment, the range field 725 has changed from the status of "ranging" to the numerical value of 565 Y which is five-hundred and sixty-five yards. As noted previously, other units of measurement such as units in the SI system may be employed without departing from the scope of this disclosure. The elevation field 735 has also changed from a blank or placeholder to the number 3, representing 3 MILs.

Other units besides MILs may be used for the elevation field 735 as discussed above. The range value in the range field 725 may be a result produced by either a laser rangefinder 20 or a calculation made by the ballistic solutions system 100A1. The display 147A may also been updated by the self correcting reticle module 35 to include crosshairs 43. One of ordinary skill the art will appreciate that other graphical elements besides crosshairs 43 may be employed without departing from the scope of this disclosure. For example, instead of crosshairs 43, an "X" shaped icon or symbol may be employed as described above in connection with how reticles 43 may be varied. As noted previously, the crosshairs 43 may indicate the ballistic solution impact point as calculated by the ballistic solutions system 100A1, and specifically, the self correcting reticle module 35 translates the ballistics solution calculated by the ballistic computing module 160 into coordinates for the display 147A.

In other words, the real-world position of the crosshairs 43 relative to the potential targets 605 and 710 is determined by the ballistic computing module 160 taking into account all of its sensors input and especially the distance between the potential targets 605, 710 and the weapon 27. The self correcting reticle module 35 converts the ballistic solution of the impact point calculated by the ballistic computing module 160 into screen coordinates for the display 147A.

FIG. 7C illustrates that at certain distances relative to the potential target 605, 710, the zero point 33 for the weapon 27 will not be the same as the impact point 43 due to external forces as described above that include, but are not limited to, gravity, wind, the Coriolis effect, temperature, humidity, etc.

This relationship between the zero point 33 and the crosshairs 43 denoting the impact point for the weapon 27 is made further apparent as illustrated in FIG. 7D. FIG. 7D illustrates a real-world side view of the weapon 27 and the one or more potential targets 605, 710 which were visible in the display 147A of the direct optic ballistic solution system 100A1 of FIG. 7C. FIG. 7D is very similar to FIG. 7B described above. Therefore, only the differences between these two figures will be described.

FIG. 7D further illustrates the direct optic field of view 740A. The direct optic field of view 740A corresponds with the height dimension of the display 147A illustrated in FIG. 7C. FIG. 7D also illustrates the trajectory 745 of a projectile that can be launched or fired from the weapon 27.

The trajectory 745 has a significant arc or curved shape to represent the effects of external forces on the projectile launched from the weapon 27. As mentioned above, these external forces may include, but are not limited to, gravity, wind, the Coriolis effect, temperature, humidity, etc. FIG. 7D also shows a side view of the crosshairs 43 represented by a dashed line segment. If an operator of the weapon 27 were to fire the weapon 27 according to its current position relative to the potential targets 705, 710, then the projectile fired from the weapon 27 would hit the potential target 710 in the central portion of the crosshairs 43 as calculated by the direct optic ballistic solution system 100A1.

Figures 8A, 8B:
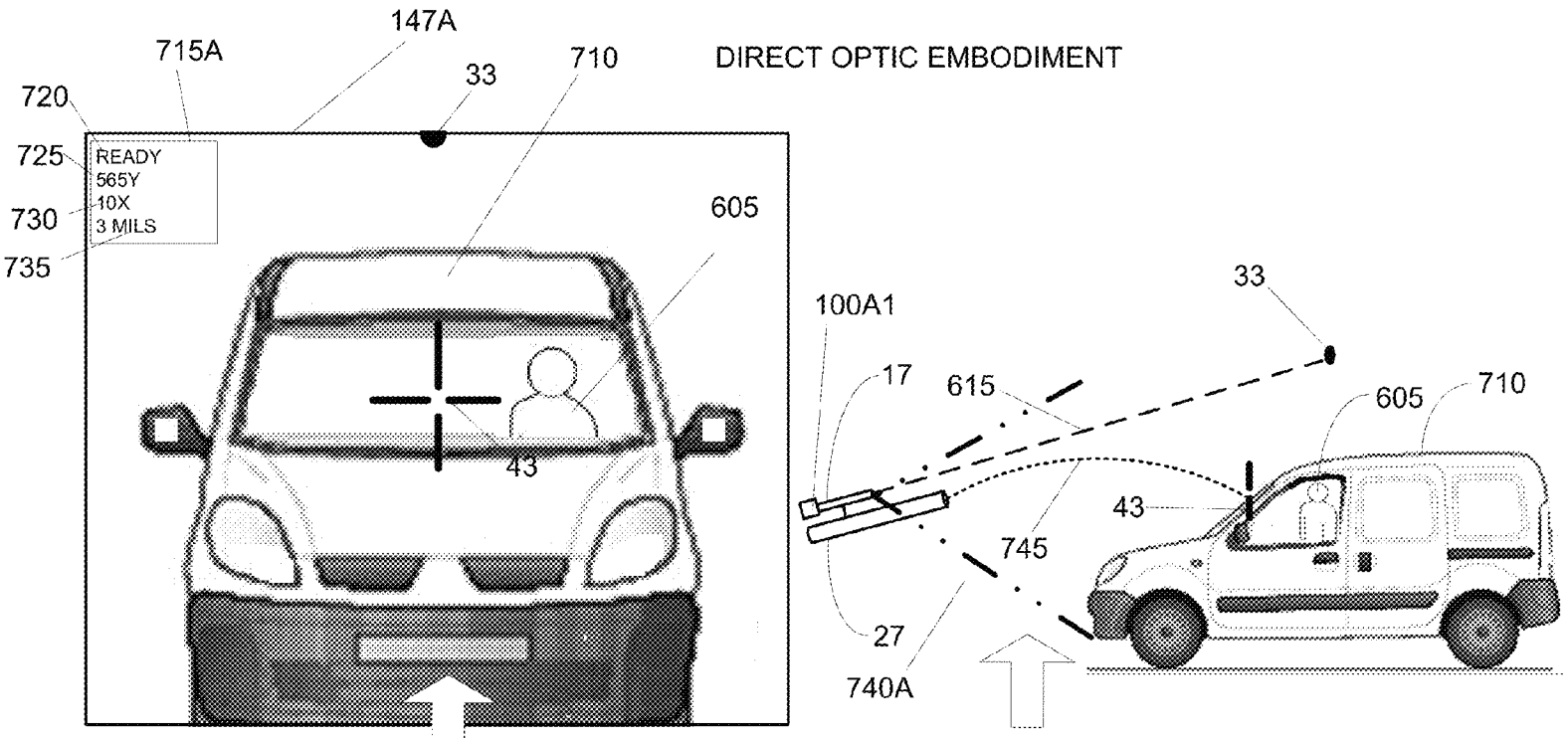
FIG. 8A illustrates a exemplary scene including crosshairs and one or more potential targets as seen using a direct optic ballistic solution system according to one exemplary embodiment.
FIG. 8B illustrates a real-world side view of the weapon and the one or more potential targets which were visible in the display of the direct optic ballistic solution system of FIG. 8A.

FIG. 8A illustrates an exemplary scene including crosshairs 43 and one or more potential targets 605, 710 as seen using a direct optic ballistic solution system 100A1 according to one exemplary embodiment. The scene of FIG. 8A is generated by a direct optic 17 in combination with the display 147A of the direct optic ballistic solution system 100A1. FIG. 8A is very similar to FIGS. 7A, 7C. Therefore, only the differences between these figures will be described.

According to this exemplary environment, the crosshairs 43 has been elevated to correspond with elevation and/or lateral adjustments to the weapon 27 relative to the horizon and azimuth. In other words, according to this exemplary embodiment illustrated in FIG. 8A, the operator has adjusted the weapon 27 upwards relative to the horizon of the earth (see upward arrow of FIG. 8A) so that the ballistic solution impact point 43 is now in line with the potential targets 605, 710.

In the exemplary embodiment illustrated in FIG. 8A compared to the exemplary embodiment illustrated in FIG. 7C, the operator of the weapon 27 has adjusted the weapon such that the direct optic ballistic solution system has calculated the impact point of the projectile to be positioned within the windshield of the vehicle 710 as indicated by the crosshairs 43.

At the option of the operator and/or the ballistic solution system 100, the zero point 33 may be continued to be displayed within the display 147A. However, in the exemplary embodiment illustrated in FIG. 8A, the weapon 27 has been adjusted such that the zero point 33 for the weapon 27 may now fall outside the field of view 740A for the weapon 27. The existence of the zero point 33 being outside the field of view 740A for the weapon 27 as further illustrated in FIG. 8B as will be described below.

Another difference between FIG. 8A and FIG. 7C is that the field of view 740A for the direct optic 17 has been shifted in an upward direction relative to the vehicle 710. Comparing the display 147A of FIG. 7C to FIG. 8A, one of ordinary skill the art recognizes that the rectangular shaped view has shifted upward such that the tires of the vehicle 710 are no longer visible in FIG. 8A compared to FIG. 7C in which the tires of vehicles 710 are visible. This shift in the field of view 740A for the direct optic 17 comprising the scope of a rifle 27 is more apparent in FIG. 8B as will be described in further detail below.

FIG. 8B illustrates a real-world side view of the weapon 27 and the one or more potential targets 605, 710 which were visible in the display 147A of the direct optic ballistic solution system 100A1 of FIG. 8A. FIG. 8B is similar to FIG. 7D. Therefore, only the differences between these two figures will be described.

As noted previously, the field of view 740A for the direct optic 17 has been shifted upward relative to the vehicle 710 such that the lower limit of the field of view 740A has been elevated from the Earth to a section of the bumper of the vehicle 710. Because of this shift in the position of the direct optic 17 and the corresponding shift in the position of the weapon 27, the endpoint of the trajectory 745 of the projectile has also moved from the lower portion of the bumper of the vehicle 710 to the center of the windshield of the vehicle 710. The endpoint of the trajectory 745 comprises the side portion of the crosshairs 43 as illustrated in FIG. 8B. As noted previously, the crosshairs 43 indicates the ballistic solution impact point which is the center of the windshield of the vehicle 710.

The zero point 33 corresponding to the default line of sight (DLOS) of the weapon 27 is shown to be almost out of the field of view 740A for the weapon 27 as defined by the direct optic 17 due to the rotation of the weapon 27 relative to the horizon of the Earth. One of ordinary skill the art recognizes that if the operator of the weapon 27 adjusted the magnification for the direct optic 17, this may also change the field of view 740A for the direct optic 17. If the magnification of the direct optic 17 was increased, then the field of view 740A would become more narrow—increasing the size of each object within the current field of view 740A. Meanwhile, if the magnification of the direct optic 17 was decreased, then the field of view 740A would become much wider and would encapsulate more objects if other objects were present.

Figure 9A:
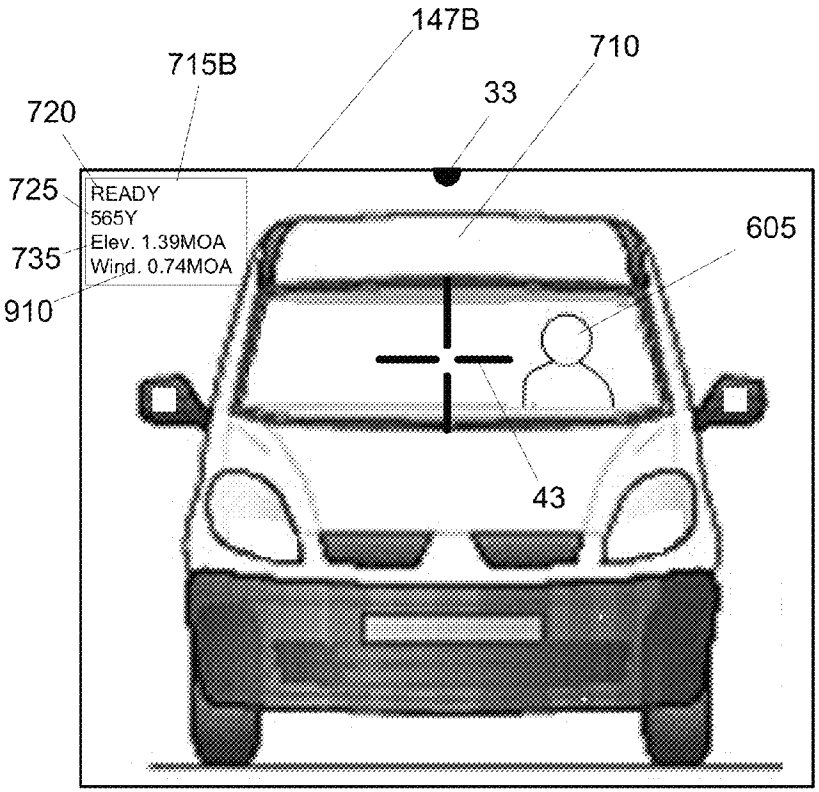
FIG. 9A illustrates a exemplary scene including crosshairs and one or more potential targets as seen using a camera embodiment of the ballistic solution system.

Referring now to FIG. 9A, this figure illustrates an exemplary scene including crosshairs 43 and one or more potential targets 605, 710 as seen using a camera embodiment of the ballistic solution system 110B. According to this exemplary embodiment, the display 147B is generated by the camera 30 as controlled by the system host controller 10. FIG. 9A is very similar to FIGS. 7C, 8A. Therefore, only the differences between FIG. 9A and FIGS. 7C, 8A will be described.

The message window 715B of FIG. 9A is different compared to the message window 715A of FIGS. 7C, 8A. One difference is that the magnification field 730 which generally describes the magnification of the direct optic 17 is no longer present. This is because the camera 30 of the ballistic solution system 100B is responsible for controlling the magnification of the potential targets 605, 710 which are projected onto the display 147B. The message window 715B further includes a new status field adjacent to the elevation field 735: a windage adjustment field 910.

In the exemplary embodiment illustrated in FIG. 9A, the unit of measurement for the elevation field 735 and the windage adjustment field 910 are expressed in MOAs. As noted previously, these fields may be expressed in other units of measurement, such as, but not limited to, MILs, IPHY, Feet, inches, clicks, etc. the values for the windage adjustment field 910 and the elevation field 735 may be automatically calculated by the ballistic solution system 100B based on inputs that the system 100B receives from the sensor array 175 and/or inputs that it receives from the operator of the weapon 27.

Because the ballistic solution system 100B controls the magnification for the display 147B with the camera 30, the ballistic solution system 100B may automatically adjust the magnification so that it is at an optimal level for including the most desired targets 605, 710 for the operator of the weapon 27. This means that the ballistic solution system 100B may continuously adjust the field of view 740B for the camera 30.

Comparing the field of view 740B (which includes the image presented in the display 147B of FIG. 9A) to the field of view 740A (which includes the objects presented in the display 147A of FIG. 8A), the entire vehicle 710 is presented in display 147B compared to a portion of the vehicle 710 presented in the display 147A of FIG. 8A. The differences between these fields of view 740 is due to the camera 30 of the system 100B being able to automatically adjust the zoom and magnification for the display 147B.

This automatic adjustment to the field of view 740B for the camera 30 is more apparent in FIG. 9B as described in further detail below. In the exemplary embodiment illustrated in FIG. 9A, crosshairs 43 which denotes the ballistic solution impact point is shown to be in the center portion of the windshield of the vehicle 710, similar to FIG. 8A described above.

Figure 9B:
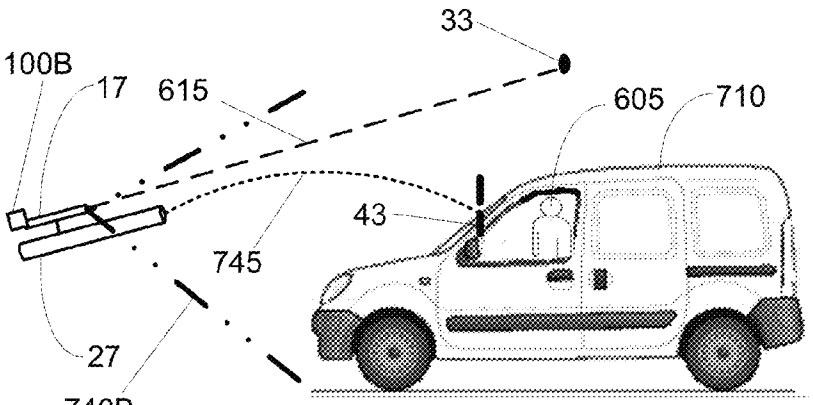
FIG. 9B illustrates a real-world side view of the weapon and the one or more potential targets which were visible in the display of the camera embodiment of the ballistic solution system of FIG. 9A.

FIG. 9B illustrates a real-world side view of the weapon 27 and the one or more potential targets 605, 710 which were visible in the display of the camera embodiment of the ballistic solution system 100B of FIG. 9A. The system 100B is illustrated with a square-shaped module coupled to the direct optic 19 of the weapon 27. As noted above, the system 100B may be completely integrated within the direct optic 19. FIG. 9B is very similar to FIG. 8B. Therefore, only the differences between FIG. 9B and FIG. 8B will be described below.

Comparing FIG. 9B to FIG. 8B, it is apparent that the field of view 740B generated by the camera 30 of the system 100B relative to the field of view 740A produced by the direct optic 17 for the system 100A1 of FIG. 8B is larger. The larger field of view 740B of FIG. 9B is attributed to the camera 30 which usually has autofocusing with its optics. The camera 30 as controlled by the video target tracking module 40 may continuously adjust the field of view 740B so that the potential targets 605, 710 are always visible for the operator of the weapon 27. The camera 30 may adjust its zoom and the magnification of the display 147B automatically under control of the video target tracking module 40 so that the operator of the weapon 27 may focus his or her efforts on maintaining the ballistic solution impact point noted by the crosshairs 43 on the intended target 605 or 710.

Figure 10:
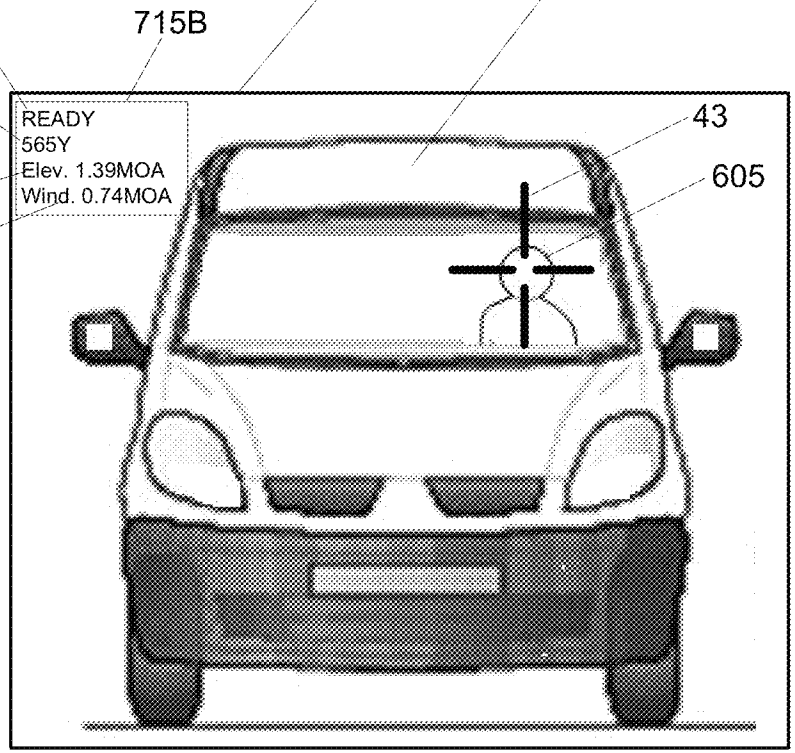
FIG. 10 illustrates a exemplary scene including crosshairs and one or more potential targets as seen using a camera embodiment of the optic ballistic solution system.

FIG. 10 illustrates a exemplary scene including crosshairs 43 and one or more potential targets 605, 710 as seen using a camera embodiment of the optic ballistic solution system 100B. According to this exemplary embodiment, the display 147B is generated by the camera 30 as controlled by the system host controller 10. FIG. 10 is very similar to FIG. 9A. Therefore, only the differences between FIG. 10 and FIG. 9A will be described.

In the exemplary embodiment illustrated in FIG. 10, the system host controller 10 in combination with the video target tracking module 40 have positioned the crosshairs 43 (which denotes the ballistic solution impact point) over the potential targets 605.

What is one unique advantage with the camera embodiment of system 100B is that the camera 30 may always maintain a magnification and zoom such that all potential targets 605, 710 remain in the field of view of the display 147B while the operator of the weapon 27 may only be interested and/or capable of striking one of the targets 605, 710 at a time. Meanwhile, the crosshairs 43 which denotes the ballistic solution impact point may be positioned off-centered relative to the geometric center of the display 147B. The operator of the weapon 27 will understand that even though the ballistic solution impact point noted by the crosshairs 43 is off-centered relative to display 147B, the potential target 605 will still be struck by the projectile launched by the weapon 27 as long as the crosshairs 43 is aligned with the potential target 605.

FIG. 11A1 illustrates an exemplary scene including height bars 1115A, 1115B and one or more potential targets 605 being ranged and seen using a direct optic ballistic solution system 100A1 according to one exemplary embodiment. The scene of FIG. 7A is generated by a direct optic 17 in combination with the display 147A of the direct optic ballistic solution system 100A1. FIG. 11A1 is very similar to FIGS. 7A, 7C, and 8A. Therefore, only the differences between FIGS. 11A1 and 7A, 7C, and 8A will be described below.

In the exemplary embodiment of FIG. 11A1, the message window 715A includes a new height input field 1105 that displays a request for the operator of the weapon 27 to input a first point of two points for measuring a height of a potential target 605 captured within the display 147A. The display 147A may generate two graphical markers or elements 1115A, 1115B by the operator of the weapon 27.

While the graphical markers 1115A, 1115 of FIG. 11A1 have been illustrated as lines, other graphical elements or symbols may be employed without departing from the scope of this disclosure as understood by one of ordinary skill the art. While a height dimension has been selected for input, the system 100A1 may just as easily request a width dimension input. The width of a potential target 605 may also be used calculate distance to the target 605.

The graphical markers 1115A, 1115B may be characterized as height bars to the operator 27. The operator may manipulate the height bars 1115A, 1115B by using a pointing device or some other input device, like a keypad 305, that may be coupled to the direct optic ballistic solutions system 100A1. The operator of the weapon 27 may press the input device, like a keypad 305, when the first height bar 1115A is positioned over the first point of a height dimension. Similarly, the operator of the weapon 27 may press an input device, like a keypad 305, when the second height bar 1115B is positioned over the second point for the height dimension.

These height bars 1115A, 1115B are used by the system 100A1 in order to calculate the distance to the potential target 605. The operator of the weapon 27 provides an estimated height of the potential target 605 and then uses the height bars 1105 in combination with the height of the potential target 605 in order to calculate the distance to the target 605.

According to one exemplary embodiment, the self correcting reticle module 35 counts the pixels denoted by the height bars 1115 in combination with the known magnification of the direct optic 17 in order to range the potential target 605. The self correcting reticle module 35 then positions the crosshairs 43 on the display 147A at a position which corresponds to the real-world impact point as calculated by the ballistic computing module 160.

FIG. 11B1 illustrates a exemplary scene including crosshairs 43A used for a first point in a height dimension and one or more potential targets 1102 being ranged and seen using a direct optic ballistic solution system 100A1 according to one exemplary embodiment. The scene of FIG. 11B1 is generated by a direct optic 17 in combination with the display 147A of the direct optic ballistic solution system 100A1. FIG. 11B1 is very similar to FIG. 11A1. Therefore, only the differences between FIGS. 11A1 and 11B1 will be described below.

According to the exemplary embodiment illustrated in FIG. 11B1, the potential target 1102 comprises an animal other than a human compared to the potential target 605 FIG. 11A1. The potential target 1102 is shown to have the shape of a deer. However, other types of animal targets besides deer are well within the scope of this disclosure as understood by one of ordinary skill the art.

According to this exemplary embodiment, the crosshairs 43A may be used similar to the height bars 1115A, 1115B described above in connection with FIG. 11A1. That is, the crosshairs 43A may be used by the operator of the weapon 27 to denote at least two points for a height dimension of the target 1102. In the exemplary embodiment illustrated in FIG. 11B1, a first point of a two point height dimension has been identified with the crosshairs 43A.

FIG. 11A2 illustrates a exemplary scene including height bars 1115A, 1115B and one or more potential targets 605 after being ranged and seen using a direct optic ballistic solution system 100B according to one exemplary embodiment. The scene of FIG. 11A2 is generated by a direct optic 17 in combination with the display 147A of the direct optic ballistic solution system 100A1. FIG. 11A2 is very similar to FIG. 11A1. Therefore, only the differences between FIGS. 11A2 and 11A1 will be described below.

According to this exemplary embodiment, the message window 715A has been updated by the direct optic ballistic solution system 100A1 to include the range to the potential target 605 in yards as indicated by the update to range field 725. The direct optic ballistic solution system 100A1 was able to use the height dimension defined by the height bars 1115A, 1115B in order to optically range or determine the distance to the potential target 605 as described above with respect to the optical ranging techniques that may be used by the ballistic solution system 100 and specifically the ballistic computing module 160 for the distance calculation and real-world impact point and the self correcting reticle for positioning the crosshairs 43 in the display 147A on the impact point.

FIG. 11B2 illustrates an exemplary scene including crosshairs 43B used for a second point in a height dimension and one or more potential targets 1102 after being ranged and seen using a direct optic ballistic solution system 100B according to one exemplary embodiment. The scene of FIG. 11B2 is generated by a direct optic 17 in combination with the display 147A of the direct optic ballistic solution system 100A1. FIG. 11B2 is very similar to FIG. 11B1. Therefore, only the differences between FIGS. 11B2 and 11B1 will be described below.

According to this exemplary embodiment, the message window 715A has been updated by the direct optic ballistic solution system 100A1 to include the range to the potential target 1102 in yards as indicated by the update to range field 725. The direct optic ballistic solution system 100A1 was able to use the height dimension defined by the two different positions of the crosshairs 43A, 43B in order to optically range or determine the distance to the potential target 1102 as described above with respect to the optical ranging techniques that may be used by the ballistic solution system 100 and specifically the ballistic computing module 160 to calculate the distance to the potential target 1102.

Figure 12:
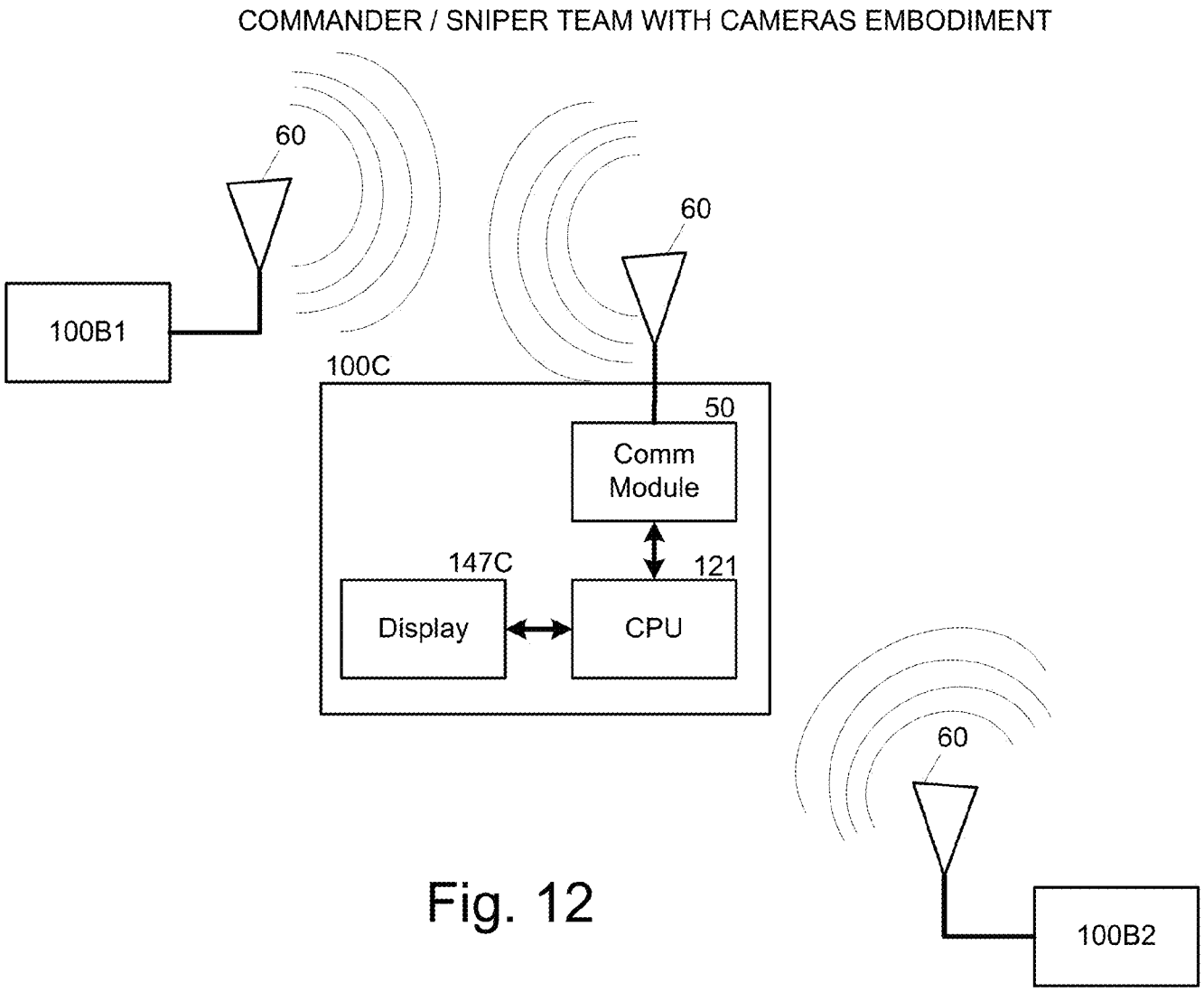
FIG. 12 is a functional block diagram illustrating some details of a commander and marksmen team using camera embodiments of the ballistic solution system.

FIG. 12 is a functional block diagram illustrating some details of a commander 100C and marksmen team 100B1, 100B2 using camera embodiments of the ballistic solution system 100B. According to this exemplary embodiment, a commander unit 100C may be in constant wireless communication with at least two different marksmen units that employ two separate camera embodiments of the ballistic solution system 100B. The antennas 60 of each unit 100 may transmit and receive wireless communications such as radiofrequency signals.

The commander unit 100C may comprise a communication module 50 that is coupled to a central processing unit 121. The central processing unit may also be coupled to a display 147C. In this way, each of the cameras 30 of the ballistic solution systems 100B may relay their images to the commander unit 100C for projection on the display 147C which may be visible by the commander. The communication modules 50 among the units 100 may establish data communications as well as voice communications service that the commander may assess situations and provide appropriate commands to the marksmen units 100B1, 100B2. Further details of a commander unit 100C and a marksmen team are described in further detail below in connection with FIGS. 13-14.

Figure 13:
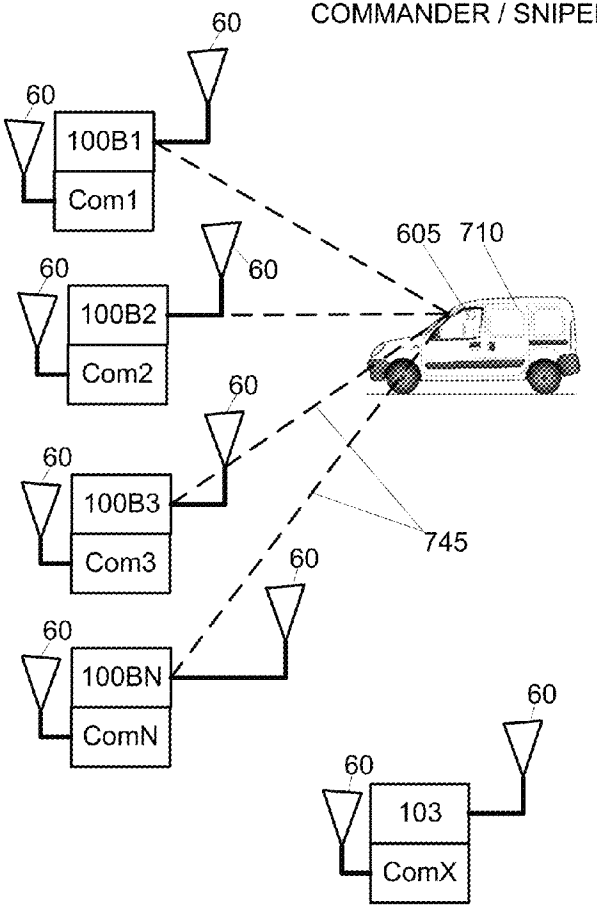
FIG. 13 is a functional block diagram illustrating how a commander may track a target with a marksmen team using camera embodiments of the ballistic solution system.

FIG. 13 is a functional block diagram illustrating how a commander unit 100C may track a target 710 with a marksmen team 100B1-BN using camera embodiments of the ballistic solution system 100B. According to this exemplary embodiment, a commander unit 100C may be in constant wireless communications with his marksmen team that may comprise a plurality of ballistic solution systems 100B that include cameras 30 (not illustrated, but see FIG. 2B described above).

In this exemplary embodiment, each unit 100 is provided with a secondary communication device represented by the reference character "com." The secondary communication device may support wireless audio communications while the communication module 50 (not illustrated) present within each ballistic solution system 100B may support wireless data communications. The dashed lines 745 between the potential target 710 and the camera embodiments of the ballistic solution system unit 100B may comprise the trajectory of each projectile that may be launched from a weapon 27 associated with each ballistic solution system unit 100B.

In this way, the commander unit 100C may receive for separate and different images of the potential target 710 as recorded by cameras 30 from each different ballistic solution system unit 100B. The commander unit 100C and/or other systems, such as the database 179 as illustrated in FIG. 4B, may record both the audio communications and data communications that include the digital images of the 710 as evidence for future review.

With the separate communication "com" modules supporting the audio communications, the commander unit 100C may issue appropriate commands, such as firing a weapon 27 at the potential target 710. The separate communication "com" modules may also provide for some communication redundancy if any of the data communications from a respective ballistic solution system unit 100B fails or becomes subjected to some interference and vice versa with respect to the audio communications.

Figure 14:
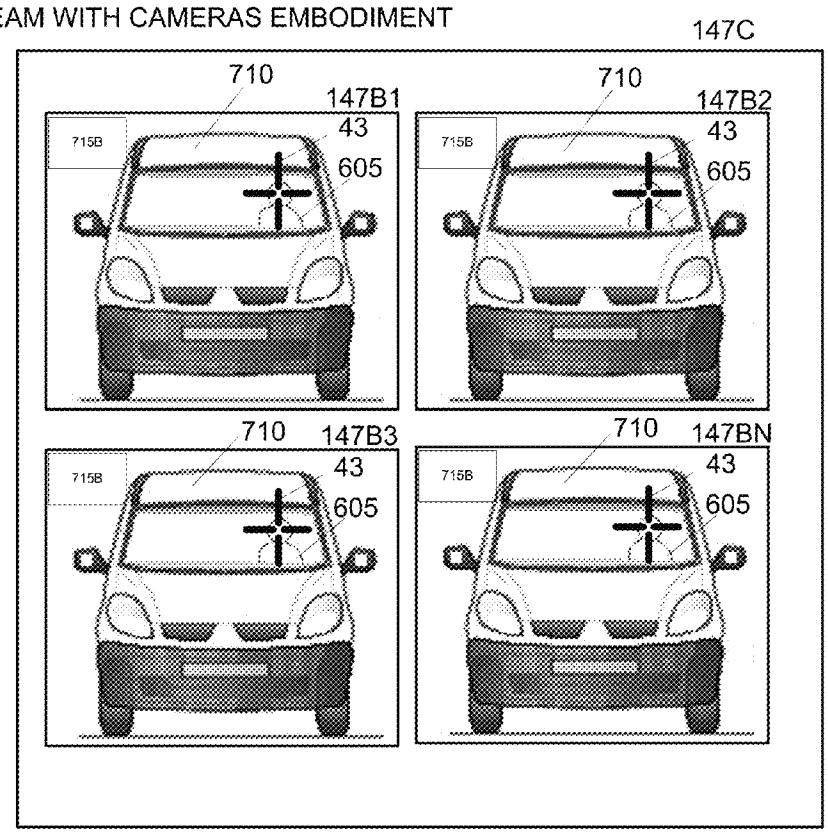
FIG. 14 is an exemplary screen display for the commander illustrated in FIG. 13.

FIG. 14 is an exemplary screen display 147C for the commander unit 100C as illustrated in FIG. 13. As noted above, a commander unit 100C coupled to at least four different camera embodiments of the ballistic solution systems 100B may receive four separate camera feeds produced by the cameras 30 of each system 100B. These four separate camera feeds may be displayed simultaneously by the commander unit 100C as illustrated in the display 147C of FIG. 14.

Alternatively, or in addition to this illustrated embodiment, the operator of the commander unit 100C may select camera feeds such that only one feed is displayed at a time on the display 147C. Each display 147B projected on the display 147C may comprise the identical information that is presented to each operator of the weapons 27 corresponding to the units 100B as illustrated in FIG. 13. Similar to FIGS. 9A, 10, each display 147B produced by each system unit 100B may comprise the status window 715 and its corresponding information or data in addition to crosshairs 43 is a noting the ballistic solution impact point generated by a respective ballistic solution system 100B.

One advantage of this exemplary embodiment of FIGS. 13-14 is that when the commander unit 100C issues a fire command to one of the units 100B, then the commander unit 100C will still have accurate and clear views of the potential target 710 from the remaining three units 100B. One of ordinary skill the art will recognizes that the unit 100B that receives the fire command will likely have its camera 30 off target for brief moment due to the recoil action of the weapon 27 when it launches its projectile, such as a bullet.

Figure 15:
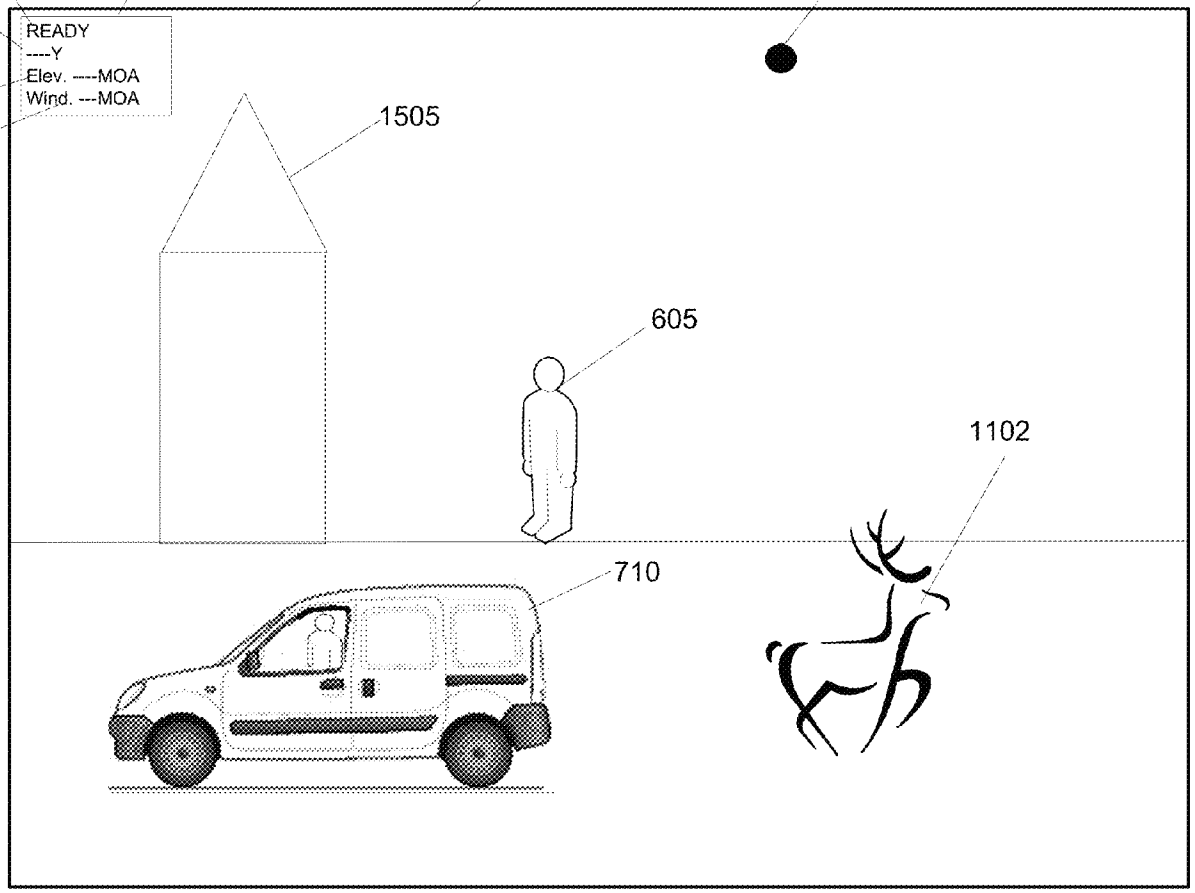
FIG. 15 illustrates an exemplary scene with a plurality of targets as seen using a camera embodiment of the ballistic solution system.

FIG. 15 illustrates an exemplary scene with a plurality of potential targets 605, 710, 1102, and 1505 as seen using a camera embodiment of the ballistic solution system 100B. According to this exemplary embodiment, the display 147B is generated by the camera 30 as controlled by the self correcting reticle 35 of system 100B. FIG. 15 is similar to FIGS. 9A, 10, and 14. Therefore, only the differences between FIG. 15 and FIGS. 9A, 10, and 14 will be described.

According to this exemplary embodiment in FIG. 15, the video target tracking module 40 receives input that multiple potential targets 605, 710, 1102, and 1505 exist within the display 147B. The video target tracking module 40 may comprise one or more pattern/object/shape recognition algorithms as understood by one of ordinary skill in the art. For example, the video target tracking module 40 may be trained to look for certain objects, like humans, animals, vehicles, weapons, buildings, etc. This means the video target tracking module 40 may determine that potential target 605 has a shape of a human, while potential target 710 has a shape of a vehicle. Similarly, the video target tracking module may determine that potential target 1102 has a shape of an animal, while potential target 1505 has a shape of a building.

The video target tracking module 40 may continuously monitor the ballistic solutions impact points that it receives from the ballistics computing module 160 for each of the targets 605, 710, 1102, and 1505 that it recognizes. The message window 715A may remain blank until one of the potential targets 605, 710, 1102, and 1505 is selected by an operator of the weapon 27. The operator may select one of the potential targets 605, 710, 1102, and 1505 when the zero point 33 of the weapon 27 comes in relative close proximity to a potential target 605, 710, 1102, and 1505.

Also, the crosshairs 43 denoting the projectile (i.e. bullet) impact point will not appear in the display 147B until the zero point 33 is in close proximity to a potential target 605, 710, 1102, 1505. In the exemplary embodiment illustrated in FIG. 15, the zero point 33 is so distant from all of the targets 605, 710, 1102, and 1505 that the video target tracking module 40 does not produce any crosshairs 43 for any of the targets 606, 710, 1102, and 1505.

Figure 16:
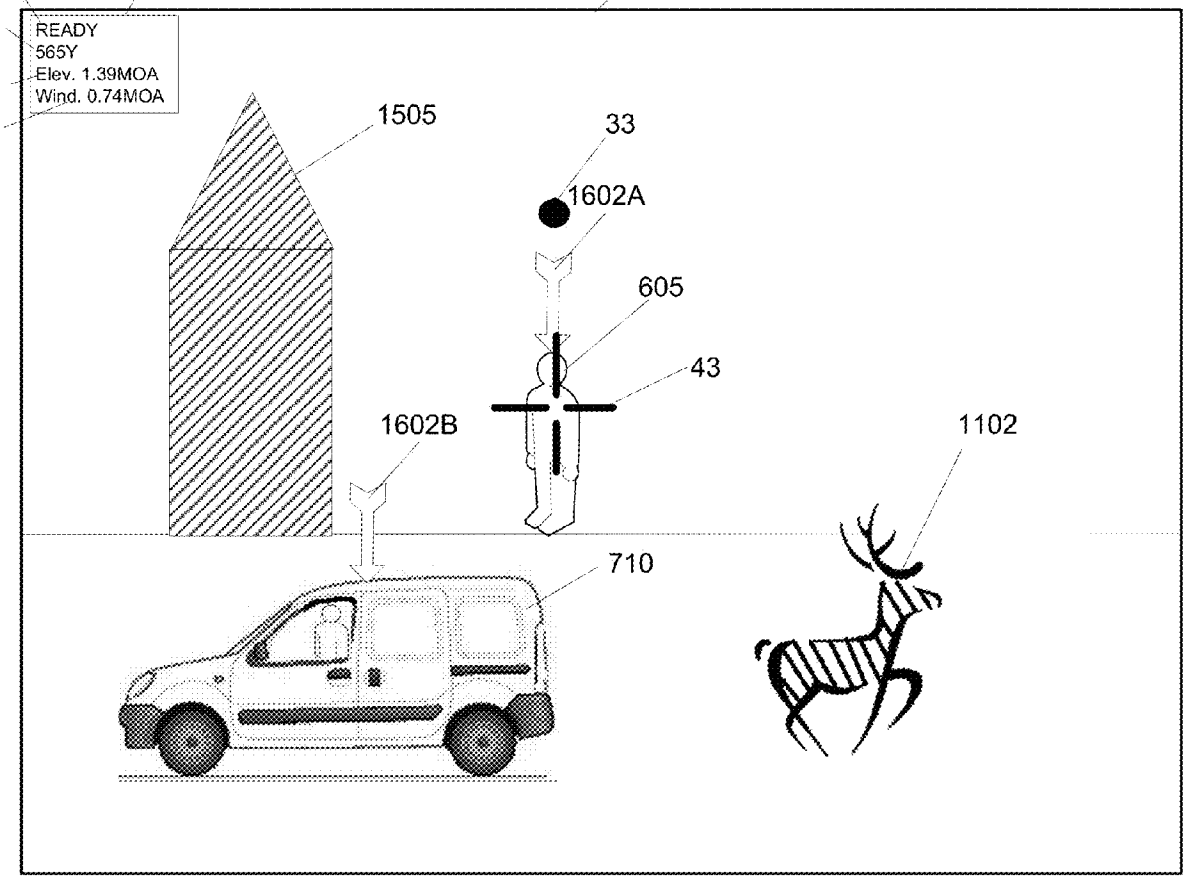
FIG. 16 illustrates an exemplary scene with a plurality of targets as seen and being tracked with unique screen markers using a camera embodiment of the ballistic solution system.

FIG. 16 illustrates an exemplary scene with a plurality of targets 605, 710, 1102, and 1505 as seen and being tracked with unique screen markers 1602A, 1602B using a camera embodiment of the ballistic solution system 100B. According to this exemplary embodiment, the display 147B is generated by the camera 30 as controlled by the video target tracking module 40 of system 100B. FIG. 16 is similar to FIG. 15. Therefore, only the differences between FIG. 16 and FIG. 15 will be described.

As noted previously, the video target tracking module 40 recognized the potential targets 605, 710, 1102 and 1505 in FIG. 15 and started to calculate the ballistic solution impact points for each of the potential targets based on the current position of the weapon 27 and the corresponding conditions detected by the sensor array 175. The video target tracking module 40 after it recognizes a potential target may generate a unique screen marker such as 1602A, 1602B in order to alert the operator of the weapon 27 that the potential target has been recognized by the target tracking module 40.

The screen marker can take on anyone of a variety of shapes and types. According to the exemplary embodiment illustrated in FIG. 16, the potential target 605 having a human form is designated with a screen marker 1602A having the shape of an arrow in which the arrowhead points to the head of the human form of the potential target 605. The potential target 710 having a shape of a vehicle has also been designated with a screen marker 1602B having the shape of an arrow in which arrowhead points to the top portion of the vehicle.

As noted previously, the system 100B is not limited to arrowhead shapes for the screen marker 1602. For example, the video target tracking module 40 may shade or colorize potential targets like potential targets 1102 and 1505. Potential target 1102 having the shape of an animal, like a deer, has been shaded by the video target tracking module 40 with parallel lines. These parallel lines form one exemplary embodiment of the screen marker described above.

Similarly, the potential target 1505 having the shape of a building has been shaded by the video target tracking module 40 with a series of thin parallel lines relative to the parallel lines of the potential target 1102 having the animal shape. The system 100B, and specifically the video target tracking module 40, maybe program such that certain class of objects take on different forms of the screen marker as described above.

So in the exemplary embodiment illustrated in FIG. 16, potential targets 1102 and 1505 which have an animal shape and a building shape respectively may be provided by the video target tracking module 40 with screen markers that comprise special shading as described above. Meanwhile, for potential targets 605 and 710 which have a human shape and vehicle shape respectively may be provided by the video target tracking module 40 with screen markers comprising the arrows 1602A, 1602B as described above.

In the exemplary embodiment illustrated in FIG. 16, the potential target 605 having the human shape has been selected by the operator of the weapon 27 because of the close proximity of the zero point 33 relative to the potential target 605. Once an target 605, 710, 1102, or 1505 has been selected by the operator by positioning the zero point 33 of the weapon in close proximity to the potential target 605, the video target tracking module 40 may position the crosshairs 43 over the selected potential target 605.

Then, the message window 715A may be updated with the data corresponding to the selected potential target 605. Specifically, the message window 715A may have its range field 725, elevation field 735, and wind field 910 updated to reflect those parameters associated with the selected potential target 605.

Meanwhile, as noted above, the video target tracking module 40 in combination with the system host controller 10 and the ballistic computing module 160 may continue to calculate the ballistic solution impact point for the remaining potential targets 710, 1102, and 1505 which have not been selected by the operator of the weapon 27. In this way, if the operator of the weapon 27 decides to switch to another potential target 710, 1102, and 1505, then the system 100B will have the ballistic solution data ready to be displayed within the message window 715A upon selection of the new potential target 710, 1102 and 1505.

The camera 30 of the system 100B may automatically control the zoom and focus on the display 147B. The operator of the weapon 27 may indicate or inform the video target tracking module 40 of the number of potential targets 605, 710, 1102, and 1505 that he or she desires to track with the display 147B. Therefore, if the operator of the weapon 27 desire to track only the potential target 605 having the human shape and the potential target 710 having the vehicle shape, then the video target tracking module 40 in combination with the system host controller 10 would send messages or signals to the camera 30 so that only these two targets would become the focus for the display 147B.

In such a scenario, the camera 30 of system 100B may automatically zoom and/or adjust the focus of display 147B such that the two selected potential targets 605, 710 are only contained or confined within the display 147B. Meanwhile, other potential targets such as the potential target 1102 having the animal shape and the potential target 1505 having the building shape could fall out of view relative to the display 147B because of the automatic adjustment to the zoom or focus of the camera 30 in order to track the selected two targets 605, 710.

The video target tracking module 40 may track one or more potential targets 605, 710, 1102, and 1505. The video target tracking module 40 may be designed to track a predetermined number of targets. According to one exemplary embodiment, the video target tracking module may have a set threshold of ten potential targets to track within the display 147B. However, other thresholds higher or lower than this threshold are not beyond the scope of the disclosure as understood by one of ordinary skill in the art.

Figure 17:
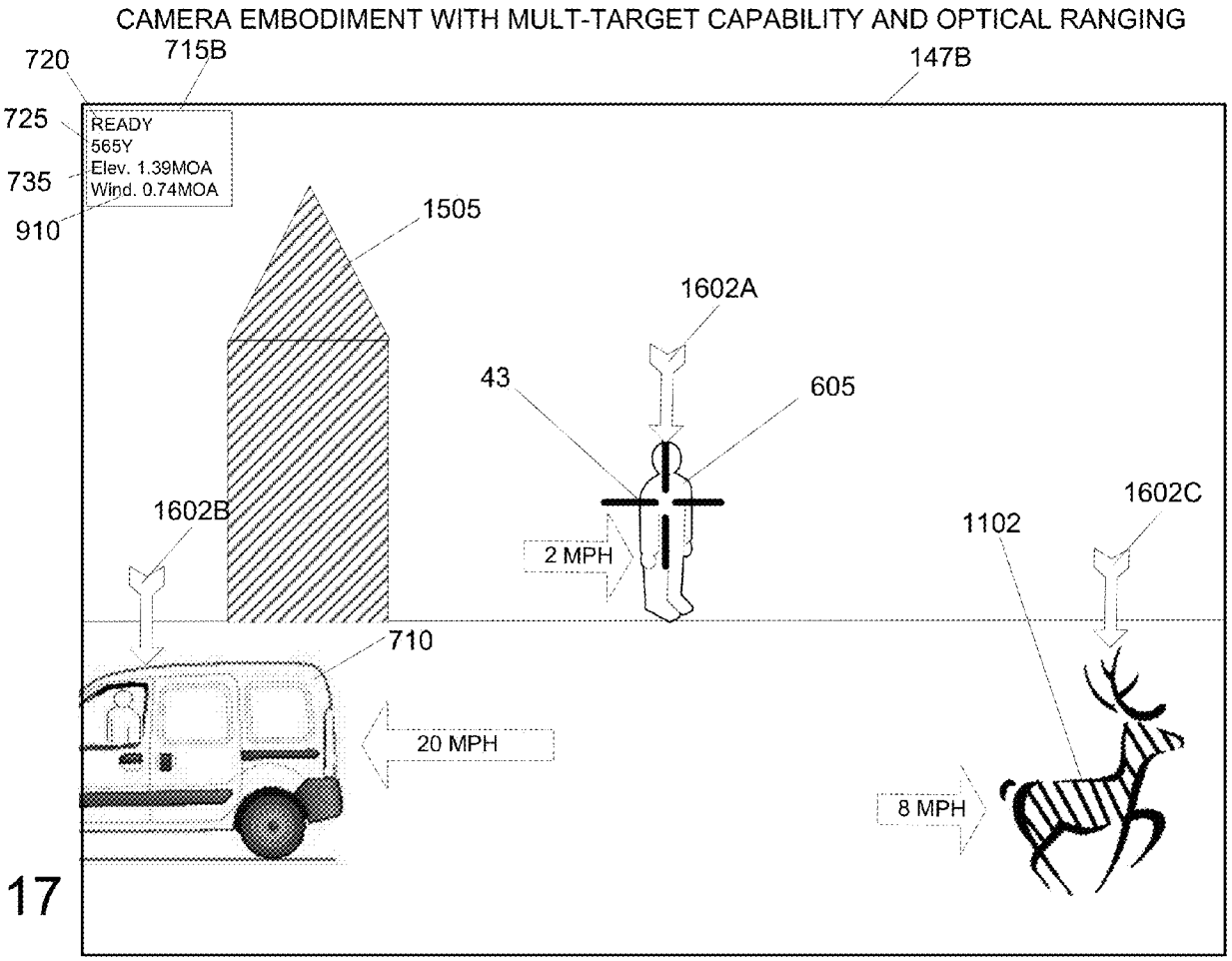
FIG. 17 illustrates an exemplary scene with a plurality of targets corresponding to those of FIG. 16 after movement and as seen and tracked with unique screen markers using a camera embodiment of the ballistic solution system.

FIG. 17 illustrates an exemplary scene with a plurality of targets 605, 710, 1102, and 1505 corresponding to those of FIG. 16 after movement and as seen and tracked with unique screen markers 1602A, 1602B using a camera embodiment of the ballistic solution system 100B. According to this exemplary embodiment, the display 147B is generated by the camera 30 as controlled by the video target tracking module 40 of system 100B. FIG. 17 is similar to FIG. 16. Therefore, only the differences between FIG. 17 and FIG. 16 will be described.

According to this exemplary embodiment of FIG. 17, the some of the potential targets 605, 710, 1102, and 1505 have moved within the display 147B. Dashed arrows have been provided to indicate the movement of the potential targets 605, 710, and 1102. Specifically, the potential target 605 having the human shape, the potential target 710 having the vehicle shape 710, and the potential target 1102 having the animal shape have moved.

The video target tracking module 40 may insure that the screen markers like markers 1602A, 1602B move with their respective potential targets 605, 710, and 1102. The video target tracking module 40 may also use certain screen markers to denote movement. So the arrows 1602A, 1602B, 1602C above targets 605, 710, and 1102 may be projected above a respective target 605, 710, and 1102 only when the video target tracking module 40 has detected movement of the potential target 605, 710, and 1102.

The video target tracking module 40 may also calculate the speed of moving potential targets 605, 710, and 1102 by counting pixels as understood by one of ordinary skill in the art. The video target tracking module 40 in addition to displaying arrows 1602A, 1602B, 1602C above the moving potential targets 605, 710, and 1102 may also display the speed of the potential targets in the message window 715B and/or adjacent to each moving potential target 605, 710, and 1102. Any crosshair 43 displayed on a moving potential target 604, 710, or 1102 will have accounted (by the ballistic computing module 160) for the speed of the moving potential target 605, 710, or 1102.

Relative to the display 147B of FIG. 16, the potential targets 605, 710, and 1102 have moved and the video target tracking module 40 has adjusted the screen markers like 1602A, 1602B, 1602C to move with their respective potential targets 605 and 710. As noted previously, the screen marker for the potential target 1102 having the animal shape comprises shading of the potential target 1102. When the potential target 1102 having the animal shape moved, so did its corresponding shading.

Figure 18:
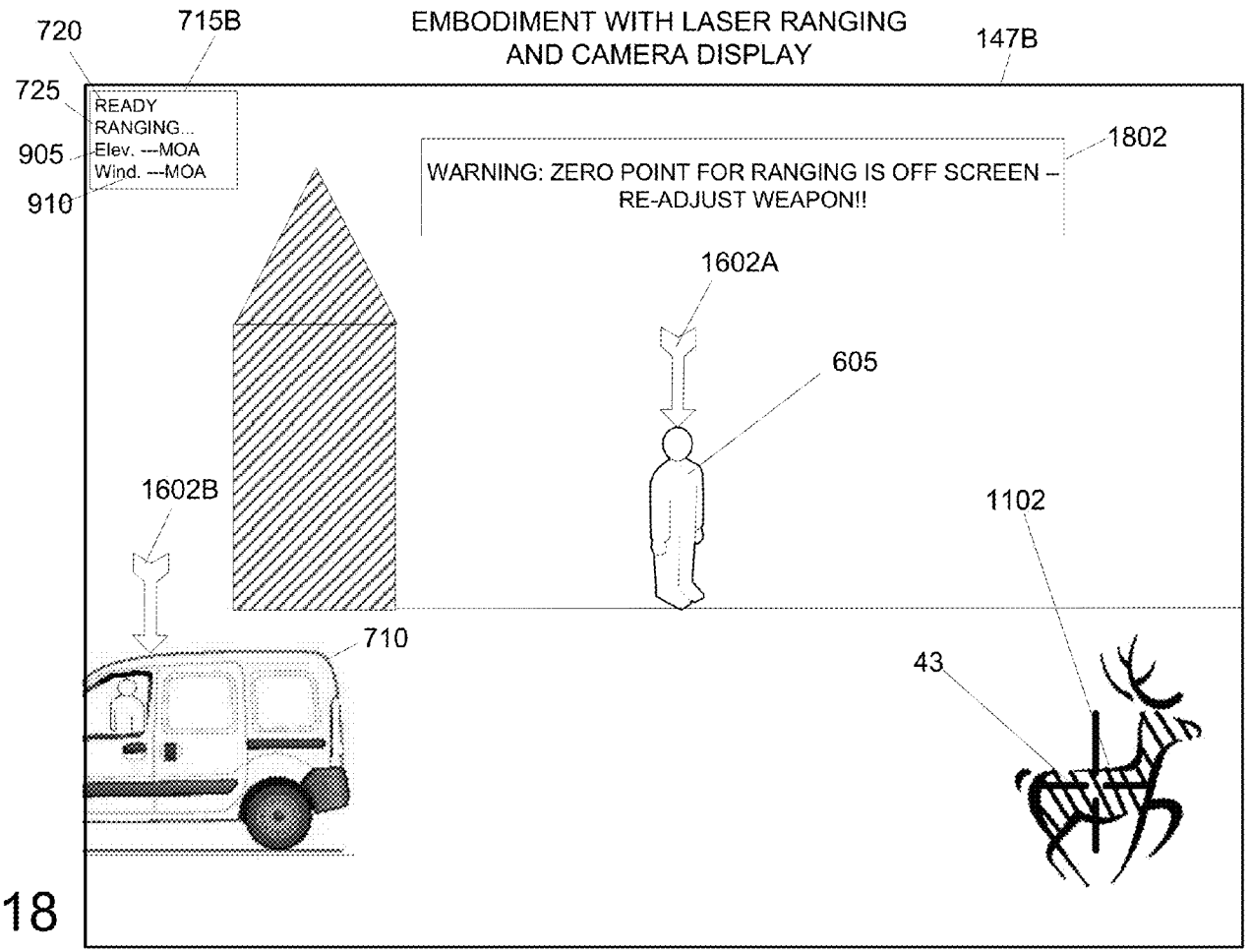
FIG. 18 corresponds with the exemplary scene of FIG. 17 and further includes a warning message when a bullet impact point is off-screen or out of the display according to an exemplary embodiment.

FIG. 18 corresponds with the exemplary scene of FIG. 17 and further includes a warning message 1902 when a zero point 33 (not illustrated) for a ranging system 20 is off-screen or out of the display 147B according to an exemplary embodiment. According to this exemplary embodiment, the display 147B is generated by the camera 30 as controlled video target tracking module 40 of system 100B. FIG. 18 is similar to FIG. 17. Therefore, only the differences between FIG. 18 and FIG. 17 will be described.

According to this exemplary embodiment, the system 100B includes a laser range finder module 20 as illustrated in FIG. 2B. In the exemplary embodiment illustrated in FIG. 18, the selected potential target comprises the potential target 1102 having the animal shape. The crosshairs 43 positioned on the selected potential target 1102 indicates that the ballistics solutions module 100B has calculated the ballistic solutions impact point (corresponding to the crosshairs 43) based on the current position of the weapon 27 and the current environmental conditions (wind, temperature, humidity, barometric pressure, altitude, look angle, cant angle, spin drift, coriolis effect, and movement of the target, etc.)

If the operator of the weapon 27 decides to select another potential target, such as the potential target 710 having the vehicle shape, and if the weapon 27 has a laser range finder 20, then the operator will need to re-position the weapon 27 since the crosshairs 43 in the display 147B of FIG. 18 was projected based on the current position of the weapon 27 which was tailored/specific for the potential target 1102 having the animal shape. If the weapon 27 and system 100B has a laser range finder 20, then when the operator decides to range the newly selected potential target 605 having the human shape, then the video target tracking module 40 will generate an alert 1802 which may comprises a video and/or audible alert.

One exemplary embodiment of a video alert 1802 may comprise an alphanumeric text message that states, "WARNING: ZERO POINT FOR RANGING IS OFF SCREEN—READJUST WEAPON!!" which may be projected on the display 147B. After generating this alert 1802, then the video tracking module 40 may project on a display 147 that includes the zero point 33 for the laser range finder module 20, similar to display 147A as illustrated in FIG. 7A, described above.

Alternatively, after "zeroing" the weapon 27, if the operator of the weapon 27 sees only the zero point 33 and not any crosshairs 43 corresponding a projectile impact point, then video alert 1802 above may be substituted with the following text message that states, "WARNING: PROJECTILE IMPACT POINT IS OFF SCREEN—ADJUST WEAPON FOR DESIRED TARGET!!" Other video and/or audio alerts are included and are not beyond the scope of this disclosure.

While FIG. 7A corresponds to the direct optic embodiment of system 100A1, it is understood by one of ordinary skill in the art that FIG. 7A may be produced with a camera 30 of the system 100B described in connection with FIG. 18. The video target tracking module 40 may readjust the display 147B as illustrated in FIG. 18 so that the camera 30 zooms-in or adjusts the magnification corresponding to the selected target 710 having the vehicle shape, as described in prior examples discussed above.

Similar to FIG. 18, the direct optic embodiment of system 100A1 may also produce the alert 1802 when the operator tries to use a range finder module 20 that is part of the system 100A1. The display 147A of the direct optic embodiment of system 100A1 may support alphanumeric text messages as understood by one of ordinary skill in the art.

Certain steps in the processes or process flows described in this specification naturally precede others for the invention to function as described. However, the method is not limited to the order of the steps described if such order or sequence does not alter the functionality of the invention. That is, it is recognized that some steps may be performed before, after, or in parallel with (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

Additionally, one of ordinary skill in programming is able to write computer code or identify appropriate hardware and/or circuits to implement the disclosed invention without difficulty based on the flow charts and associated description in this specification, for example. Therefore, disclosure of a particular set of program code instructions or detailed hardware devices is not considered necessary for an adequate understanding of how to make and use the invention. The inventive functionality of the claimed computer implemented processes is explained in more detail in this description and in conjunction with the Figures which may illustrate various process flows.

In one or more exemplary aspects, the functions described may be implemented in hardware, software, firmware, or any combination thereof. That is, it is recognized that the ballistic solutions system 100 may be implemented in firmware or hardware or a combination of software with firmware or software. If implemented in software, the functions may be stored on or transmitted as one or more instructions or code on a computer-readable medium.

Computer-readable media include both computer storage media and communication media including any medium that facilitates transfer of a computer program from one place to another. A storage media may be any available media that may be accessed by a computer. By way of example, and not limitation, such computer-readable media may comprise RAM, ROM, EPROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks usually reproduce data magnetically, while discs reproduce data optically with lasers. Combinations of the above should also be included within the scope of computer-readable media.

Figure 19:
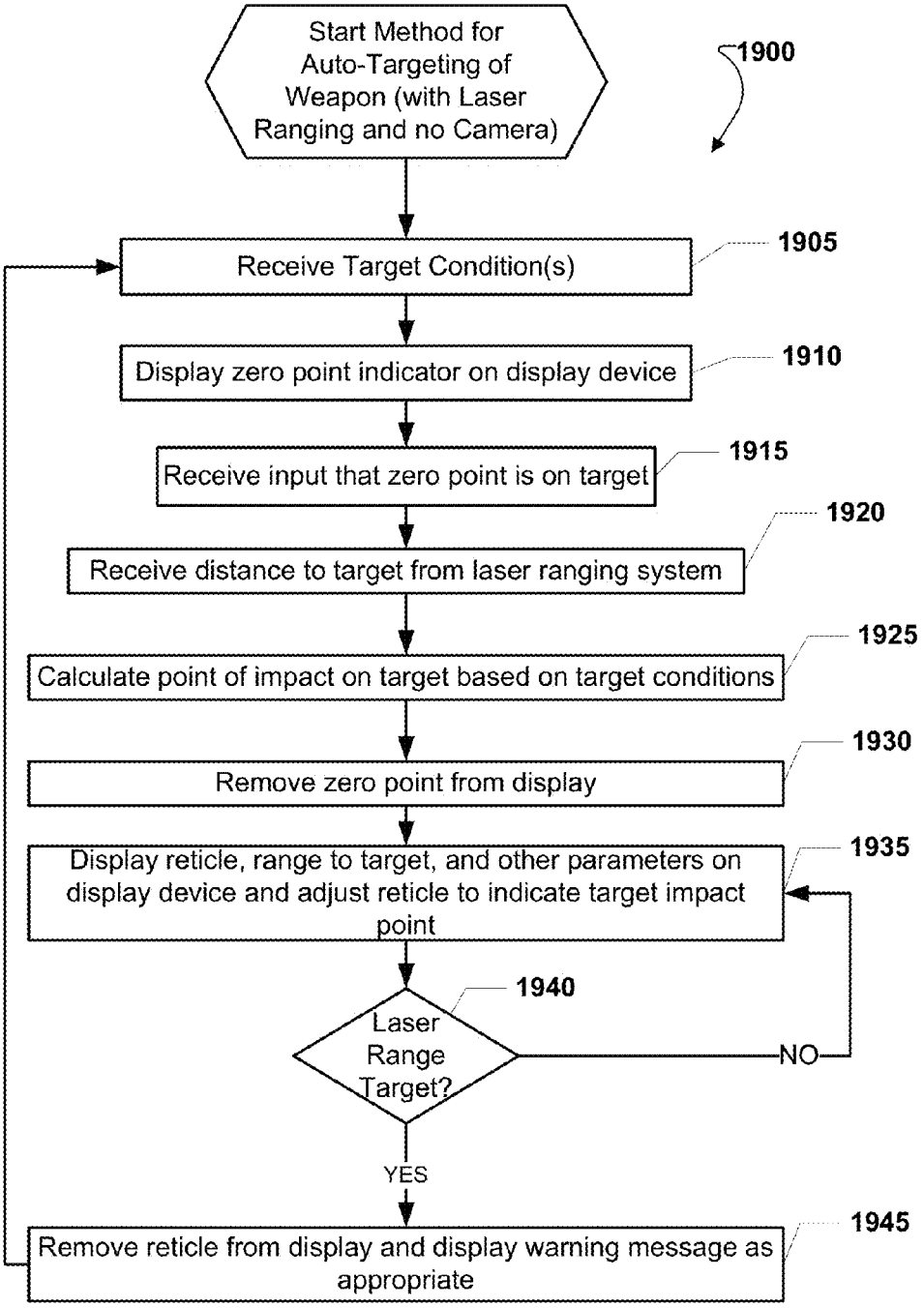
FIG. 19 is a flow chart illustrating an exemplary method for the automatic targeting of a weapon having a laser ranging system but without a camera according to one exemplary embodiment.

FIG. 19 is a flow chart illustrating an exemplary method 1900 for the automatic targeting of a weapon 27 having a laser ranging system 20 but without a camera 30 according to one exemplary embodiment. FIG. 19 generally corresponds with the operation of the exemplary system 100A1 illustrated in FIG. 1B described in detail above. As noted above, the system 100A1 comprises a display 147A that is positioned in front of a direct optic like a rifle scope 17 as understood by one of ordinary skill in the art.

Block 1905 is the first block of the exemplary method 1900 for the automatic targeting of the weapon 27. In Block 1905, the system 100A1 may receive environmental conditions for one of the potential targets 605, 710, 1102, and 1505 that are being tracked within the direct optic 17 by the operator of the weapon 27. The system 100A1 may receive the environmental conditions automatically from sensors 175 or if the system 100A1 does not have any sensors, then it may receive the environmental conditions from input generated by the operator of the weapon 27. Alternatively, if the system 100A1 has a limited number of sensors 175, in block 1905, the system 100A1 may receive the environmental conditions for a target 605, 710, 1102, or 1505 from a combination of the sensors 175 and input received from the operator of the weapon 27. The environmental conditions may include, but are not limited to, wind, temperature, humidity, barometric pressure, altitude, look angle, cant angle, spin drift, etc. as described above.

Next, in block 1910, the system 100A1 may display the zero point indicator 33 on a display 147A as illustrated in FIG. 7A described above. The zero point indicator 33 usually corresponds with the default line of sight (DLOS) of the weapon as described above.

In block 1915, the system 100A1 receives input that the zero point 33 is positioned on potential target, such as potential target 710 as illustrated in FIG. 7A. This input may be generated by the operator of the weapon 27 by partially pulling the trigger of the weapon 27 or by selecting some other user interface to inform the system 100A1 that the zero point 33 of the weapon is positioned on its intended potential target 710.

Next in block 1920, the operator of the weapon 27 may activate the laser range finder module 20 such that it provides its output to the direct optic ballistic solutions system 100A1.

This output from the laser range finder module 20 is usually the distance to the intended target 710 on which the zero point is currently positioned. The distance may be supplied to the system 100A1 in any number of units such as yards, feet, meters, kilometers, etc.

In block 1925, the direct optic ballistic solutions system 100A1, and specifically the ballistics computing module 160, calculates the point of impact for the weapon 27 as it is currently positioned and based on the environmental conditions it received in block 1905. As noted previously, the default line of sight (DLOS) for a weapon 27 corresponding to the zero point 33 as illustrated in FIGS. 7A-7B will not be the same as the point of impact 43 for a projectile launched by the weapon for distances over 100 yards based on the environmental conditions described above.

In block 1930, the direct optic ballistic solutions system 100A1 may remove the zero point 33 from the display 147A as appropriate. Next, in block 1935, the direct optic ballistic solutions system 100A1, and specifically the self correcting reticle module 35, may display the reticle or crosshairs 43, range field 725, and other parameters, like an elevation field 735, a windage field 910, etc. similar to FIG. 7C described above.

Next in decision block 1940, the ballistic solutions system 100A1 may determine if the operator of the weapon 27 desires to range the current target 710 or range a new target. If the inquiry to decision block 1940 is negative, then the "NO" branch is followed back to block 1935. If the inquiry to decision block 1940 is positive, then the "YES" branch is followed to block 1945.

In block 1945, the ballistic solutions system 100A1 may remove the reticle or crosshairs 43 from the display 147A and the system 100A1 may also generate and project the visible alert 1802 (from FIG. 18) on the display 147A. As noted previously, the visible alert 1802 may warn the operator of the weapon 27 that the zero point 33 is not visible yet due to the current position of the weapon 27 relative to the potential target 605, 710, 1102, or 1505. The method 1900 then returns to block 1905.

Figure 20:
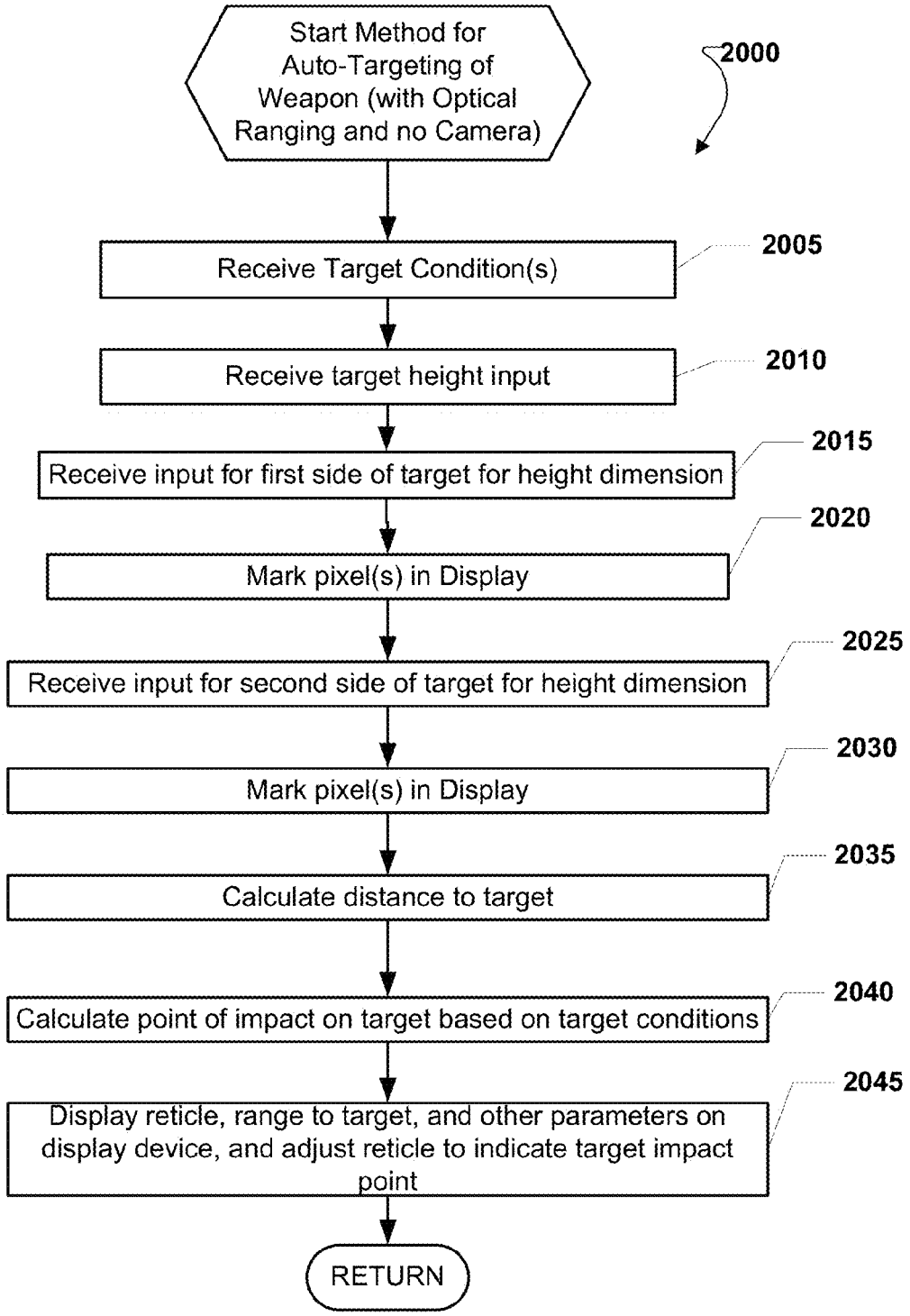
FIG. 20 is a flow chart illustrating an exemplary method for the automatic targeting of a weapon using optical ranging but without a camera according to one exemplary embodiment.

Referring now to FIG. 20, this figure is a flow chart illustrating an exemplary method 2000 for the automatic targeting of a weapon 27 using optical ranging but without a camera 30 according to one exemplary embodiment. Method 2000 generally corresponds with the ballistic solutions system 100A1 illustrated in FIG. 1B but without any laser range finder module 20.

Block 2005 is the first block of method 2000. In block 2005, the system 100A1 may receive the current conditions for a potential target 605, 710, 1102, or 1505. Similar to block 1905 of FIG. 19, the system 100A1 may receive the environmental conditions automatically from sensors 175 or if the system 100A1 does not have any sensors, then it may receive the environmental conditions from input generated by the operator of the weapon 27.

Alternatively, if the system 100A1 has a limited number of sensors 175, in block 2005, the system 100A1 may receive the environmental conditions for a target 605, 710, 1102, or 1505 from a combination of the sensors 175 and input received from the operator of the weapon 27. The environmental conditions may include, but are not limited to, wind, temperature, humidity, barometric pressure, altitude, look angle, cant angle, spin drift, etc. as described above.

In block 2010, the system 100A1 may receive an estimated height of the potential target 605, 705, 1102, and 1505 from the operator of the weapon 27. Next, in block 2015, the system 100A1 may receive a first point of two points for the height of a potential target 605, 710, 1102, or 1505. Block 2010 generally corresponds to FIGS. 11A1, 11 B1 in which the operator of the weapon 27 is indicating the first point of two points for the height of a potential target such as target 605 in FIG. 11A1 and target 1102 in FIG. 11B1. As noted previously, the system 100A1 is not limited to a height dimension: the system 100A1 may just as easily calculate distance based on a width dimension as understood by one of ordinary skill in the art.

In block 2020, the system 100A1 may flag a first a pixel in the display 147A as the first point of a height dimension for a potential target 605. In block 2025, the system 100A1 may receive input for a second side of the potential target 605 for the height dimension. In block 2030, the system 100A1 may flag a second pixel in the display 147A as the second point of a height dimension for a potential target 605.

Next, in block 2035, the system 100A1, and specifically the ballistics computing module 160, may calculate the distance to the potential target 605 similar to the process described above in connection with FIG. 6B in which ratios and similar triangles may be used to calculate distances for a ballistic solution.

In block 2040, the direct optic ballistic solutions system 100A1, and specifically the ballistics computing module 160, calculates the point of impact for the weapon 27 as it is currently positioned and based on the distance calculated in block 2035 and based on the environmental conditions it received in block 2005. As noted previously, the default line of sight (DLOS) for a weapon 27 corresponding to the zero point 33 as illustrated in FIGS. 7A-7B will not be the same as the point of impact 43 for a projectile launched by the weapon for distances over 100 yards based on the environmental conditions described above.

Next, in block 2045, the direct optic ballistic solutions system 100A1, and specifically the self correcting reticle module 35, may display the reticle or crosshairs 43, range field 725, and other parameters, like an elevation field 735, a windage field 910, etc. similar to FIG. 7C described above.

Figure 21:
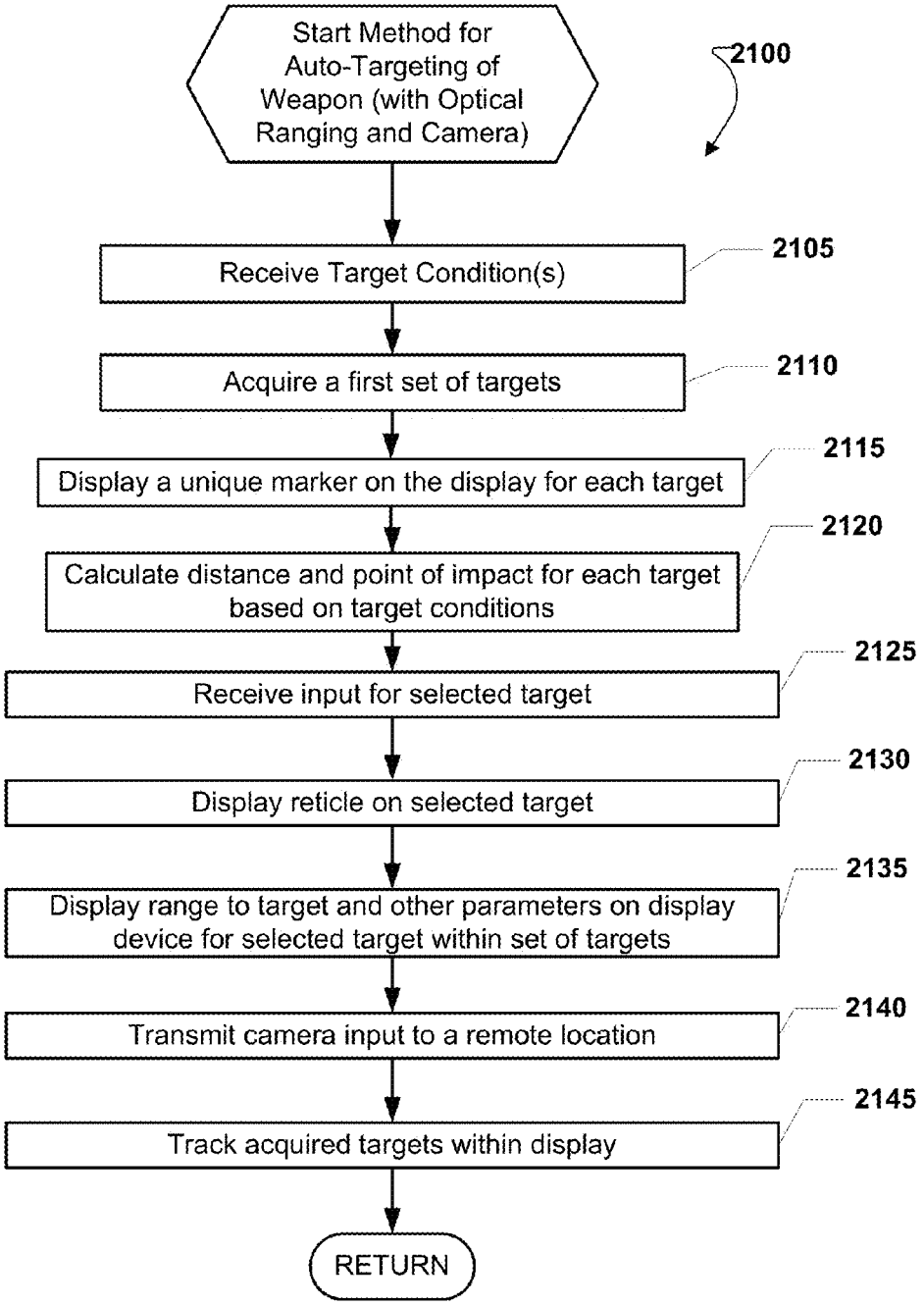
FIG. 21 is a flow chart illustrating an exemplary method for the automatic targeting of a weapon using optical ranging and a camera according to one exemplary embodiment.

FIG. 21 is a flow chart illustrating an exemplary method 2100 for the automatic targeting of a weapon 27 using optical ranging and a camera 30 according to one exemplary embodiment. Method 2100 generally corresponds with the camera embodiment of the ballistic solutions system 100B as illustrated in FIG. 2B described above. Method 2100 also corresponds with the camera displays 147B as illustrated in FIGS. 15-18 described above in which multiple targets 605, 710, 1102, and 1505 may be tracked.

The first block of method 2100 is block 2105. In block 2105, the system 100B may receive the current conditions for a potential target 605, 710, 1102, or 1505. Similar to block 1905 of FIG. 19, the system 100B may receive the environmental conditions automatically from sensors 175 or if the system 100B does not have any sensors 175, then it may receive the environmental conditions from input generated by the operator of the weapon 27.

Alternatively, if the system 100B has a limited number of sensors 175, in block 2105, the system 100B may receive the environmental conditions for a target 605, 710, 1102, or 1505 from a combination of the sensors 175 and input received from the operator of the weapon 27. The environmental conditions may include, but are not limited to, wind, temperature, humidity, barometric pressure, altitude, look angle, cant angle, spin drift, etc. as described above.

In block 2110, the system 100B, and specifically the video target tracking module 40 may acquire a first set of potential targets 605, 710, 1102, and 1505 as illustrated in FIG. 16 as described above. In block 2115, the video target tracking module 40 may display a unique marker 1602A, 1602B on the display 147B for each potential target 605, 710, 1102, and 1505. As described previously, a marker like 1602 may comprise a graphical character such as an arrow as illustrated in FIG. 16. Alternatively, a marker may comprise how a particular potential target is shaded like the potential targets 1102 and 1505 illustrated in FIG. 16. As noted above, the set of potential targets acquired by the video target tracking module 40 may be set at manufacture or it may be determined by the operator of the weapon 27. One exemplary size for the set is ten potential targets. But fewer or a greater number of targets may be selected without departing from the scope of this disclosure.

Next, in block 2120, the ballistic solutions system 100B, and specifically the ballistic computing module 160, may calculate the distance and point of impact for each potential target 605, 710, 1102, and 1505. As noted previously, distance to each potential target may be calculated based on the pixel height determined by the video target tracking module 40 in combination with estimated heights of the targets 605, 710, 1102, and 1505 provided by the operator of the weapon 27. The point of impact for each potential target 605, 710, 1102, and 1505 may be calculated by the ballistic computing module 160 as described above.

Next, in block 2125, the system 100B may receive input for the selected target which could include any one of potential targets 605, 710, 1102, and 1505 illustrated in FIG. 16. The input may comprise positioning the zero point 33 in close proximity to a desired target 605, 710, 1102, or 1505 or some other device/mechanism like a keypad. The operator of the weapon 27 with this input indicates to the system 100B which potential target is desired by the operator.

Next, in block 2130, the video target tracking module 40 in combination with the display 147 project the reticle or crosshairs 43 on the target selected by the operator of the weapon 27. Next, in block 2135, the system 100B displays the range field 735 and other target parameters on the display device 147 such as contained in the message field 715A as illustrated in FIG. 16.

In block 2140, the system host controller 10 may work with the communications module 50 in order to transmit the camera input to a remote location, such as, but not limited to, a commander module 100C as illustrated in FIGS. 13-14. In block 2145, the system 100B may continue to track the acquired targets 605, 710, 1102, and 1505 within the display 147. The method 2100 then returns.

Figure 22:
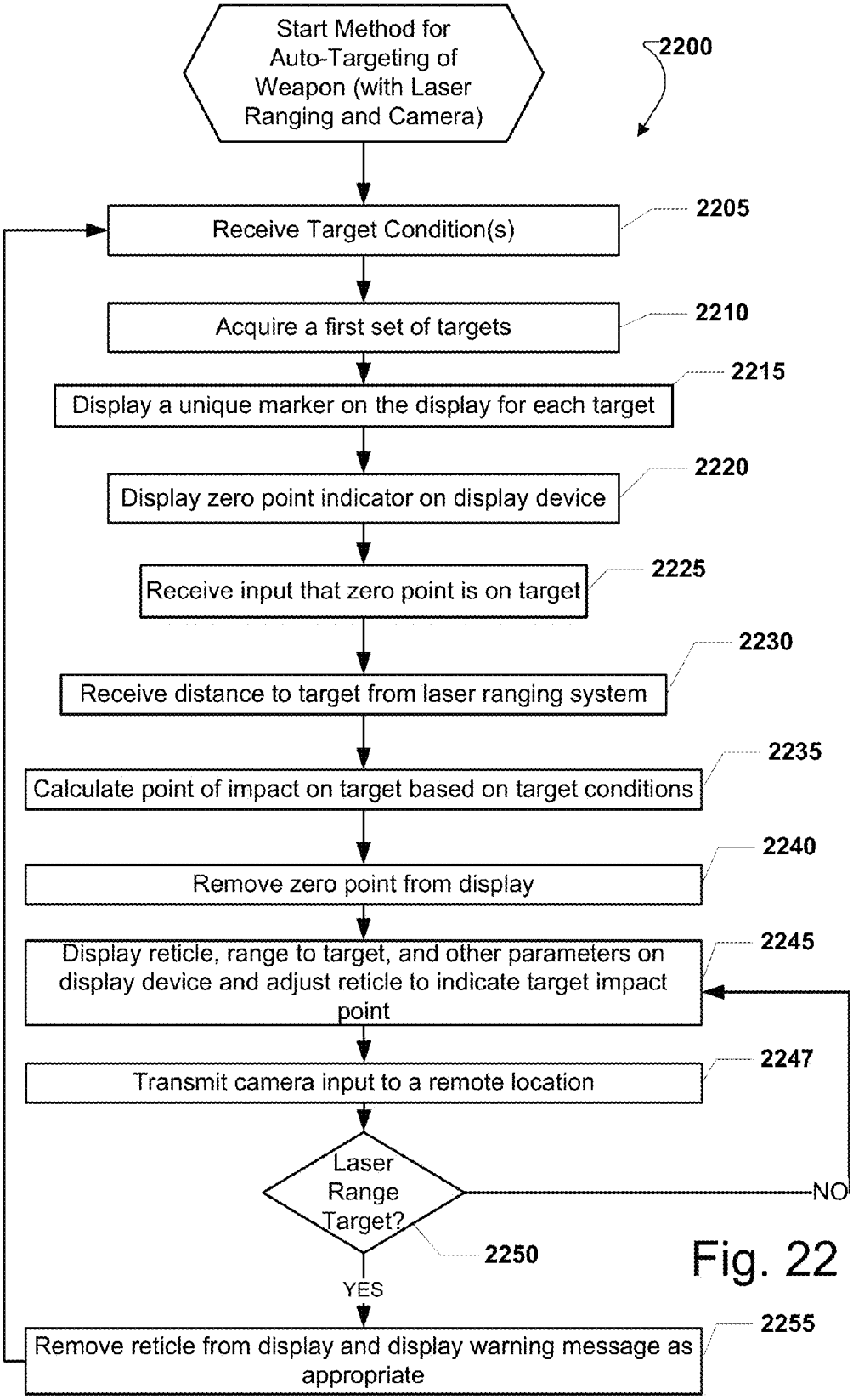
FIG. 22 is a flow chart illustrating an exemplary method for the automatic targeting of a weapon using laser ranging and a camera according to one exemplary embodiment.

FIG. 22 is a flow chart illustrating an exemplary method 2200 for the automatic targeting of a weapon 27 equipped with an optional laser range finder 20 and a camera 30 according to one exemplary embodiment. Method 2200 generally corresponds with the camera embodiment of the ballistic solutions system 100B equipped with the optional laser range finder module 20 as illustrated in FIG. 2B described above. Method 2200 also corresponds with the camera displays 147B as illustrated in FIGS. 15-18 described above in which multiple targets 605, 710, 1102, and 1505 may be tracked.

The first block of method 2200 is block 2205. In block 2205, the system 100B may receive the current conditions for a potential target 605, 710, 1102, or 1505. Similar to block 1905 of FIG. 19, the system 100B may receive the environmental conditions automatically from sensors 175 or if the system 100B does not have any sensors 175, then it may receive the environmental conditions from input generated by the operator of the weapon 27.

Alternatively, if the system 100B has a limited number of sensors 175, in block 2205, the system 100B may receive the environmental conditions for a target 605, 710, 1102, or 1505 from a combination of the sensors 175 and input received from the operator of the weapon 27. The environmental conditions may include, but are not limited to, wind, temperature, humidity, barometric pressure, altitude, look angle, cant angle, spin drift, etc. as described above.

In block 2210, the system 100B, and specifically the video target tracking module 40 may acquire a first set of potential targets 605, 710, 1102, and 1505 as illustrated in FIG. 16 as described above. In block 2215, the video target tracking module 40 may display a unique marker 1602A, 1602B on the display 147B for each potential target 605, 710, 1102, and 1505.

As described previously, a marker like 1602 may comprise a graphical character such as an arrow as illustrated in FIG. 16. Alternatively, a marker may comprise how a particular potential target is shaded like the potential targets 1102 and 1505 illustrated in FIG. 16. As noted above, the set of potential targets acquired by the video target tracking module 40 may be set at manufacture or it may be determined by the operator of the weapon 27. One exemplary size for the set is ten potential targets. But fewer or a greater number of targets may be selected without departing from the scope of this disclosure.

Next, in block 2220, the system 100B may display the zero point indicator 33 on a display 147A, similar to the one illustrated in FIG. 7A described above. The zero point indicator 33 usually corresponds with the default line of sight (DLOS) of the weapon 27 as described above.

In block 2225, the system 100B receives input that the zero point 33 is positioned on potential target, such as potential target 710 as illustrated in FIG. 7A. This input may be generated by the operator of the weapon 27 by partially pulling the trigger of the weapon 27 or by selecting some other user interface to inform the system 100B that the zero point 33 of the weapon 27 is positioned on its intended potential target 710.

Next in block 2230, the operator of the weapon 27 may activate the laser range finder module 20 such that it provides its output to the direct optic ballistic solutions system 100B. This output from the laser range finder module 20 is usually the distance to the intended target 605, 710, 1102, or 1505 on which the zero point 33 is currently positioned. The distance may be supplied to the system 100B in any number of units such as yards, feet, meters, kilometers, etc.

In block 2235, the camera equipped ballistic solutions system 100B, specifically the ballistic computing module 160, calculates the point of impact for the weapon 27 as it is currently positioned and based on the environmental conditions it received in block 2205. As noted previously, the default line of sight (DLOS) for a weapon 27 corresponding to the zero point 33 as illustrated in FIGS. 7A-7B will not be the same as the point of impact 43 for a projectile launched by the weapon for distances over 100 yards based on the environmental conditions described above.

In block 2240, the direct optic ballistic solutions system 100A1 may remove the zero point 33 from the display 147B as appropriate. Next, in block 2245, the camera equipped ballistic solutions system 100B, and specifically the video target tracking module 40, may display the reticle or crosshairs 43, range field 725, and other parameters, like an elevation field 735, a windage field 910, etc. similar to FIG. 16 described above for the selected potential target 605. In block 2247, the system host controller 10 may work with the communications module 50 in order to transmit the camera input to a remote location, such as, but not limited to, a commander module 100C as illustrated in FIGS. 13-14.

Next in decision block 2250, the ballistic solutions system 100B may determine if the operator of the weapon 27 desires to range the current target 605 or range a new target 710, 1102, or 1505. If the inquiry to decision block 2250 is negative, then the "NO" branch is followed back to block 2245. If the inquiry to decision block 2250 is positive, then the "YES" branch is followed to block 2255.

In block 2255, the ballistic solutions system 100B may remove the reticle or crosshairs 43 from the display 147B and the system 100B may also generate and project the visible alert 1802 (from FIG. 18) on the display 147B. As noted previously, the visible alert 1802 may warn the operator of the weapon 27 that the zero point 33 is not visible yet due to the current position of the weapon 27 relative to the potential target 605, 710, 1102, or 1505. The method 2200 then returns to block 2205.

Advantageously, having established a user-defined ratio for the particular distance between reticle markings in an exemplary direct optic, like the scope 17 of FIG. 1A, one of ordinary skill in the art will understand that the system 100 may "mil" distances to targets of known heights by applying the formula described above wherein the ratio of target distance to target height is 5.55556 instead of 27.7778. Moreover, one of ordinary skill will understand that the system defined MIL may also be used to apply ballistic solutions via "holdover" as is known in the art of long range shooting. Further, certain embodiments of a ballistic solutions system 100 may be configured to render ballistic solutions based on a user-defined MIL ratio associated with a particular optical viewing device.

One of the major advancements of the method and system 100 is that the video target tracking module 40 or the self correcting reticle module 35 displays the projectile (i.e. bullet) impact point shown with crosshairs 43 within the marksmen's field of view (on a display device 147). Further, the video target tracking module 40 or self correcting reticle 35 module moves that projectile impact point (crosshairs 43) as the weapon 27 is moved/translated in space by the marksmen while a potential target 605, 710, 1102, or 1505 is tracked by the marksmen. The projectile impact point or crosshairs 43 is moved as the weapon 27 moves since the ballistic computing module 160 is continuously updating its projectile impact point solutions when movement of the weapon changes trajectory of the projectile.

The ballistic solution system 100 has been described using detailed descriptions of exemplary embodiments thereof that are provided by way of example and are not intended to limit the scope of the disclosure. The described embodiments comprise different features, not all of which are required in all embodiments of a ballistic solutions system 100. Some embodiments of a ballistic solutions system 100 utilize only some of the features or possible combinations of the features.

Moreover, some embodiments of a ballistic solutions system 100 may be configured to work in conjunction with multiple optical viewing devices, rifle/scope combinations, field applications, etc. and, as such, it will be understood that multiple instances of a ballistic solutions system 100, wherein each instance may utilize only some of the features or possible combinations of the features, may be reside within a single embodiment of a given ballistic solutions system 100. Variations of embodiments of a ballistic solutions system 100 that are described and embodiments of a ballistic solutions system 100 comprising different combinations of features noted in the described embodiments will occur to one of ordinary skill in the art.

Therefore, although selected aspects have been illustrated and described in detail, it will be understood that various substitutions and alterations may be made therein without departing from the spirit and scope of the present invention, as defined by the following claims.

What is claimed is:

1. A method for automatically calculating a trajectory of a projectile launched from a weapon, comprising:

receiving one or more environmental conditions relative to the weapon;

determining a distance to a potential target from the weapon;

automatically calculating a point of impact for the projectile on the potential target based on the distance and environmental conditions;

displaying a graphical indicator on a display device corresponding to the potential target that denotes the point of impact for the projectile on the potential target; and generating an alert when the point of impact is not visible on the display, wherein the alert is at least one of an audible alert and a visual alert displayed on the display device.

2. The method of claim 1, wherein receiving environmental conditions relative to the weapon further comprises receiving data for at least one of: wind, temperature, humidity, barometric pressure, altitude, look angle, cant angle, spin drift, and coriolis effect relative to the weapon.

3. The method of claim 2, wherein the one or more environmental conditions received are produced by at least one sensor.

4. The method of claim 1, further comprising:

displaying a zero point for the weapon on a display device.

5. The method of claim 4, further comprising:

generating a alert when the point of impact is not visible on the display device.

6. The method of claim 5, further comprising:

generating a unique marker for the potential target; and displaying the unique marker on the display device that tracks the potential target.

7. The method of claim 5, further comprising:

transmitting the image of the potential target to a remote location relative to the weapon.

8. The method of claim 7, further comprising:

transmitting the image of the potential target over at least one of a wired medium and wireless medium.

9. The method of claim 8, wherein the wireless medium comprises at least one of radio-frequency (RF), acoustic, magnetic, optical, and infra-red mediums.

10. A method for automatically calculating a trajectory of a projectile launched from a weapon, comprising:

receiving one or more environmental conditions relative to the weapon;

determining a distance to a potential target from the weapon;

automatically calculating a point of impact for the projectile on the potential target based on the distance and environmental conditions; and displaying a first graphical marker on a display device corresponding to the potential target that denotes the point of impact for the projectile on the potential target;

displaying a second graphical marker on the display device corresponding to at least one of a height dimension and a width dimension of a the potential target; and calculating a distance to the potential target by counting pixels between two graphical markers denoting at least one of a height dimension and a width dimension.

11. The method of claim 10, further comprising:

determining a speed of the potential target; and displaying the graphical indicator over the potential target while it is moving across the display device.

12. The method of claim 11, further comprising:

automatically moving the graphical indicator to correspond with any movement of the weapon in order to track the potential target in the display device.

13. A computer system for automatically calculating a trajectory of a projectile launched from a weapon, comprising:

a processing element operable for:

receiving one or more environmental conditions relative to the weapon;

determining a distance to a potential target from the weapon;

automatically calculating a point of impact for the projectile on the potential target based on the distance and environmental conditions;

displaying a graphical indicator on a display device corresponding to the potential target that denotes the point of impact for the projectile on the potential target; and generating an alert when the point of impact is not visible on the display device, wherein the alert is at least one of an audible alert and a visual alert displayed on the display device.

14. The computer system of claim 13, wherein the processing element comprises at least one of a single central processing unit, a multicore processor, and an application specific integrated chip (ASIC).

15. The computer system of claim 13, wherein the processing element is further operable for:

automatically moving the graphical indicator to correspond with any movement of the weapon in order to track the potential target in the display device.

16. The computer system of claim 13, wherein the display device is coupled to at least one of a direct optic and a camera.

17. The computer system of claim 13, wherein the processing element is further operable for:

generating a unique marker for the potential target; and displaying the unique marker on the display device that tracks the potential target.

* * * * *